US008756068B2

(12) United States Patent
Kikuiri et al.

(10) Patent No.: US 8,756,068 B2
(45) Date of Patent: Jun. 17, 2014

(54) SPEECH DECODER, SPEECH ENCODER, SPEECH DECODING METHOD, SPEECH ENCODING METHOD, STORAGE MEDIUM FOR STORING SPEECH DECODING PROGRAM, AND STORAGE MEDIUM FOR STORING SPEECH ENCODING PROGRAM

(71) Applicant: NTT DoCoMo, Inc., Tokyo (JP)

(72) Inventors: Kei Kikuiri, Tokyo (JP); Atsushi Yamaguchi, Tokyo (JP)

(73) Assignee: NTT DoCoMo, Inc., Tokyo (JP)

( * ) Notice: Subject to any disclaimer, the term of this patent is extended or adjusted under 35 U.S.C. 154(b) by 0 days.

(21) Appl. No.: 13/968,898

(22) Filed: Aug. 16, 2013

(65) Prior Publication Data

US 2013/0339010 A1 Dec. 19, 2013

Related U.S. Application Data

(63) Continuation of application No. PCT/JP2012/053700, filed on Feb. 16, 2012.

(30) Foreign Application Priority Data

Feb. 18, 2011 (JP) ..... 2011-033917
Sep. 29, 2011 (JP) ..... 2011-215591

(51) Int. Cl.
*G10L 19/00* (2013.01)

(52) U.S. Cl.
USPC ..... 704/500

(58) Field of Classification Search
USPC ..... 704/500–504
See application file for complete search history.

(56) References Cited

U.S. PATENT DOCUMENTS

| | | | | |
|---|---|---|---|---|
| 2004/0125878 | A1* | 7/2004 | Liljeryd et al. | 375/242 |
| 2005/0143985 | A1* | 6/2005 | Sung et al. | 704/219 |
| 2006/0023888 | A1* | 2/2006 | Henn et al. | 381/1 |
| 2006/0029231 | A1* | 2/2006 | Henn et al. | 381/1 |
| 2006/0122828 | A1* | 6/2006 | Lee et al. | 704/219 |
| 2006/0271356 | A1* | 11/2006 | Vos | 704/222 |
| 2007/0088541 | A1* | 4/2007 | Vos et al. | 704/219 |
| 2007/0088542 | A1* | 4/2007 | Vos et al. | 704/219 |
| 2008/0126086 | A1* | 5/2008 | Vos et al. | 704/225 |
| 2008/0189116 | A1* | 8/2008 | LeBlanc et al. | 704/500 |
| 2012/0010879 | A1 | 1/2012 | Tsujino et al. | |
| 2013/0138432 | A1 | 5/2013 | Tsujino et al. | |

FOREIGN PATENT DOCUMENTS

| | | | |
|---|---|---|---|
| JP | 2006-243644 | A | 9/2006 |
| WO | WO 2010/114123 | A1 | 10/2010 |

OTHER PUBLICATIONS

International Search Report for International Application No. PCT/JP2012/053700, dated May 22, 2012, 2 pages.

* cited by examiner

*Primary Examiner* — Michael N Opsasnick
(74) *Attorney, Agent, or Firm* — Brinks Gilson & Lione

(57) ABSTRACT

A speech decoder includes a demultiplexing unit, a low frequency band decoding unit, a band splitting filter bank unit, a coded sequence analysis unit, a coded sequence decoding/dequantization unit, a high frequency band generation unit, low frequency band time envelope calculation units that acquire a plurality of low frequency band time envelopes, a time envelope calculation unit that calculates high frequency band time envelopes using time envelope information and the plurality of low frequency band time envelopes, a time envelope adjustment unit that adjusts the time envelope of high frequency band components using the time envelopes obtained by the time envelope calculation unit, and a band synthesis filter bank unit.

21 Claims, 40 Drawing Sheets

SPEECH DECODER, SPEECH ENCODER, SPEECH DECODING METHOD, SPEECH ENCODING METHOD, STORAGE MEDIUM FOR STORING SPEECH DECODING PROGRAM, AND STORAGE MEDIUM FOR STORING SPEECH ENCODING PROGRAM

RELATED APPLICATIONS

This application is a continuation of PCT/JP2012/053700 filed on Feb. 16, 2012, which claims priority to Japanese Application Nos. 2011-033917 filed on Feb. 18, 2011 and 2011-215591 filed on Sep. 29, 2011. The entire contents of these applications are incorporated herein by reference.

TECHNICAL FIELD

The present invention relates to a speech decoder, a speech encoder, a speech decoding method, a speech encoding method, a storage medium for storing a speech decoding program, and a storage medium for storing a speech encoding program.

BACKGROUND ART

Speech and audio coding technologies that compress the amount of data in a signal to one-several tenths by removing information which is not necessarily perceived by a human according to the auditory psychology is a significantly important technology in connection with transmission and accumulation of signals. An example of widely used perceptual audio coding techniques is MPEG4 AAC (Advanced Audio Coding) standardized by ISO/IEC MPEG (Moving Picture Experts Group).

Further, as a method for improving the performance of speech coding and obtaining high speech quality at a low bit rate, a bandwidth extension technology that generates high frequency band components of a speech using low frequency band components thereof has been widely used recently. A typical example of the bandwidth extension technology is the SBR (Spectral Band Replication) technology used in MPEG4 AAC. The SBR technology generates high frequency band components by performing, on a signal transformed into the frequency domain by QMF (Quadrature Mirror Filter) bank, copying spectral coefficients from a low frequency band to a high frequency band and thereafter adjusts the high frequency band components by adjusting the spectral envelope and tonality of the replicated coefficients. Adjustment of the spectral envelope and tonality will be referred hereinafter to as "adjustment of frequency envelope". The speech encoding method using such a bandwidth extension technology can reproduce high frequency band components of a signal using only a small amount of supplementary information, and it is thus effective to achieve lower bit rate of speech coding.

In the bandwidth extension technology in the frequency domain such as SBR, since the frequency envelope is adjusted to the spectral coefficients expressed in the frequency domain, when an audio signal with large variations of time envelope, such as a speech signal, a clapping sound or a castanet sound, is encoded, there is a case where reverberant noise called pre-echo or post-echo may be perceived in a decoded signal. This problem is caused by the fact that the time envelope of high frequency band components is deformed in the process of adjustment and, in many cases, becomes flatter in shape than before the adjustment. The time envelope of high frequency band components that has become flat as a result of the adjustment does not coincide with the time envelope of high frequency band components in the original signal before encoding and causes pre-echoes or post-echoes.

As a solution to this problem, the following method is known (see WO/2010/114123). Specifically, the method acquires the electric power of low frequency band components for each time slot of a frequency domain signal, extracts time envelope information from the acquired power, and superimposes the extracted time envelope information onto high frequency band components that are adjusted using supplementary information and then processed to adjust the frequency envelope. This method is referred hereinafter to as "a method of time envelope deformation".

It is thereby possible to adjust the time envelope of a decoded signal to have a less distorted shape and obtain a reproduced signal with less pre-echo and post-echo.

SUMMARY OF INVENTION

In an example of a time envelope deformation method such as described in WO/2010/114123, after a decoded signal is obtained which contains only low frequency band components which are obtained on the basis of an inputted, multiplexed bit stream, a signal in the QMF domain is obtained from the decoded signal. Further, time envelope information is acquired from the signal in the QMF domain, and the time envelope information is adjusted using parameters. Thereafter, using the adjusted time envelope information, a time envelope deformation process is performed on the signal in the QMF domain obtained from high frequency band components of.

However, in the above-described time envelope deformation method, because the time envelope deformation process is performed using single time envelope information which is a function of time obtained from the signal in the QMF domain obtained from the low frequency band components, when the time envelope of the low frequency band components and the time envelope of the high frequency band components are not sufficiently correlated, it is difficult to adjust the waveform of the time envelope. As a result, pre-echoes and post-echoes in the decoded signal tend to be not sufficiently reduced.

The present invention has been made in view of the above problem and provides a speech decoder, a speech encoder, a speech decoding method, a speech encoding method, a speech decoding program, and a speech encoding program in which by adjusting the time envelope of a decoded signal to have a less distorted shape, a reproduced signal is obtained whose pre-echoes and post-echoes are sufficiently reduced.

To solve the above problem, a decoder according to one aspect of the invention is a speech decoder that decodes a coded sequence of an encoding speech signal. The speech decoder comprises demultiplexing means for demultiplexing the coded sequence into a low frequency band coded sequence and a high frequency band coded sequence, low frequency band decoding means for decoding the low frequency band coded sequence demultiplexed by the demultiplexing means and obtaining a low frequency band signal, and frequency transformation means for transforming the low frequency band signal, which is obtained by the low frequency band decoding means, into a frequency domain. The speech decoder comprises high frequency band coded sequence analysis means for analyzing the high frequency band coded sequence demultiplexed by the demultiplexing means and acquiring supplementary information for high frequency band generation and time envelope information, and coded sequence decoding and dequantization means for decoding and inversely quantizing the supplementary information for high frequency band generation and the time envelope information acquired by the high frequency band coded sequence analysis means. The speech decoder comprises high frequency band generation means for generating, using the supplementary information for high frequency band generation decoded by the coded sequence decoding and dequantization means, high frequency band components in the frequency domain of the speech signal from the low frequency band signal transformed into the frequency domain by the frequency transformation means. The speech decoder further comprises first to Nth (N is an integer equal to or larger than two) low frequency band time envelope calculation means for analyzing the low frequency band signal transformed into the frequency domain by the frequency transformation means and acquiring time envelopes for a plurality of low frequency bands, and time envelope calculation means for calculating a time envelop for a high frequency band using the time envelope information acquired by the coded sequence decoding and dequantization means and the plurality of low frequency band time envelopes acquired by the low frequency band time envelope calculation means. The speech decoder comprises time envelope adjustment means for adjusting, using the time envelope acquired by the time envelope calculation means, a time envelope of the high frequency band components generated by the high frequency band generation means, and inverse frequency transformation means for adding the high frequency band components adjusted by the time envelope adjustment means and the low frequency band signal decoded by the low frequency band decoding means and outputting a time domain signal containing entire frequency band components.

A decoder according to another aspect of the invention is a speech decoder that decodes a coded sequence of an encoding speech signal. The speech decoder comprises a demultiplexing unit for demultiplexing the coded sequence into a low frequency band coded sequence and a high frequency band coded sequence, a low frequency band decoding unit for decoding the low frequency band coded sequence, which is demultiplexed by the demultiplexing unit, and obtaining a low frequency band signal, a frequency transformation unit for transforming the low frequency band signal, which is obtained by the low frequency band decoding unit, into a frequency domain, and a high frequency band coded sequence analysis unit for analyzing the high frequency band coded sequence, which is demultiplexed by the demultiplexing unit, and acquiring supplementary information for high frequency band generation, frequency envelope information, and time envelope information. The speech decoder further comprises a coded sequence decoding and dequantization unit for decoding and inversely quantizing the supplementary information for high frequency band generation, the frequency envelope information, and the time envelope information acquired by the high frequency band coded sequence analysis unit, a high frequency band generation unit for generating, using the supplementary information for high frequency band generation decoded by the coded sequence decoding and dequantization unit, high frequency band components in the frequency domain of the speech signal from the low frequency band signal transformed into the frequency domain by the frequency transformation unit. The speech decoder further comprises a first to Nth (N is an integer equal to or larger than two) low frequency band time envelope calculation unit for analyzing the low frequency band signal, which is transformed into the frequency domain by the frequency transformation unit, and acquiring time envelopes for a plurality of low frequency bands, and a time envelope calculation unit for calculating a high frequency band time envelope, using the time envelope information acquired by the coded sequence decoding and dequantization unit and the plurality of low frequency band time envelopes acquired by the low frequency band time envelope calculation unit. The speech decoder further comprises a frequency envelope superposition unit for superimposing the frequency envelope information, which is acquired by the coded sequence decoding and dequantization unit, onto the high frequency band time envelope and acquiring a time-frequency envelope, a time-frequency envelope adjustment unit for adjusting, using the time envelope acquired by the time envelope calculation unit and the time-frequency envelope acquired by the frequency envelope superposition unit, a time envelope and a frequency envelope of the high frequency band components generated by the high frequency band generation unit, and an inverse frequency transformation unit for adding the high frequency band components, which are adjusted by the time-frequency envelope adjustment unit, and the low frequency band signal, which is decoded by the low frequency band decoding unit, and outputting a time domain signal containing entire frequency band components.

A decoder according to yet another aspect of the invention is a speech decoder that decodes a coded sequence of an encoding speech signal. The speech decoder comprises a demultiplexing unit for demultiplexing the coded sequence into a low frequency band coded sequence and a high frequency band coded sequence, a low frequency band decoding unit for decoding the low frequency band coded sequence demultiplexed by the demultiplexing unit and obtaining a low frequency band signal, a frequency transformation unit for transforming the low frequency band signal, which is obtained by the low frequency band decoding unit, into a frequency domain, and a high frequency band coded sequence analysis unit for analyzing the high frequency band coded sequence demultiplexed by the demultiplexing unit and acquiring coded supplementary information for high frequency band generation, frequency envelope information, and time envelope information. The speech decoder further comprises a coded sequence decoding and dequantization unit for decoding and inversely quantizing the supplementary information for high frequency band generation, the frequency envelope information, and the time envelope information acquired by the high frequency band coded sequence analysis unit, a high frequency band generation unit for generating, using the supplementary information for high frequency band generation decoded by the coded sequence decoding and dequantization unit, high frequency band components in the frequency domain of the speech signal from the low frequency band signal transformed into the frequency domain by the frequency transformation unit, a first to Nth (N is an integer equal to or larger than two) low frequency band time envelope calculation unit for analyzing the low frequency band signal transformed into the frequency domain by the frequency transformation unit and acquiring time envelopes for a plurality of low frequency bands, and a time envelope calculation unit for calculating a high frequency band time envelope using the time envelope information, which is acquired by the coded sequence decoding and dequantization unit, and the plurality of low frequency band time envelopes, which are acquired by the low frequency band time envelope calculation unit. The speech decoder further comprises a frequency envelope calculation unit for calculating a frequency envelope using the frequency envelope information acquired by the coded sequence decoding and dequantization unit, a time-frequency envelope adjustment unit for adjusting, using the time envelope acquired by the time envelope calculation unit and the frequency envelope acquired by the frequency envelope calculation unit, a time envelope and a frequency envelope of the high frequency band components generated by the high frequency band generation unit, and an inverse frequency transformation unit for adding the high frequency band components, which are adjusted by the time-frequency envelope adjustment unit, and the low frequency band signal, which is decoded by the low frequency band decoding unit, and outputting a time domain signal containing the entire frequency band components.

A decoding method according to one aspect of the invention is a speech decoding method of decoding a coded sequence of an encoded speech signal. The method comprises a demultiplexing step, performed by a demultiplexing unit, of demultiplexing the coded sequence into a low frequency band coded sequence and a high frequency band coded sequence, a low frequency decoding step, performed by a low frequency band decoding unit, of decoding the low frequency band coded sequence demultiplexed by the demultiplexing unit and obtaining a low frequency band signal, a frequency transformation step, performed by a frequency transformation unit, of transforming the low frequency band signal, which is obtained by the low frequency band decoding unit, into a frequency domain, a high frequency band coded sequence analysis step, performed by a high frequency band coded sequence analysis unit, of analyzing the high frequency band coded sequence demultiplexed by the demultiplexing unit and acquiring supplementary information for high frequency band generation and time envelope information. The step further comprises a coded sequence decoding and dequantization step, performed by a coded sequence decoding and dequantization unit, of decoding and inversely quantizing the supplementary information for high frequency band generation and the time envelope information acquired by the high frequency band coded sequence analysis unit, a high frequency band generation step, performed by a high frequency band generation unit, of generating, using the supplementary information for high frequency band generation decoded by the coded sequence decoding and dequantization unit, high frequency band components in the frequency domain of the speech signal from the low frequency band signal, which is transformed into the frequency domain by the frequency transformation unit. The method further comprises a first to Nth (N is an integer equal to or larger than two) low frequency band time envelope calculation step, performed by a first to Nth low frequency band time envelope calculation unit, of analyzing the low frequency band signal, which is transformed into the frequency domain by the frequency transformation unit, and acquiring time envelopes for a plurality of low frequency bands, a time envelope calculation step, performed by a time envelope calculation unit, of calculating a high frequency band time envelope using the time envelope information, which is acquired by the coded sequence decoding and dequantization unit, and the plurality of low frequency band time envelopes, which are acquired by the low frequency band time envelope calculation unit, a time envelope adjustment step, performed by the time envelope adjustment unit, of adjusting, using the time envelope acquired by the time envelope calculation unit, a time envelope of the high frequency band components generated by the high frequency band generation unit, and an inverse frequency transformation step, performed by an inverse frequency transformation unit, of adding the high frequency band components, which are adjusted by the time envelope adjustment unit, and the low frequency band signal, which is decoded by the low frequency band decoding unit, and outputting a time domain signal containing the entire frequency band components.

A decoding method according to another aspect of the invention is a speech decoding method of decoding a coded sequence of an encoded speech signal. The method comprises a demultiplexing step, performed by a demultiplexing unit, of demultiplexing the coded sequence into a low frequency band coded sequence and a high frequency band coded sequence, a low frequency decoding step, performed by a low frequency band decoding unit, of decoding the low frequency band coded sequence demultiplexed by the demultiplexing unit and obtaining a low frequency band signal, a frequency transformation step, performed by a frequency transformation unit, of transforming the low frequency band signal, which is obtained by the low frequency band decoding unit, into a frequency domain, a high frequency band coded sequence analysis step, performed by a high frequency band coded sequence analysis unit, of analyzing the high frequency band coded sequence demultiplexed by the demultiplexing unit and acquiring supplementary information for high frequency band generation, frequency envelope information, and time envelope information. The method further comprises coded sequence decoding and dequantization step, performed by a coded sequence decoding and dequantization unit, of decoding and inversely quantizing the supplementary information for high frequency band generation, the frequency envelope information, and the time envelope information acquired by the high frequency band coded sequence analysis unit, a high frequency band generation step, performed by a high frequency band generation unit, of generating, using the supplementary information for high frequency band generation decoded by the coded sequence decoding and dequantization unit, high frequency band components in the frequency domain of the speech signal from the low frequency band signal transformed into the frequency domain by the frequency transformation unit. The method further comprises first to Nth (N is an integer equal to or larger than two) low frequency band time envelope calculation step, performed by a first to Nth low frequency band time envelope calculation unit, of analyzing the low frequency band signal transformed into the frequency domain by the frequency transformation unit and acquiring time envelopes for a plurality of low frequency bands, a time envelope calculation step, performed by a time envelope calculation unit, of calculating a high frequency band time envelope using the time envelope information, which is acquired by the coded sequence decoding and dequantization unit, and the plurality of low frequency band time envelopes, which are acquired by the low frequency band time envelope calculation unit, a frequency envelope superposition step, performed by a frequency envelope superposition unit, of superimposing the frequency envelope information, which is acquired by the coded sequence decoding and dequantization unit, onto the high frequency band time envelope and acquiring a time-frequency envelope, a time-frequency envelope adjustment step, performed by a time-frequency envelope adjustment unit, of adjusting, using the time envelope acquired by the time envelope calculation unit and the time-frequency envelope acquired by the frequency envelope superposition unit, a time envelope and a frequency envelope of the high frequency band components generated by the high frequency band generation unit and an inverse frequency transformation step, performed by an inverse frequency transformation unit, of adding the high frequency band components, which are adjusted by the time-frequency envelope adjustment unit, and the low frequency band signal, which is decoded by the low frequency band decoding unit, and outputting a time domain signal containing the entire frequency band components.

A decoding method according to yet another aspect of the invention is a speech decoding method of decoding a coded sequence of an encoded speech signal. The method comprises a demultiplexing step, performed by a demultiplexing unit, of demultiplexing the coded sequence into a low frequency band coded sequence and a high frequency band coded sequence, a low frequency band decoding step, performed by a low frequency band decoding unit, of decoding the low frequency band coded sequence demultiplexed by the demultiplexing unit and obtaining a low frequency band signal, a frequency transformation step, performed by a frequency transformation unit, of transforming the low frequency band signal, which is obtained by the low frequency band decoding unit, into a frequency domain, a high frequency band coded sequence analysis step, performed by high frequency band coded sequence analysis unit, of analyzing the high frequency band coded sequence demultiplexed by the demultiplexing unit and acquiring supplementary information for high frequency band generation, frequency envelope information, and time envelope information, The method further comprises a coded sequence decoding and dequantization step, performed by coded sequence decoding and dequantization unit, of decoding and inversely quantizing the supplementary information for high frequency band generation, the frequency envelope information, and the time envelope information acquired by the high frequency band coded sequence analysis unit, a high frequency band generation step, performed by a high frequency band generation unit, of generating, using the supplementary information for high frequency band generation decoded by the coded sequence decoding and dequantization unit, high frequency band components in the frequency domain of the speech signal from the low frequency band signal transformed into the frequency domain by the frequency transformation unit. The method further comprises a first to Nth (N is an integer equal to or larger than two) low frequency band time envelope calculation step, performed by a first to Nth low frequency band time envelope calculation unit, of analyzing the low frequency band signal transformed into the frequency domain by the frequency transformation unit and acquiring time envelopes for a plurality of low frequency bands, a time envelope calculation step, performed by a time envelope calculation unit, of calculating a high frequency band time envelope using the time envelope information, which is acquired by the coded sequence decoding and dequantization unit, and the plurality of low frequency band time envelopes, which are acquired by the low frequency band time envelope calculation unit, a frequency envelope calculation step, performed by a frequency envelope calculation unit, of calculating a frequency envelope using the frequency envelope information acquired by the coded sequence decoding and dequantization unit, a time-frequency envelope adjustment step, performed by a time-frequency envelope adjustment unit, of adjusting, using the time envelope acquired by the time envelope calculation unit and the frequency envelope acquired by the frequency envelope calculation unit, a time envelope and a frequency envelope of the high frequency band components generated by the high frequency band generation unit, and an inverse frequency transformation step, performed by an inverse frequency transformation unit, of adding the high frequency band components, which are adjusted by the time-frequency envelope adjustment unit, and the low frequency band signal, which is decoded by the low frequency band decoding unit, and outputting a time domain signal containing the entire frequency band components.

A decoding program stored in a stored medium according to one aspect of the invention is a speech decoding program that decodes a coded sequence of an encoded speech signal. The program causes a computer to function as a demultiplexing unit for demultiplexing the coded sequence into a low frequency band coded sequence and a high frequency band coded sequence, a low frequency band decoding unit for decoding the low frequency band coded sequence demultiplexed by the demultiplexing unit and obtaining a low frequency band signal, a frequency transformation unit for transforming the low frequency band signal, which is obtained by the low frequency band decoding unit, into a frequency domain, and a high frequency band coded sequence analysis unit for analyzing the high frequency band coded sequence demultiplexed by the demultiplexing unit and acquiring coded supplementary information for high frequency band generation and time envelope information. The program further causes the computer to function as a coded sequence decoding and dequantization unit for decoding and inversely quantizing the supplementary information for high frequency band generation and the time envelope information acquired by the high frequency band coded sequence analysis unit, a high frequency band generation unit for generating, using the supplementary information for high frequency band generation decoded by the coded sequence decoding and dequantization unit, high frequency band components in the frequency domain of the speech signal from the low frequency band signal transformed into the frequency domain by the frequency transformation unit, a first to Nth (N is an integer equal to or larger than two or more) low frequency band time envelope calculation unit for analyzing the low frequency band signal transformed into the frequency domain by the frequency transformation unit and acquiring a plurality of low frequency band time envelopes, a time envelope calculation unit for calculating a high frequency band time envelope using the time envelope information, which is acquired by the coded sequence decoding and dequantization unit and the plurality of low frequency band time envelopes, which are acquired by the low frequency band time envelope calculation unit, a time envelope adjustment unit for adjusting, using the time envelope acquired by the time envelope calculation unit, a time envelope of the high frequency band components generated by the high frequency band generation unit, and an inverse frequency transformation unit for adding the high frequency band components, which are adjusted by the time envelope adjustment unit, and the low frequency band signal, which is decoded by the low frequency band decoding unit, and outputting a time domain signal containing the entire frequency band components.

A decoding program stored in a storage medium according to another aspect of the invention is a speech decoding program that decodes a coded sequence of an encoded speech signal. The program causes a computer to function as a demultiplexing unit for demultiplexing the coded sequence into a low frequency band coded sequence and a high frequency band coded sequence, a low frequency band decoding unit for decoding the low frequency band coded sequence demultiplexed by the demultiplexing unit and obtaining a low frequency band signal, a frequency transformation unit for transforming the low frequency band signal, which is obtained by the low frequency band decoding unit, into a frequency domain, a high frequency band coded sequence analysis unit for analyzing the high frequency band coded sequence demultiplexed by the demultiplexing unit and acquiring coded supplementary information for high frequency band generation, frequency envelope information, and time envelope information. The program further causes the computer to function as a coded sequence decoding and dequantization unit for decoding and inversely quantizing the supplementary information for high frequency band generation, the frequency envelope information, and the time envelope information acquired by the high frequency band coded sequence analysis unit, a high frequency band generation unit for generating, using the supplementary information for high frequency band generation decoded by the coded sequence decoding and dequantization unit, high frequency band components in the frequency domain of the speech signal from the low frequency band signal transformed into the frequency domain by the frequency transformation unit, a first to Nth (N is an integer equal to or larger than two) low frequency band time envelope calculation unit for analyzing the low frequency band signal transformed into the frequency domain by the frequency transformation unit and acquiring time envelopes for a plurality of low frequency bands, a time envelope calculation unit for calculating a high frequency band time envelope using the time envelope information, which is acquired by the coded sequence decoding and dequantization unit, and the plurality of low frequency band time envelopes which is acquired by the low frequency band time envelope calculation unit, a frequency envelope superposition unit for superimposing the frequency envelope information, which is acquired by the coded sequence decoding and dequantization unit, onto the high frequency band time envelope and acquiring a time-frequency envelope, a time-frequency envelope adjustment unit for adjusting, using the time envelope, which is acquired by the time envelope calculation unit, and the time-frequency envelope, which is acquired by the frequency envelope superposition unit, a time envelope and a frequency envelope of the high frequency band components generated by the high frequency band generation unit, and an inverse frequency transformation unit for adding the high frequency band components, which are adjusted by the time-frequency envelope adjustment unit and the low frequency band signal, which is decoded by the low frequency band decoding unit, and outputting a time domain signal containing the entire frequency band components.

A decoding program stored in a storage medium according to yet another aspect of the invention is a speech decoding program that decodes a coded sequence of an encoded speech signal. The program causes a computer to function as a demultiplexing unit for demultiplexing the coded sequence into a low frequency band coded sequence and a high frequency band coded sequence, a low frequency band decoding unit for decoding the low frequency band coded sequence demultiplexed by the demultiplexing unit and obtaining a low frequency band signal, a frequency transformation unit for transforming the low frequency band signal, which is obtained by the low frequency band decoding unit, into a frequency domain, and a high frequency band coded sequence analysis unit for analyzing the high frequency band coded sequence demultiplexed by the demultiplexing unit and acquiring coded supplementary information for high frequency band generation, frequency envelope information, and time envelope information. The program further causes the computer to function as a coded sequence decoding and dequantization unit for decoding and inversely quantizing the supplementary information for high frequency band generation, the frequency envelope information, and the time envelope information acquired by the high frequency band coded sequence analysis unit, a high frequency band generation unit for generating, using the supplementary information for high frequency band generation decoded by the coded sequence decoding and dequantization unit, high frequency band components in the frequency domain of the speech signal from the low frequency band signal transformed into the frequency domain by the frequency transformation unit, a first to Nth (N is an integer equal to or larger than two) low frequency band time envelope calculation unit for analyzing the low frequency band signal transformed into the frequency domain by the frequency transformation unit and acquiring a plurality of low frequency band time envelopes, a time envelope calculation unit for calculating a high frequency band time envelope using the time envelope information, which is acquired by the coded sequence decoding and dequantization unit, and the plurality of low frequency band time envelopes, which are acquired by the low frequency band time envelope calculation unit, a frequency envelope calculation unit for calculating a frequency envelope using the frequency envelope information, which is acquired by the coded sequence decoding and dequantization unit, a time-frequency envelope adjustment unit for adjusting, using the time envelope acquired by the time envelope calculation unit and the frequency envelope acquired by the frequency envelope calculation unit, a time envelope and a frequency envelope of the high frequency components generated by the high frequency band generation unit, and an inverse frequency transformation unit for adding the high frequency band components, which are adjusted by the time-frequency envelope adjustment unit, and the low frequency band signal, which is decoded by the low frequency band decoding unit, and outputting a time domain signal containing the entire frequency band components.

According to the decoder, the decoding method or the stored decoding program described above, the low frequency band signal is obtained from the coded sequence by demultiplexing and decoding, and the supplementary information for high frequency band generation and the time envelope information are obtained from the coded sequence by demultiplexing, decoding and dequantization. Then, the high frequency band components in the frequency domain are generated from the low frequency band signal transformed into the frequency domain using the supplementary information for high frequency band generation, and, after acquiring a plurality of low frequency band time envelopes by analyzing the low frequency band signal in the frequency domain, the high frequency band time envelope is calculated using the plurality of low frequency band time envelopes and the time envelope information. Further, the time envelope of the high frequency band components is adjusted by the calculated high frequency band time envelope, and the adjusted high frequency band components and the low frequency band signal are added together and thereby the time domain signal is output. In this manner, because a plurality of low frequency band time envelopes are used for adjustment of the time envelope of the high frequency band components, the waveform of the time envelope of the high frequency band components is adjusted with high accuracy by use of the correlation between the time envelopes of low frequency band components and the time envelope of high frequency band components. As a result, the time envelope in the decoded signal is adjusted to have a less distorted shape, and therefore a reproduced signal can be obtained in which pre-echoes and post-echoes are sufficiently reduced.

It is preferred that the speech decoder further includes a time envelope calculation control unit for controlling at least one of (i) calculation of the low frequency band time envelopes in the first to Nth low frequency band time envelope calculation unit and (ii) calculation of the high frequency band time envelope in the time envelope calculation unit using the low frequency band signal transformed into the frequency domain by the frequency transformation unit. With the time envelope calculation control unit, it is possible to omit calculation of the low frequency band time envelopes or calculation of the high frequency band time envelope according to properties such as the power of the low frequency band signal, thereby reducing the amount of computation.

It is also preferred that the speech decoder further includes time envelope calculation control unit for controlling at least one of (i) calculation of the low frequency band time envelopes in the first to Nth low frequency band time envelope calculation unit and (ii) calculation of the high frequency band time envelope in the time envelope calculation unit using the time envelope information acquired by the coded sequence decoding and dequantization unit. With the time envelope calculation control unit, it is possible to omit calculation of the low frequency band time envelopes or calculation of the high frequency band time envelope according to the time envelope information obtained from the coded sequence, thereby reducing the amount of computation.

It is also preferred that the high frequency band coded sequence analysis unit further acquires time envelope calculation control information, and the speech decoder further includes a time envelope calculation control unit for controlling at least one of (i) calculation of the low frequency band time envelopes in the first to Nth low frequency band time envelope calculation unit and (ii) calculation of the high frequency band time envelope in the time envelope calculation unit using the time envelope calculation control information acquired by the high frequency band coded sequence analysis unit. In this configuration, it is possible to omit calculation of the low frequency band time envelopes or calculation of the high frequency band time envelope according to the time envelope calculation control information obtained from the coded sequence, thereby reducing the amount of computation.

It is also preferred that the high frequency band coded sequence analysis unit further acquires time envelope calculation control information, and that the coded sequence decoding and dequantization unit further includes a time envelope calculation control unit which further acquires second frequency envelope information and determines, based on the time envelope calculation control information, whether to adjust the frequency envelope of the high frequency band components based on the second frequency envelope information and, when it is determined to adjust the frequency envelope, controls not to perform calculation of the low frequency band time envelopes by the first to Nth low frequency band time envelope calculation unit and calculation of the high frequency band time envelope by the time envelope calculation unit. In this case also, it is possible to omit calculation of the low frequency band time envelopes or calculation of the high frequency band time envelope according to the time envelope calculation control information obtained from the coded sequence, thereby reducing the amount of computation.

It is also preferred that the time-frequency envelope adjustment unit processes, with a specified function, the high frequency band components of the speech signal generated by the high frequency band generation unit. It is also preferred that the low frequency band time envelope calculation unit processes, with a specified function, the acquired plurality of low frequency band time envelopes.

Further, an encoder according to one aspect of the invention is a speech encoder that encodes a speech signal. The speech encoder comprises a frequency transformation unit for transforming the speech signal into a frequency domain, a down-sampling unit for down-sampling the speech signal and acquiring a low frequency band signal, a low frequency band encoding unit for encoding the low frequency band signal acquired by the down-sampling unit, a first to Nth (N is an integer equal to or larger than two) low frequency band time envelope calculation unit for calculating a plurality of time envelopes of low frequency band components of the speech signal transformed into the frequency domain by the frequency transformation unit, a time envelope information calculation unit for calculating, using the time envelopes of the low frequency band components calculated by the first to Nth low frequency band time envelope calculation unit, time envelope information necessary to acquire a time envelope of high frequency band components of the speech signal transformed by the frequency transformation unit, and a supplementary information calculation unit for analyzing the speech signal and calculating supplementary information for high frequency band generation to be used for generating high frequency band components from the low frequency band signal. The speech encoder further comprises a quantization and encoding unit for quantizing and encoding the supplementary information for high frequency band generation generated by the supplementary information calculation unit and the time envelope information calculated by the time envelope information calculation unit, a coded sequence construction unit for constructing a high frequency band coded sequence from the supplementary information for high frequency band generation and the time envelope information quantized and encoded by the quantization and encoding unit, and a multiplexing unit for generating a coded sequence which multiplexes the low frequency band coded sequence, which is acquired by the low frequency band encoding unit, and the high frequency band coded sequence, which is constructed by the coded sequence construction unit.

An encoding method according to one aspect of the invention is a speech encoding method of encoding a speech signal. The method comprises a frequency transformation step, performed by a frequency transformation unit, of transforming the speech signal into a frequency domain, a down-sampling step, performed by a down-sampling unit, of down-sampling the speech signal and acquiring a low frequency band signal, a low frequency band encoding step, performed by a low frequency band encoding unit, of encoding the low frequency band signal acquired by the down-sampling unit, first to Nth (N is an integer equal to or larger than two) low frequency band time envelope calculation step, performed by a first to Nth low frequency band time envelope calculation unit, of calculating a plurality of time envelopes of low frequency band components of the speech signal transformed into the frequency domain by the frequency transformation unit, time envelope information calculation step, performed by a time envelope information calculation unit, of calculating, using the time envelopes of the low frequency band components calculated by the first to Nth low frequency band time envelope calculation unit, time envelope information necessary to acquire a time envelope of high frequency band components of the speech signal transformed by the frequency transformation unit, and a supplementary information calculation step, performed by a supplementary information calculation unit, of analyzing the speech signal and calculating supplementary information for high frequency band generation to be used for generating high frequency band components from the low frequency band signal. The method further comprises a quantization and encoding step, performed by a quantization and encoding unit, of quantizing and encoding the supplementary information for high frequency band generation generated by the supplementary information calculation unit and the time envelope information calculated by the time envelope information calculation unit, a coded sequence construction step, performed by a coded sequence construction unit, of constructing a high frequency band coded sequence from the supplementary information for high frequency band generation and the time envelope information quantized and encoded by the quantization and encoding unit, and a multiplexing step, performed by multiplexing unit, of generating a coded sequence which multiplexes the low frequency band coded sequence acquired by the low frequency band encoding unit and the high frequency band coded sequence constructed by the coded sequence construction unit.

An encoding program stored in a storage medium according to one aspect of the invention is a speech encoding program that encodes a speech signal The program causes a computer to function as a frequency transformation unit for transforming the speech signal into a frequency domain, a down-sampling unit for down-sampling the speech signal and acquiring a low frequency band signal, a low frequency band encoding unit for encoding the low frequency band signal acquired by the down-sampling unit, a first to Nth (N is an integer equal to or larger than two) low frequency band time envelope calculation unit for calculating a plurality of time envelopes of low frequency band components of the speech signal transformed into the frequency domain by the frequency transformation unit, a time envelope information calculation unit for calculating, using the time envelopes of the low frequency band components calculated by the first to Nth low frequency band time envelope calculation unit, time envelope information necessary to acquire a time envelope of high frequency band components of the speech signal transformed by the frequency transformation unit, and a supplementary information calculation unit for analyzing the speech signal and calculating supplementary information for high frequency band generation to be used for generating high frequency band components from the low frequency band signal. The program further causes the computer to function as a quantization and encoding unit for quantizing and encoding the supplementary information for high frequency band generation generated by the supplementary information calculation unit and the time envelope information calculated by the time envelope information calculation unit, a coded sequence construction unit for constructing a high frequency band coded sequence from the supplementary information for high frequency band generation and the time envelope information quantized and encoded by the quantization and encoding unit, and a multiplexing unit for generating a coded sequence which multiplexes the low frequency band coded sequence acquired by the low frequency band encoding unit and the high frequency band coded sequence constructed by the coded sequence construction unit.

According to the speech encoder, the encoding method or the stored encoding program described above, the low frequency band signal is obtained by down-sampling of a speech signal, and the low frequency band signal is encoded, while a plurality of time envelopes of low frequency band components are calculated based on the speech signal in the frequency domain, and using the plurality of time envelopes of low frequency band components, the time envelope information for acquiring the time envelope of high frequency band components is calculated. Further, the supplementary information for high frequency band generation for generating high frequency band components from the low frequency band signal is calculated, and, after the supplementary information for high frequency band generation and the time envelope information are quantized and encoded, the high frequency band coded sequence is constructed, which contains the supplementary information for high frequency band generation and the time envelope information. Then, the coded sequence is generated in which the low frequency band coded sequence and the high frequency band coded sequence is multiplexed. Accordingly, when the coded sequence is input to the decoder, a plurality of low frequency band time envelopes can be used on the decoder side for adjusting the time envelope of high frequency band components on the decoder side, and thereby the waveform of the time envelope of high frequency band components is adjusted with high accuracy, using the correlation between the time envelope of low frequency band components and the time envelope of high frequency band components on the decoder side. As a result, the time envelope in the decoded signal is adjusted to have a less distorted shape, and therefore a reproduced signal can be obtained on the decoder side in which pre-echoes and post-echoes are sufficiently reduced.

It is preferred that the speech encoder further includes a frequency envelope calculation unit for calculating frequency envelope information of the high frequency band components of the speech signal which is transformed into the frequency domain by the frequency transformation unit, that the quantization and encoding unit further quantizes and encodes the frequency envelope information, and that the coded sequence construction unit constructs the high frequency band coded sequence by further adding the frequency envelope information quantized and encoded by the quantization and encoding unit. In this configuration, adjustment of the frequency envelope of the high frequency band components can be made on the decoder side, and therefore a reproduced signal with improved frequency characteristics can be obtained on the decoder side.

It is also preferred that the speech encoder further includes a control information generation unit for generating time envelope calculation control information that controls time envelope calculation in a speech decoder using at least one of (i) the speech signal transformed into the frequency domain by the frequency transformation unit and (ii) the time envelope information calculated by the time envelope information calculation unit, and that the coded sequence construction unit constructs the high frequency band coded sequence by further adding the time envelope calculation control information generated by the control information generation unit. In this case, it is possible to increase the efficiency of time envelope calculation on the decoder side by referring to the property such as the power of the speech signal and the time envelope information, thereby reducing the amount of computation.

It is also preferred that the time envelope information calculation means calculates a time envelope of high frequency band components of the speech signal transformed into the frequency domain by the frequency transformation means, and calculates the time envelope information based on correlation between a time envelope calculated from the first to Nth time envelopes of low frequency band components and the time envelope of the frequency components.

According to the present invention, it is possible to adjust the time envelope of a decoded signal to have a less distorted shape and thereby obtain a reproduced signal in which pre-echoes and post-echoes are sufficiently reduced.

DETAILED DESCRIPTION OF THE PREFERRED EMBODIMENTS

Preferred embodiments of a speech decoder, a speech encoder, a speech decoding method, a speech encoding method, a speech decoding program, and a speech encoding program according to the present invention are described hereinafter in detail with reference to the drawings. It is noted that, in the description of the drawings, the same elements will be denoted by the same reference symbols and redundant description will be omitted.

First Embodiment

Figure 1:
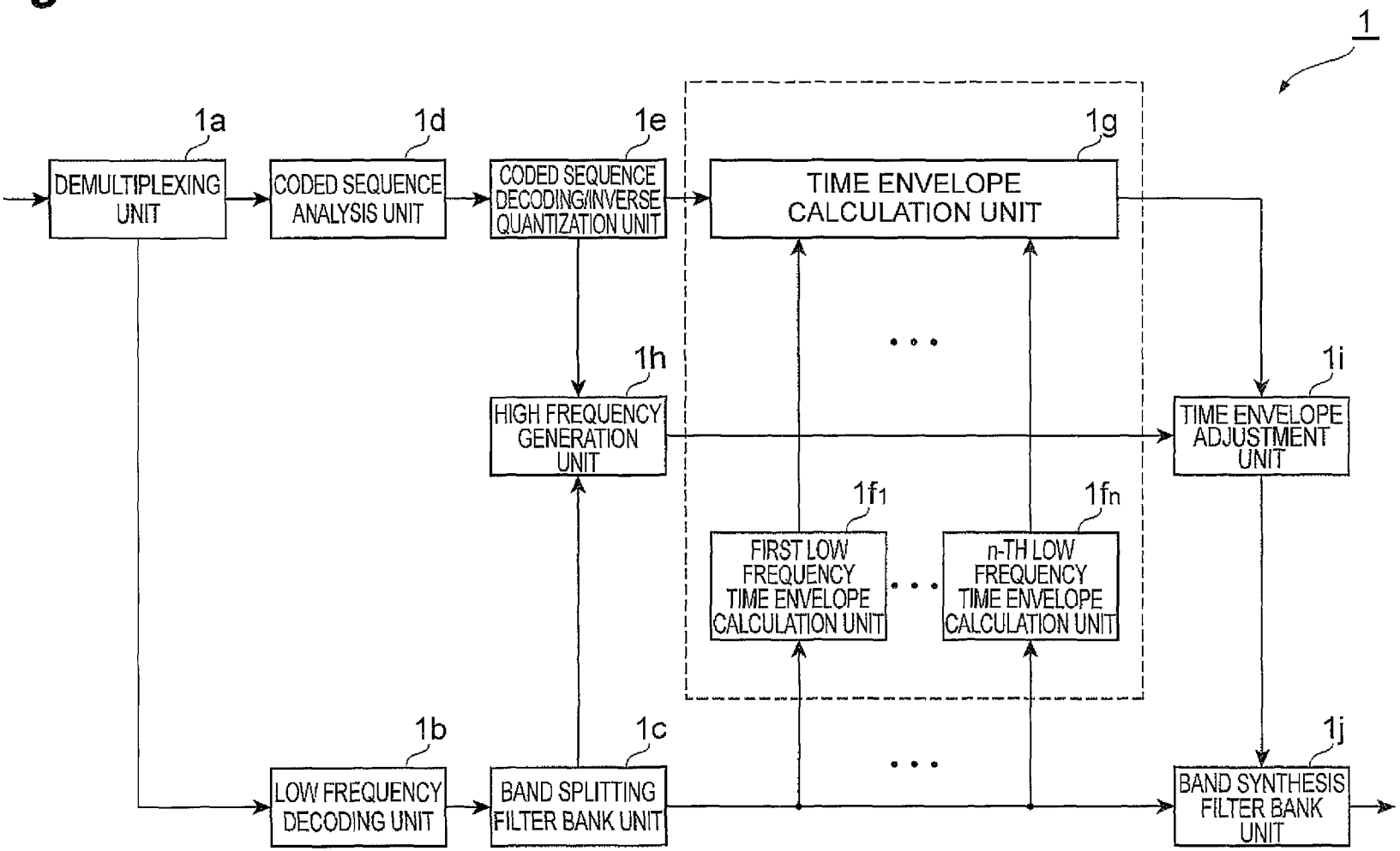
FIG. 1 is a schematic block diagram of a speech decoder 1 according to a first embodiment of the invention.
Figure 2:
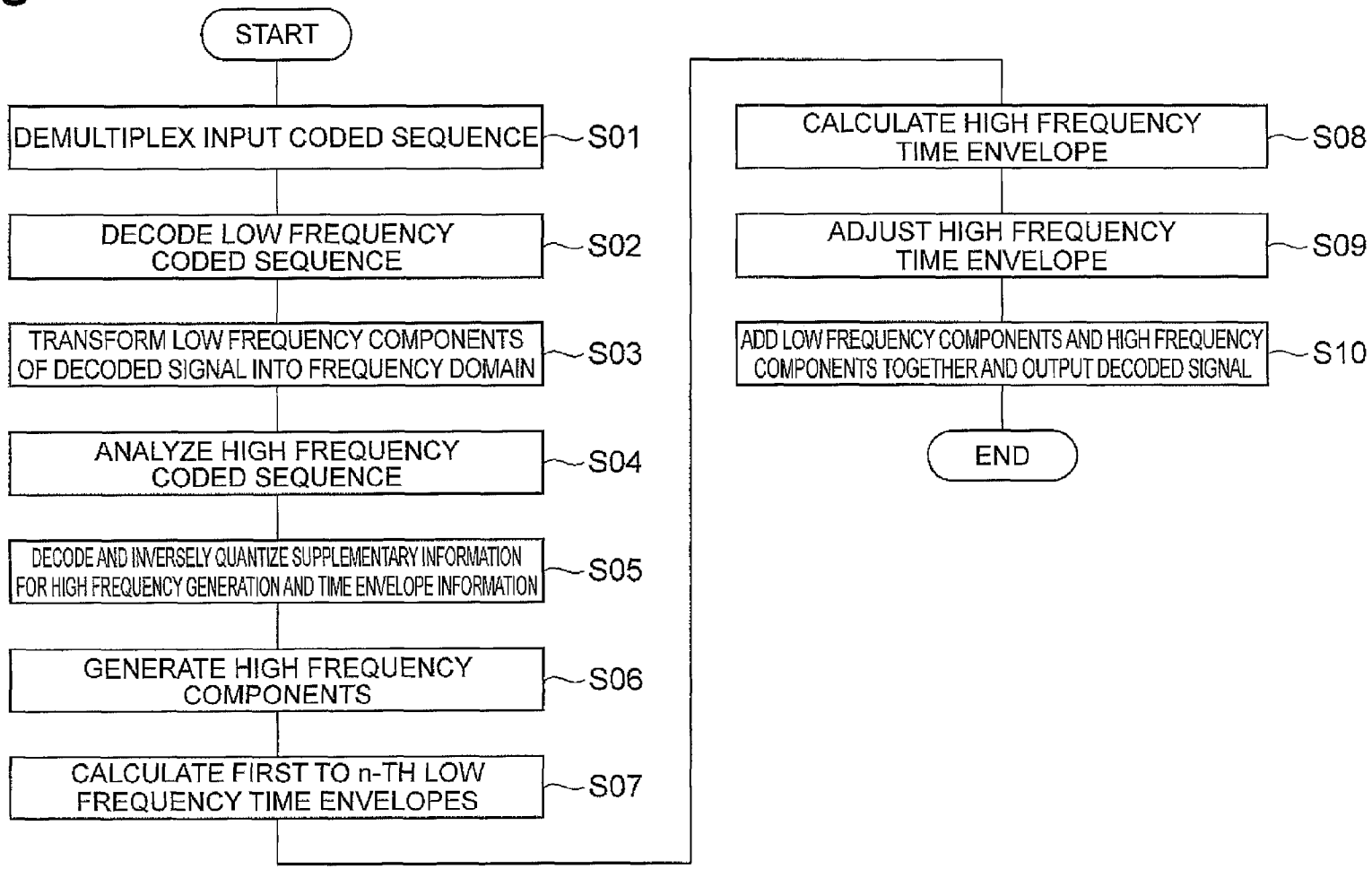
FIG. 2 is a flowchart showing a procedure of a speech decoding method implemented by the speech decoder 1 shown in FIG. 1.

FIG. 1 is a schematic block diagram of a speech decoder 1 according to a first embodiment of the invention, and FIG. 2 is a flowchart showing a procedure of a speech decoding method implemented by the speech decoder 1. The speech decoder 1 includes CPU, ROM, RAM, a communication device and the like, which are not shown, and the CPU loads a specified computer program (for example, a computer program for performing the process shown in the flowchart of FIG. 2) stored in an internal memory such as the ROM of the speech decoder 1 to the RAM and executes the program to exercise control over the speech decoder 1. The communication device of the speech decoder 1 receives a multiplexed coded sequence that is output from the speech encoder 2, which will later be described, and outputs a decoded speech signal to the outside.

As shown in FIG. 1, the speech decoder 1 functionally includes a demultiplexing unit (demultiplexing means) 1*a*, a low frequency band decoding unit (low frequency band decoding means) 1*b*, a band splitting filter bank unit (frequency transformation means) 1*c*, a coded sequence analysis unit (high frequency band coded sequence analysis means) 1*d*, a coded sequence decoding/dequantization unit (coded sequence decoding and dequantization means) 1*e*, first to n-th (n is an integer of two or more) low frequency band time envelope calculation unit (low frequency band time envelope calculation means) $\mathbf{1}f_1$ to $\mathbf{1}f_n$, a time envelope calculation unit (time envelope calculation means) 1*g*, a high frequency band generation unit (high frequency band generation means) 1*h*, a time envelope adjustment unit (time envelope adjustment means) 1*i*, and a band synthesis filter bank unit (inverse frequency transformation means) 1*j* (1*c* to 1*e* and 1*h* to 1*i* are sometimes referred to also as a bandwidth extension unit (bandwidth extension means)). The respective units of the speech decoder 1 shown in FIG. 1 are functional units that are realized by the CPU of the speech decoder 1 executing a computer program stored in the internal memory of the speech decoder 1. The CPU of the speech decoder 1 executes the computer program (uses the functional units of FIG. 1) and thereby sequentially executes the process shown in the flowchart of FIG. 2 (the process of Steps S01 to S10). It is assumed that various data required for execution of the computer program and various data generated through execution of the computer program are stored in the internal memory, such as ROM and RAM, of the speech decoder 1.

The functions of the respective units of the speech decoder 1 will hereinafter be described in detail.

The demultiplexing unit 1*a* divides a multiplexed coded sequence that is input through the communication device of the speech decoder 1 into a low frequency band coded sequence and a high frequency band coded sequence by demultiplexing.

The low frequency band decoding unit 1*b* decodes the low frequency band coded sequence supplied from the demultiplexing unit 1*a* and obtains a decoded signal that contains only low frequency band components. A method of decoding may be based on a speech coding method such as CELP (Code-Excited Linear Prediction) or based on audio coding such as AAC (Advanced Audio Coding) and TCX (Transform Coded Excitation). Further, it may be based on PCM (Pulse Code Modulation) coding. Furthermore, it may be based on a method that uses those coding methods switchably. In this embodiment, a method of coding is not particularly limited.

The band splitting filter bank unit 1*c* analyzes the decoded signal containing only low frequency band components supplied from the low frequency band decoding unit 1*b* and transforms the decoded signal into a signal in the frequency domain. Hereinafter, the signal in the frequency domain that corresponds to the low frequency band acquired by the band splitting filter bank unit 1*c* is represented as $X_{dec}(j,i)$ $\{0 \le j < k_x, t(s) \le i < t(s+1), 0 \le s < s_E\}$, where j is an index in the frequency direction, i is an index in the time direction, and $k_x$ is a nonnegative integer. Further, t is defined so that the range $t(s) \le i < t(s+1)$ of the signal $X_{dec}(j,i)$ with respect to the index i corresponds to the s-th ($0 \le s < s_E$) frame. Further, $s_E$ is the number of all frames. The above frame corresponds to the frame specified by the coding method to which the decoding method of the low frequency band decoding unit 1*b* conforms. Further, the above frame may correspond to so-called SBR frame or SBR envelope time segment in SBR used in "MPEG4 AAC" specified by "ISO/IEC 14496-3". Note that, in this embodiment, the time interval specified by the frame is not limited to the above example. The above index i may correspond to a QMF subband subsample or a time slot equaling several subband samples in SBR used in "MPEG4 AAC" specified by "ISO/IEC 14496-3".

The coded sequence analysis unit 1*d* analyzes the high frequency band coded sequence supplied from the demultiplexing unit 1*a* and acquires coded supplementary information for high frequency band generation and coded time-frequency envelope information.

The coded sequence decoding/dequantization unit 1*e* decodes and dequantize the coded supplementary information for high frequency band generation supplied from the coded sequence analysis unit 1*d* and obtains coded supplementary information for high frequency band generation, and decodes and dequantize the coded time envelope information supplied from the coded sequence analysis unit 1*d* and acquires time envelope information.

The first to n-th low frequency band time envelope calculation units $\mathbf{1}f_1$ to $\mathbf{1}f_n$ calculate time envelopes different from each other. Specifically, the k-th low frequency band time envelope calculation unit $\mathbf{1}f_k$ ($1 \le k \le n$) receives a low frequency band signal $X(j,i)$ $\{0 \le j < k_x, t(s) \le i < t(s+1), 0 \le s < s_E\}$ from the band splitting filter bank unit 1*c* and calculates the k-th time envelope $L_{dec}(k,i)$ in the low frequency band (processing in Step Sb6). To be specific, the k-th low frequency band time envelope calculation unit $\mathbf{1}f_k$ calculates the time envelope $L_{dec}(k,i)$ as follows.

First, different sub-bands in the low frequency band can be specified using two integers $k_l$ and $k_h$ satisfying the following condition.

$$0 \le k_l \le k_h < k_x \qquad \text{[Equation 1]}$$

The total number of possible sets of integers ($k_l$, $k_h$) satisfying the above condition is $n_{max} = k_x(k_x+1)/2$. The sub-bands can be specified by selecting any one from those sets of integers.

Next, n number of sub-bands are specified by selecting n number from the $n_{max}$ sets of integers. Hereinafter, to represent the n number of bands, two arrays $B_l$ and $B_h$ with the size n are defined so that the signal $X_{dec}(j,i)$ $\{B_l(k) \le j \le B_h(k), t(s) \le i < t(s+1)), 0 \le s < s_E\}$ corresponds to the k-th ($1 \le k \le n$) sub-band component.

Further, the power time envelope of the n number of sub-band components is acquired by the following equation.

$$E_L(k, i) = \frac{1}{k_h - k_l + 1} \sum_{j=k_l}^{k_h} |X_{dec}(j, i)|^2 \qquad \text{[Equation 2]}$$

$$k_l = B_l(k),\ k_h = B_h(k),$$

$$1 \le k \le n,\ t(s) \le i < t(s+1),\ 0 \le s < s_E$$

Then, the following equation is calculated for the above $E_L(k,i)$.

$$L_0(k,i)=10\log_{10}E_L(k,i),$$

$$1\le k\le n,\ t(s)\le i<t(s+1),\ 0\le s<s_E \quad \text{[Equation 3]}$$

Then, a time envelope L(k,i) is acquired by performing specified processing on the quantity $L_0(k,i)$. For example, the time envelope L(k,i) may be acquired by smoothing the quantity $L_0(k,i)$ in the time direction by using the following equation.

$$L_1(k,i)=\begin{cases}\sum_{j=0}^{d}L_0(k,i-j)sc(j) & d\le i\\ \sum_{j=0}^{d}L_0(k,i-j)sc(j) & i<d\end{cases} \quad \text{[Equation 4]}$$

$$1\le k\le n,\ t(s)\le i<t(s+1),\ 0\le s<s_E$$

In the above equation, sc(j), $0\le j\le d$ is the coefficient of smoothing, and d is the order of smoothing. The value of sc(j) is set by the following equation, for example.

$$sc(j)=1/(d+1),\ 0\le j\le d \quad \text{[Equation 5]}$$

However, in this embodiment, the value of sc(j) is not limited to the above equation.

Further, the above $L_0(k,i)$ may be calculated by the following equation, for example.

$$L_0(k,i)=E_L(k,i),$$

$$1\le k\le n,\ t(s)\le i<t(s+1),\ 0\le s<s_E \quad \text{[Equation 6]}$$

Furthermore, the above $L_0(k,i)$ may be calculated by the following equation, for example.

$$L_0(k,i)=10\log_{10}\left(\frac{E_L(k,i)}{\sum_{i=t(s)}^{t(s+1)-1}E_L(k,i)+\varepsilon}\right), \quad \text{[Equation 7]}$$

$$1\le k\le n,\ t(s)\le i<t(s+1),\ 0\le s<s_E$$

where $\epsilon$ is the relaxation factor for avoiding division by zero. Further, the above $L_0(k,i)$ may be calculated by the following equation, for example.

$$L_0(k,i)=\frac{E_L(k,i)}{\sum_{i=t(s)}^{t(s+1)-1}E_L(k,i)+\varepsilon}, \quad \text{[Equation 8]}$$

$$1\le k\le n,\ t(s)\le i<t(s+1),\ 0\le s<s_E$$

The time envelope $L_{dec}(k,i)$ calculated by the k-th low frequency band time envelope calculation unit $\mathbf{1}f_k$ is obtained using the following equation:

$$L_{dec}(k,i)=L_0(k,i)$$

$$1\le k\le n,\ t(s)\le i<t(s+1),\ 0\le s<s_E \quad \text{[Equation 9]}$$

or the following equation:

$$L_{dec}(k,i)=L_1(k,i)$$

$$1\le k\le n,\ t(s)\le i<t(s+1),\ 0\le s<s_E$$

$$1\le l,\ m\le n-1 \quad \text{[Equation 10].}$$

Note that the above $L_{dec}(k,i)$ may be any parameter representing the time-variation of the signal power or the signal amplitude of the k-th sub-band signal and not limited to the above form of $L_0(k,i)$ and $L_1(k,i)$.

Further, the above $L_{dec}(k,i)$ may be calculated by a method using principal component analysis as follows.

First, in the process of calculating $L_{dec}(k,i)$ $\{1\le k\le n,\ t(s)\le i\le t(s+1),\ 0\le s<s_E\}$ described above, m kinds of quantities corresponding to the above $L_{dec}(k,i)$ are calculated for the index k by replacing n with another integer m=n−1, and those quantities are represented as $L_2(k,i)$ $\{1\le k\le m(=n-1),\ t(s)\le i<t(s+1),\ 0\le s<s_E\}$. Then, the above $L_2(l,i)$ $\{1\le l\le m,\ t(s)\le i<t(s+1)\}$ corresponding to the s-th $(0\le s<s_E)$ frame is regarded as samples of m number of vectors with the order D=t(s+1)−t(s), and the average of those samples is calculated by the following equation.

$$L_{2,ave}(i)=\frac{1}{m}\sum_{l=1}^{m}L_2(l,i) \quad \text{[Equation 11]}$$

$$t(s)\le i<t(s+1),\ 0\le s<s_E$$

Using the above average, the displacement vector is defined by the following equation.

$$\delta L_2(l,i)=L_2(l,i)-L_{2,ave}(i)$$

$$1\le l\le m,$$

$$t(s)\le i<t(s+1),\ 0\le s<s_E$$

From those displacement vectors, the variance-covariance matrix Cov with the size D×D is calculated by the following equation.

$$\mathrm{Cov}(i,j)=\frac{1}{m}\sum_{l=1}^{m}\delta L(l,i+t(s)-1)\delta L(l,j+t(s)-1) \quad \text{[Equation 13]}$$

$$i,j=1,2,\cdots,D$$

$$0\le s<s_E$$

Then, the eigenvectors $V^{(k)}$ of the matrix Cov that satisfy the following equation $$\sum_{j=1}^{D}\mathrm{Cov}(i,j)V_j^{(k)}=V_i^{(k)}\lambda^{(k)} \quad \text{[Equation 14]}$$

$$i,k=1,2,\ldots,D$$

and are orthogonal to each other are calculated. The above $V^{(k)}{}_i$ is the component of the eigenvectors $V^{(k)}$, and $\lambda^{(k)}$ is the eigenvalue of the matrix Cov corresponding to $V^{(k)}$. Each of the above vectors $V^{(k)}$ may be normalized. However, a method normalization is not limited in this invention. Hereinafter, it is assumed that $\lambda^{(1)}\ge\lambda^{(2)}\ge\ldots\ge\lambda^{(D)}$ to simplify the description.

Using the eigenvectors acquired in the above manner, the low frequency band time envelope calculation unit $\mathbf{1}f_k$ ($1 \le k \le n$) calculates the time envelope $L_{dec}(k,i)$ as follows. Specifically, when $D \ge m(=n-1)$, $n-1$ number of vectors are selected from the above eigenvectors in the order of magnitudes corresponding eigenvalues, and the time envelope is calculated by the following equation.

$$L_{dec}(k, i) = \begin{cases} V_i^{(k)} & 1 \le k \le n-1 \\ L_{2,ave}(i) & k = n \end{cases} \quad \text{[Equation 15]}$$

$$t(s) \le i < t(s+1),\ 0 \le s < s_E$$

On the other hand, when $D<m(=n-1)$, the time envelope is calculated by the following equation using the above eigenvectors.

$$L_{dec}(k, i) = \begin{cases} V_i^{(k)} & 1 \le k \le D \\ \alpha & D+1 \le k \le n-1 \\ L_{2,ave}(i) & k = n \end{cases} \quad \text{[Equation 16]}$$

$$t(s) \le i < t(s+1),\ 0 \le s < s_E$$

where $\alpha$ is a constant number, and $\alpha=0$, for example. Further, when $D<m(=n-1)$, the time envelope may be calculated by the following equation.

$$L_{dec}(k, i) = \begin{cases} V_i^{(k)} & 1 \le k \le D \\ L_2(k-D, i) & D+1 \le k \le n-1 \\ L_{2,ave}(i) & k = n \end{cases} \quad \text{[Equation 17]}$$

$$t(s) \le i < t(s+1),\ 0 \le s < s_E$$

Further, the above $L_{dec}(k,i)$ may be calculated by the following method. First, in the process of calculating $L_2(l,i)$ described above, $L_2(l,i)$, $1 \le l \le m$, $t(s) \le i < t(s+1)$, $0 \le s < s_E$ is calculated assuming $m=n$. Those can be regarded as a group of n number of $D=t(s+1)-t(s)$ dimensional vectors. Using the n number of vectors, n number of orthogonal vectors are calculated by a method such as Gram-Schmidt orthogonalization and set as $L_{dec}(k,i)$, $1 \le l \le n$, $t(s) \le i < t(s+1)$, $0 \le s < s_E$. A method of orthogonalization, however, is not limited to the above example. Further, the orthogonal vectors are not necessarily normalized.

The time envelope calculation unit 1*g* calculates a high frequency band time envelope using the n number of low frequency band time envelopes supplied from the first to n-th low frequency band time envelope calculation units $\mathbf{1}f_1$ to $\mathbf{1}f_n$ and the time envelope information supplied from the coded sequence decoding/dequantization unit 1*e*. Specifically, the calculation of the time envelope by the time envelope calculation unit 1*g* is performed as follows.

First, the high frequency band is divided into $n_H$ ($n_H \ge 1$) number of sub-bands, and those sub-bands are represented as $B^{(T)}{}_l$ ($l=1, 2, 3, \ldots, n_H$). Next, using the above-described time envelope $L_{dec}(k,i)$, the time envelope $g_{dec}(l,i)$ of the sub-band $B^{(T)}{}_l$ in the high frequency band is calculated. i is the index in the time direction.

For example, the above-described $g_{dec}(l,i)$ is given by the following equation.

$$g_{dec}(l, i) = \sum_{k=1}^{n} A_{l,k}(s) \cdot L_{dec}(k, i), \quad \text{[Equation 18]}$$

$$1 \le l \le n_H,\ t(s) \le i < t(s+1),\ 0 \le s < s_E$$

The value in the above equation:

$$A_{l,k}(s),\ 1 \le l \le n_H,\ 1 \le k \le n,\ 0 \le s < s_E \quad \text{[Equation 19]}$$

is the time envelope information supplied from the coded sequence decoding/dequantization unit 1*e*.

Further, in the time envelope information supplied from the coded sequence decoding/dequantization unit 1*e*, the coefficient $A_{l,k}(s)$ may contain the coefficient:

$$A_{l,0}(s),\ 1 \le l \le n_H,\ 0 \le s < s_E \quad \text{[Equation 20]}$$

and, in this case, the above $g_{dec}(l,i)$ may be given by the following equation.

$$g_{dec}(l, i) = \sum_{k=1}^{n} (A_{l,k}(s) \cdot L_{dec}(k, i)) + A_{l,0}(s) \quad \text{[Equation 21]}$$

$$1 \le l \le n_H,\ t(s) \le i < t(s+1),\ 0 \le s < s_E$$

Further, the time envelope information supplied from the coded sequence decoding/dequantization unit 1*e* may contain the coefficient given by the following equation:

$$A_{l,-k}(s),\ 1 \le l \le n_H,\ 1 \le k \le g,\ 0 \le s < s_E \quad \text{[Equation 22]}$$

in addition to the above coefficient $A_{l,k}(s)$ $\{1 \le l \le n_H,\ 1=k \le n,\ 0 \le s < s_E\}$ or the above coefficient $A_{l,k}(s)$ $\{1 \le l \le n_H,\ 0 \le k \le n,\ 0 \le s < s_E\}$, and, in this case, the above $g_{dec}(l,i)$ may be given by the following equation:

$$g_{dec}(l, i) = \sum_{k=1}^{n} (A_{l,k}(s) \cdot L_{dec}(k, i)) + \sum_{k=1}^{g} (A_{l,-k}(s) \cdot U(k, i)) \quad \text{[Equation 23]}$$

$$1 \le l \le n_H,\ t(s) \le i < t(s+1),\ 0 \le s < s_E$$

or the following equation:

$$g_{dec}(l, i) = \sum_{k=1}^{n} (A_{l,k}(s) \cdot L_{dec}(k, i)) + A_{l,0}(s) + \sum_{k=1}^{g} (A_{l,-k}(s) \cdot U(k, i)) \quad \text{[Equation 24]}$$

$$1 \le l \le n_H,\ t(s) \le i < t(s+1),\ 0 \le s < s_E$$

where $U(k,i)$ $\{1 \le k \le g,\ t(s) \le i < t(s+1),\ 0 \le s < s_E\}$ is a specified coefficient or a specified function. For example, $U(k,i)$ may be the function given by the following equation:

$$U(k,i) = \cos(\Omega \cdot k \cdot (i - t(s)))$$

$$1 \le k \le g,\ t(s) \le i < t(s+1),\ 0 \le s < s_E \quad \text{[Equation 25]}$$

where $\Omega$ is a specified coefficient.

The above $g_{dec}(l,i)$ may be in another form as long as it is a representation by $L_{dec}(k,i)$, and the time envelope information is also not limited to the form of the coefficient $A_{l,k}(s)$.

Finally, using the above $g_{dec}(l,i)$, the time envelope calculation unit 1*g* calculates the time envelope by the following equation $$E_T(l,i)=10^{0.1\times g_{dec}(l,i)},$$

$$1\le l\le n_H,\ t(s)\le i<t(s+1),\ 0\le s<s_E \qquad \text{[Equation 26]}$$

or the following equation.

$$E_T(l,i)=g_{dec}(l,i),$$

$$1\le l\le n_H,\ t(s)\le i<t(s+1),\ 0\le s<s_E \qquad \text{[Equation 27]}$$

The high frequency band generation unit 1*h* replicates, using the supplementary information for high frequency band generation supplied from the coded sequence decoding/dequantization unit 1*e*, the low frequency band signal $X_{dec}(j,i)$ $\{0\le j<k_x,\ t(s)\le i<t(s+1),\ 0\le s<s_E\}$ supplied from the band splitting filter bank unit 1*c* onto the high frequency band and thereby generates a high frequency band signal $X_{dec}(j,i)$ $\{k_x\le j\le k_{max},\ t(s)\le i<t(s+1),\ 0\le s<s_E\}$. The generation of the high frequency band is performed in accordance with a method of HF generation in SBR of "MPEG4 AAC" specified by "ISO/IEC 14496-3" ("ISO/IEC 14496-3 subpart 4 General Audio Coding").

The time envelope adjustment unit 1*i* adjusts the time envelope of the high frequency band signal $X_H(j,i)$ $\{k_x\le j\le k_{max},\ t(s)\le i<t(s+1),\ 0\le s<s_E\}$ supplied from the high frequency band generation unit 1*h* by using the time envelope $E_T(l,i)$ $\{1\le l\le n_H,\ t(s)?i<t(s+1),\ 0\le s<s_E\}$ supplied from the time envelope calculation unit 1*g*.

Specifically, adjustment of the time envelope is made by a method similar to the HF adjustment in SBR of "MPEG4 AAC" as descried below. For simplification, a method that takes only noise addition in the HF adjustment into consideration is described below, and methods corresponding to processing such as gain limiter, gain smother and sinusoid addition are omitted. However, it is easy to generalize processing so as to include the above omitted processing. Note that it is assumed that noise floor scale factor required for performing processing corresponding to noise addition or a parameter required for performing the above-described omitted processing are already supplied from the coded sequence decoding/dequantization unit 1*e*.

First, for simplification of the following description, an array $F_H$ having $n_H+1$ number of indexes representing the boundary of the sub-band $B^{(T)}_l$ $(1\le l\le n_H)$ as elements is defined so that the signal $X_H(j,i)$ $\{F_H(1)\le j<F_H(1+1),\ t(s)\le i<t(s+1),\ 0\le s<s_E\}$ corresponds to the component of the sub-band $B^{(T)}_l$. Note that $F_H(1)=k_x$ and $F_H(n_H+1)=k_{max}+1$.

Under the above definition, the time envelope is transformed by the following equation:

$$E(m,i)=E_T(l,i) \qquad \text{[Equation 28]}$$

$$k_l-k_x\le m\le k_h-k_x,\ \begin{cases} k_l=F_H(l) \\ k_h=F_H(l+1)-1, \end{cases}$$

$$1\le l\le n_H,\ t(s)\le i<t(s+1),\ 0\le s<s_E$$

After that, the noise floor scale factor Q(m,i) given by the coded sequence decoding/dequantization unit 1*e* are transformed by the following equation:

$$Q_2(m,i)=\sqrt{E(m,i)\cdot\frac{Q(m,i)}{1+Q(m,i)}}, \qquad \text{[Equation 29]}$$

$$0\le m<M,\ t(s)\le i<t(s+1),\ 0\le s<s_E$$

where $M=F(n_H+1)-F(1)$. Further, the gain is calculated by the following equation:

$$G(m,i)=\sqrt{\frac{E(m,i)}{(\varepsilon+E_{curr}(m,i))}\cdot\frac{Q(m,i)}{1+Q(m,i)}}, \qquad \text{[Equation 30]}$$

$$0\le m<M,\ t(s)\le i<t(s+1),\ 0\le s<s_E$$

The quantity represented by the following equation is defined.

$$E_{curr}(k-k_x,i)=\frac{1}{(k_h-k_l+1)}\cdot\sum_{j=k_l}^{k_h}|X_H(j,i)|^2, \qquad \text{[Equation 31]}$$

$$k_l\le k\le k_h,\ \begin{cases} k_l=F_H(p) \\ k_h=F_H(p+1)-1, \end{cases}$$

$$1\le p\le n_H,\ t(s)\le i<t(s+1),\ 0\le s<s_E$$

Finally, the time envelope adjustment unit 1*i* obtains the signal with the adjusted time envelope by the following equation:

$$Re\{Y(m+k_x,i)\}=Re\{W_1(m,i)\}+Q_2(m,i)\cdot V_0(f(i)),$$

$$Im\{Y(m+k_x,i)\}=Im\{W_1(m,i)\}+Q_2(m,i)\cdot V_1(f(i)),$$

$$W_1(m,i)=G(m,i)\cdot X_{dec}(m+k_x,i),$$

$$0\le m<M,\ t(s)\le i<t(s+1),\ 0\le s<s_E \qquad \text{[Equation 32]}$$

where $V_0$ and $V_1$ are arrays specifying the noise component, and f is the function to map the index i onto an index on the arrays (see "ISO/IEC 14496-3 4.B.18" for a specific example).

The band synthesis filter bank unit 1*j* adds the high frequency band signal $Y(i,j)$ $\{k_x\le j\le k_{max},\ t(s)\le i<(s+1)\ 0\le s<s_E\}$ supplied from the time envelope adjustment unit 1*i* and the low frequency band signal $X(j,i)$ $\{0\le j<k_x,\ t(s)\le i<t(s+1),\ 0\le s<s_E\}$ supplied from the band splitting filter bank unit 1*c* together and then synthesizes them, and thereby acquires a decoded speech signal in the time domain containing the entire frequency band components, and outputs the acquired speech signal to the outside through the internal communication device.

Hereinafter, the operation of the speech decoder 1 is described and the speech decoding method in the speech decoder 1 is also described in detail with reference to FIG. 2.

First, the demultiplexing unit 1*a* divides the input coded sequence into the low frequency band coded sequence and the high frequency band coded sequence (Step S01). Next, the low frequency band decoding unit 1*b* decodes the low frequency band coded sequence and obtains the decoded signal containing only low frequency band components (Step S02). Then, the band splitting filter bank unit 1*c* analyzes the decoded signal containing only low frequency band components and transforms it into a signal in the frequency domain (Step S03).

Further, the coded sequence analysis unit 1*d* analyzes the high frequency band coded sequence and acquires the coded supplementary information for high frequency band generation and the quantized time envelope information (Step S04). Then, the coded sequence decoding/dequantization unit 1*e* decodes the supplementary information for high frequency band generation and dequantize the time envelope information (Step S05). After that, the high frequency band generation unit 1*h* replicates the low frequency band signal $X_{dec}(j,i)$ onto the high frequency band using the supplementary information for high frequency band generation and thereby generates the high frequency band signal $X_{dec}(j,i)$ (Step S06). Then, the first to n-th low frequency band time envelope calculation units $1f_1$ to $1f_n$ calculate a plurality of low frequency band time envelopes $L_{dec}(k,i)$ based on the low frequency band signal X(j,i) (Step S07).

Further, the time envelope calculation unit 1*g* calculates the high frequency band time envelope $E_T(l,i)$ using the plurality of low frequency band time envelopes $L_{dec}(k,i)$ and the time envelope information (Step S08). Then, the time envelope adjustment unit 1*i* adjusts the time envelope of the high frequency band signal $X_H(j,i)$ by using the time envelope $E_T(l,i)$ (Step S09). Finally, the band synthesis filter bank unit 1*j* adds the high frequency band signal Y(i,j) and the low frequency band signal X(j,i) together and then synthesizes them to acquire the decoded speech signal in the time domain and outputs the decoded speech signal (Step S10).

Figure 3:
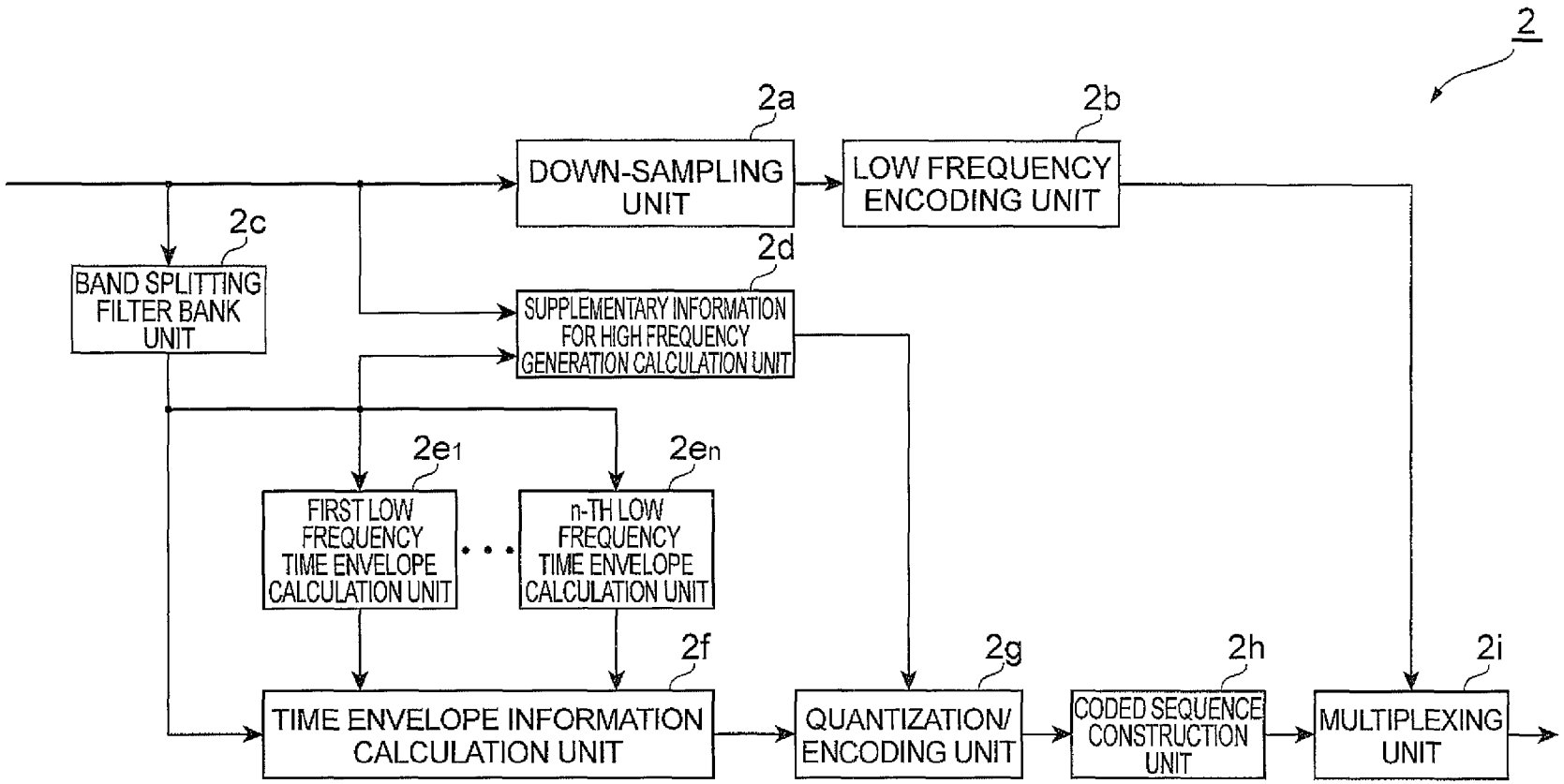
FIG. 3 is a schematic block diagram of a speech encoder 2 according to the first embodiment of the invention.
Figure 4:
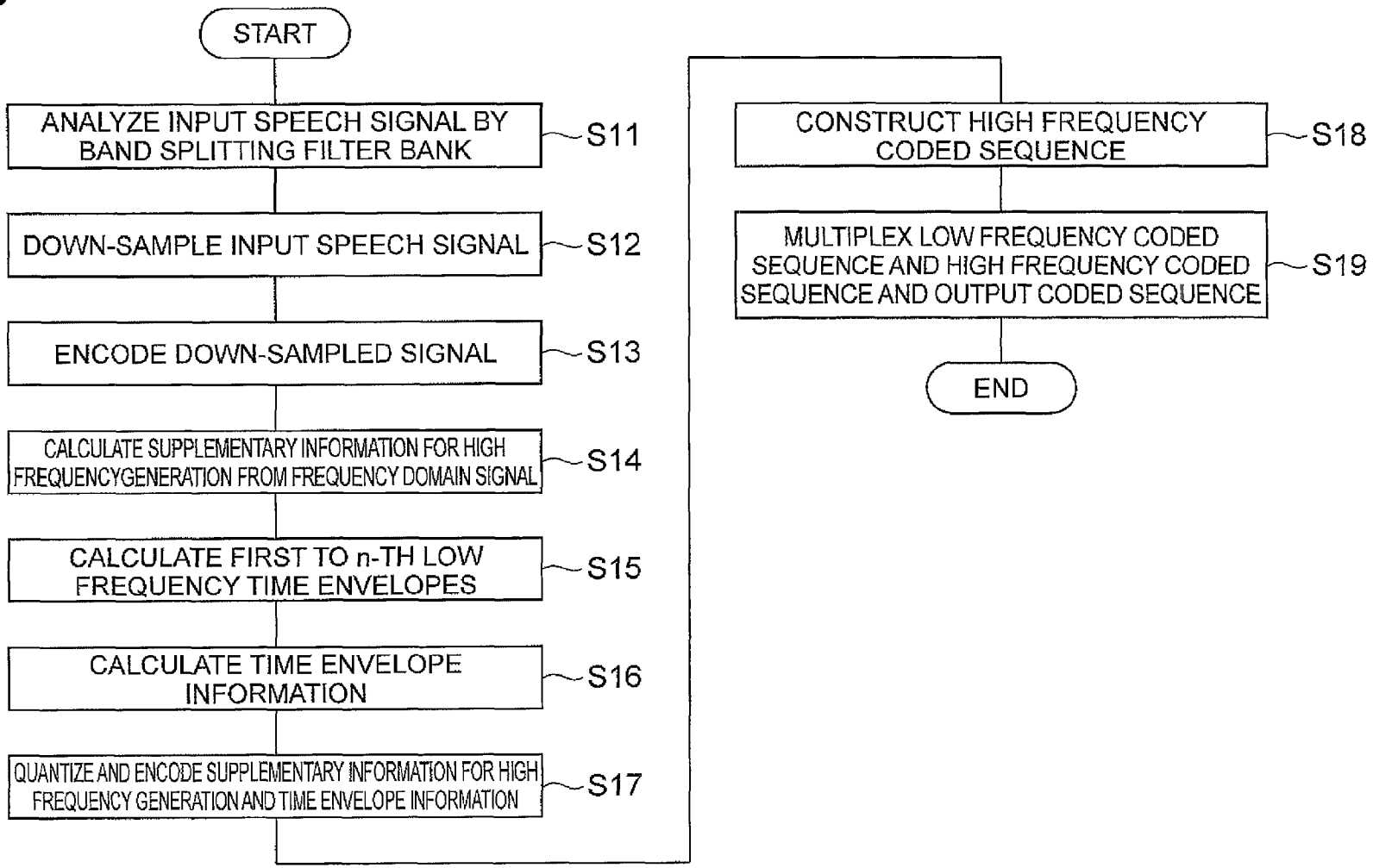
FIG. 4 is a flowchart showing a procedure of a speech encoding method implemented by the speech encoder 2 shown in FIG. 3.

FIG. 3 is a diagram showing a configuration of the speech encoder 2 according to the first embodiment of the invention, and FIG. 4 is a flowchart showing a procedure of a speech encoding method implemented by the speech encoder 2. The speech encoder 2 includes CPU, ROM, RAM, a communication device and the like that are not physically shown, and the CPU loads a specified computer program (for example, a computer program for performing the process shown in the flowchart of FIG. 4) stored in an internal memory such as the ROM of the speech encoder 2 to the RAM and executes the program to thereby exercise control over the speech encoder 2. The communication device of the speech encoder 2 receives a speech signal to be encoded from the outside and outputs a coded multiplexed bit stream to the outside.

As shown in FIG. 3, the speech encoder 2 functionally includes a down-sampling unit (down-sampling means) 2*a*, a low frequency band encoding unit (low frequency band encoding means) 2*b*, a band splitting filter bank unit (frequency transformation means) 2*c*, a supplementary information for high frequency band generation calculation unit (supplementary information calculation means) 2*d*, first to n-th (n is an integer of two or more) low frequency band time envelope calculation units (low frequency band time envelope calculation means) $2e_l$ to $2e_n$, a time envelope information calculation unit (time envelope information calculation means) 2*f*, a quantization/encoding unit (quantization and encoding means) 2*g*, a high frequency band coded sequence construction unit (coded sequence construction means) 2*h*, and a multiplexing unit (multiplexing means) 2*i*. The respective units of the speech encoder 2 shown in FIG. 3 are functional units that are realized by the CPU of the speech encoder 2 executing a computer program stored in the internal memory of the speech encoder 2. The CPU of the speech encoder 2 executes the computer program (uses the functional units of FIG. 3) to sequentially execute the process shown in the flowchart of FIG. 4 (the process of Steps S11 to S20). It is assumed that various data required for execution of the computer program and various data generated by execution of the computer program are stored in the internal memory, such as ROM and RAM, of the speech encoder 2.

The down-sampling unit 2*a* processes an external input signal that is received through the communication device of the speech encoder 2 and obtains a down-sampled time domain signal in the low frequency band. The low frequency band encoding unit 2*b* encodes the down-sampled time domain signal and obtains a low frequency band coded sequence. The encoding in the low frequency band encoding unit 2*b* may be based on a speech coding method such as CELP, or based on transform coding such as AAC or audio coding such as TCX. Further, it may be based on PCM coding. Furthermore, it may be based on a method that uses those coding methods switchably. In this embodiment, a method of coding is not particularly limited.

The band splitting filter bank unit 2*c* analyzes an external input signal that is received through the communication device of the speech encoder 2 and transforms it into a signal X(j,i) in the entire frequency bands in the frequency domain, where j is an index in the frequency direction, i is an index in the time direction.

The supplementary information for high frequency band generation calculation unit 2*d* receives the frequency domain signal X(j,i) from the band splitting filter bank unit 2*c* and calculates, based on analysis of the power, signal variations, tonality and the like of the high frequency band, supplementary information for high frequency band generation to be used when generating high frequency band signal components from low frequency band signal components.

The first to n-th low frequency band time envelope calculation units $2e_l$ to $2e_n$ calculate a plurality of different time envelopes of low frequency band components, respectively. Specifically, the k-th low frequency band time envelope calculation unit $2e_k$ ($1 \le k \le n$) receives a low frequency band signal X(j,i) $\{0 \le j < k_x, t(s) \le i < t(s+1), 0 \le s < s_E\}$ from the band splitting filter bank unit 2*c* and calculates the k-th time envelope L(k,i) $\{t(s) \le i < t(s+1), 0 \le s < s_E\}$ in the low frequency band in accordance with the above-described calculation method of the time envelope $L_{dec}(k,i)$ of the k-th low frequency band time envelope calculation unit $1f_k$ ($1 \le k \le n$) of the speech decoder 1 described above.

The time envelope information calculation unit 2*f* receives the high frequency band signal X(j,i) $\{k_x \le j < N, t(s) \le i < t(s+1), 0 \le s < s_E\}$ from the band splitting filter bank unit 2*c* and receives the time envelope L(k,i) $\{t(s) \le i < t(s+1), 0 \le s < s_E\}$ from the k-th low frequency band time envelope calculation unit $2e_k$ ($1 \le k \le n$), and calculates time envelope information required for acquiring the time envelope of high frequency band components of the signal X(j,i). The time envelope information is information that can construct the approximation of a reference time envelope in the high frequency band when the time envelope $L_{dec}(k,i)$ is given on the speech decoder 1 side described above.

Specifically, calculation of the time envelope information is performed as follows. First, a time envelope of power is calculated by the following equation.

[Equation 33]

$$E_H(l, i) = \frac{1}{k_h - k_l + 1} \sum_{j=k_l}^{k_h} |X(j, i)|^2$$

$$k_h = F_H(l),\ k_l = F_H(l+1) - 1,$$

$$1 \le l \le n_H,\ t(s) \le i < t(s+1),\ 0 \le s < s_E$$

Next, when the reference time envelope in the l-th ($1 \le l \le n_H$) frequency band of the high frequency band is represented as H(l,i) {t(s)≤i<t(s+1)}, the reference time envelope H(l,i) is calculated by the following equation.

$$H(l,i)=10\log_{10}E_H(l,i),$$

$$k_h=F_H(l),\ k_l=F_H(l+1)-1,$$

$$t(s)\le i<t(s+1),\ 0\le s<s_E \qquad \text{[Equation 34]}$$

or by the following equation.

$$H(l,i)=E_H(l,i),$$

$$k_h=F_H(l),\ k_l=F_H(l+1)-1,$$

$$t(s)\le i<t(s+1),\ 0\le s<s_E \qquad \text{[Equation 35]}$$

Note that, the reference time envelope in the high frequency band may be obtained by performing specified processing (for example, smoothing) on H(l,i), like the time envelope in the low frequency band described above. Further, the reference time envelope in the high frequency band is not necessarily calculated by the above calculation method as long as it is a parameter representing the time-variation of the signal power or the signal amplitude of the high frequency band signal. When the approximation of the reference time envelope H(l,i) by the time envelope L(k,i) is represented as g(l,i), the form of g(l,i) conforms to the form $g_{dec}$(l,i) in the speech decoder 1. The time envelope L(k,i) corresponds to the time envelope $L_{dec}$(k,i) on the speech decoder 1 side.

For example, the time envelope information can be calculated by defining an error of the above g(l,i) with respect to the reference time envelope H(l,i) and calculating g(l,i) that minimizes the error. Specifically, it can be calculated by treating the error as a function of the time envelope information and finding the time envelope information that gives the minimum value of the error. The calculation of the time envelope information may be performed numerically or may be calculated using a numerical formula.

To be more specific, the error of the above g(l,i) with respect to the reference time envelope H(l,i) may be calculated by the following equation:

$$\text{error}=\sum_{i=t(s)}^{t(s+1)-1}(H(l,i)-g(l,i))^2, \qquad \text{[Equation 36]}$$

$$1\le l\le n_H,\ 0\le s<s_E$$

Further, the error may be calculated as a weighted error using the following equation:

$$\text{error}=\sum_{i=t(s)}^{t(s+1)-1}w(i)(H(l,i)-g(l,i))^2, \qquad \text{[Equation 37]}$$

$$1\le l\le n_H,\ 0\le s<s_E$$

Furthermore, the error may be calculated by the following equation:

$$\text{error}=\sum_{l=1}^{n_H}\sum_{i=t(s)}^{t(s+1)-1}w(l,i)(H(l,i)-g(l,i))^2, \qquad \text{[Equation 38]}$$

$$0\le s<s_E$$

The weight w(l,i) may be defined as a weight that varies with the time index i or a weight that varies with the frequency index l, and it may be defined as a weight that varies with the time index i and the frequency index l. Note that, in this embodiment, the form of the error and the form of the weight are not particularly limited to the above examples.

The quantization/encoding unit 2*g* receives the time envelope information from the time envelope information calculation unit 2*f* and then quantizes and encodes the time envelope information, and receives the supplementary information for high frequency band generation from the supplementary information for high frequency band generation calculation unit 2*d* and then encodes the supplementary information for high frequency band generation.

As a quantization and encoding method of the time envelope information, when the information is in the form of the coefficient $A_{l,k}$(s), for example, $A_{l,k}$(s) may be scalar-quantized and then entropy-coded. Further, $A_{l,k}$(s) may be vector-quantized using a specified code book and then its index may be coded. In this embodiment, however, the quantization and encoding method of the time envelope information is not limited to the above.

The high frequency band coded sequence construction unit 2*h* receives the coded supplementary information for high frequency band generation and the quantized time envelope information from the quantization/encoding unit 2*g* and constructs a high frequency band coded sequence containing those.

The multiplexing unit 2*i* receives the low frequency band coded sequence from the low frequency band encoding unit 2*b* and receives the high frequency band coded sequence from the high frequency band coded sequence construction unit 2*h*, multiplexes those two coded sequences to generate a coded sequence and outputs the generated coded sequence.

Hereinafter, the operation of the speech encoder 2 is described and the speech encoding method in the speech encoder 2 is also described in detail with reference to FIG. 4.

First, the band splitting filter bank unit 2*c* analyzes an input speech signal and thereby acquires the frequency domain signal X(j,i) in the entire frequency bands (Step S11). Next, the down-sampling unit 2*a* processes an external input speech signal and acquires the down-sampled time domain signal (Step S12). Then, the low frequency band encoding unit 2*b* encodes the down-sampled time domain signal and obtains the low frequency band coded sequence (Step S13).

Further, the supplementary information for high frequency band generation calculation unit 2*d* analyzes the frequency domain signal X(j,i) acquired from the band splitting filter bank unit 2*c* and calculates the supplementary information for high frequency band generation to be used when generating high frequency band signal components (Step S14). Then, the first to n-th low frequency band time envelope calculation units $2e_1$ to $2e_n$ calculate a plurality of low frequency band time envelopes L(k,i) based on the low frequency band signal X(j,i) (Step S15). After that, the time envelope information calculation unit 2*f* calculates, based on the high frequency band signal X(j,i) and the plurality of low frequency band time envelopes L(k,i), the time envelope information required for acquiring the time envelope of high frequency band components of the signal X(j,i) (Step S16). Then, the quantization/encoding unit 2*g* quantizes and encodes the time envelope information and encodes the supplementary information for high frequency band generation (Step S17).

Further, the high frequency band coded sequence construction unit 2*h* constructs the high frequency band coded sequence containing the coded supplementary information for high frequency band generation and the quantized time envelope information (Step S18). Then, the multiplexing unit 2*i* generates the coded sequence by multiplexing the low frequency band coded sequence and the high frequency band coded sequence and outputs the generated coded sequence (Step S19).

According to the speech decoder 1, the decoding method or the decoding program described above, the low frequency band signal is obtained from the coded sequence by demultiplexing and decoding, and the supplementary information for high frequency band generation and the time envelope information are obtained from the coded sequence by demultiplexing, decoding and dequantization. Then, the high frequency band component $X_{dec}(j,i)$ in the frequency domain is generated from the low frequency band signal $X_{dec}(j,i)$ transformed into the frequency domain using the supplementary information for high frequency band generation, and, on the other hand, after acquiring a plurality of low frequency band time envelopes $L_{dec}(k,i)$ by analyzing the low frequency band signal $X_{dec}(j,i)$ in the frequency domain, the high frequency band time envelope $E_T(l,i)$ is calculated using the plurality of low frequency band time envelopes $L_{dec}(k,i)$ and the time envelope information. Further, the time envelope of the high frequency band component $X_H(j,i)$ is adjusted by the calculated high frequency band time envelope $E_T(l,i)$, and the adjusted high frequency band component and the low frequency band signal are added together and thereby the time domain signal is output. In this manner, because a plurality of low frequency band time envelopes $L_{dec}(k,i)$ are used for adjustment of the time envelope of the high frequency band component $X_H(j,i)$, the waveform of the time envelope of the high frequency band component is adjusted with high accuracy by use of the correlation between the time envelope of low frequency band components and the time envelope of high frequency band components. As a result, the time envelope in the decoded signal is adjusted into a less distorted shape, and therefore a reproduced signal with less pre-echo and post-echo can be obtained.

Further, according to the speech encoder 2, the encoding method or the encoding program described above, the low frequency band signal is obtained by down-sampling of a speech signal, and the low frequency band signal is encoded and, on the other hand, a plurality of time envelopes L(k,i) of low frequency band components are calculated based on the speech signal X(j,i) in the frequency domain, and the time envelope information for acquiring the time envelope of high frequency band components is calculated using the plurality of time envelopes L(k,i) of low frequency band components. Further, the supplementary information for high frequency band generation for generating high frequency band components from the low frequency band signal is calculated, and, after the supplementary information for high frequency band generation and the time envelope information are quantized and encoded, the high frequency band coded sequence containing the supplementary information for high frequency band generation and the time envelope information is constructed. Then, the coded sequence in which the low frequency band coded sequence and the high frequency band coded sequence are multiplexed is generated. Accordingly, when the coded sequence is input to the speech decoder 1, a plurality of low frequency band time envelopes can be used for adjustment of the time envelope of high frequency band components on the speech decoder 1 side, and the waveform of the time envelope of high frequency band components is thereby adjusted with high accuracy by use of the correlation between the time envelope of low frequency band components and the time envelope of high frequency band components on the speech decoder 1 side. As a result, the time envelope in the decoded signal is adjusted into a less distorted shape, and therefore a reproduced signal with less pre-echo and post-echo can be obtained on the decoder side.

First Alternative Example of Speech Decoder According to First Embodiment

Figure 5:
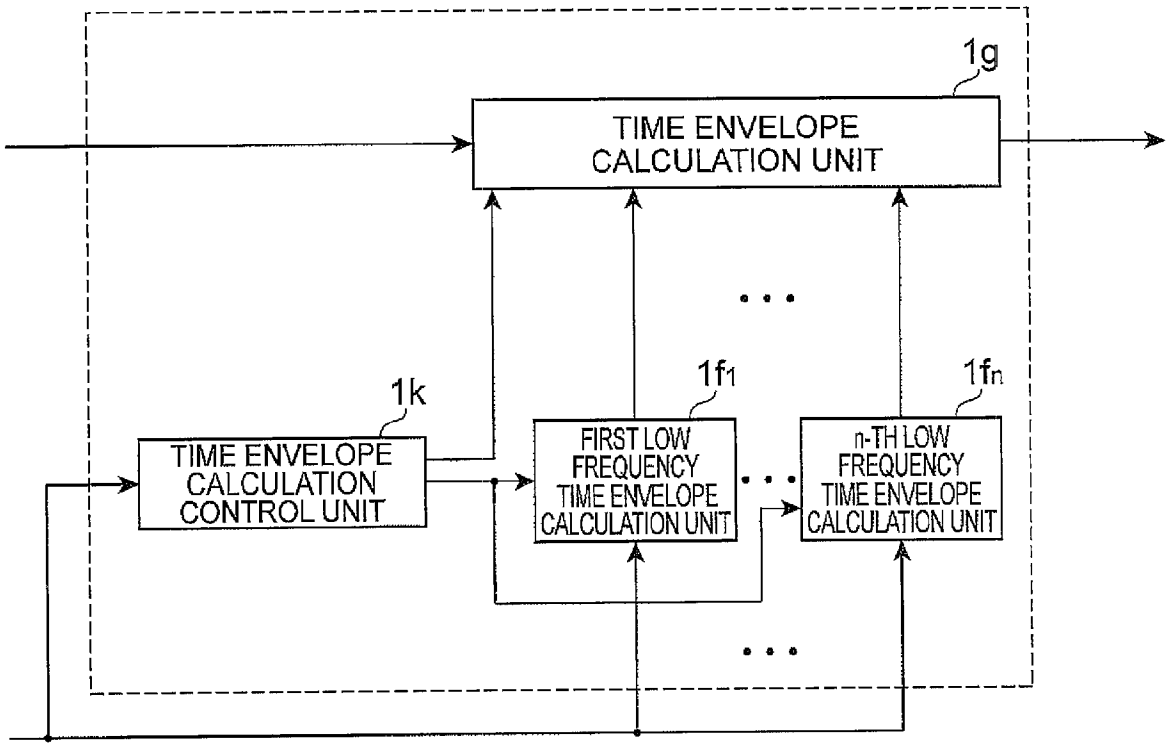
FIG. 5 is a diagram showing a configuration of a principal part relating to envelope calculation in a first alternative example of the speech decoder 1 according to the first embodiment.
Figure 6:
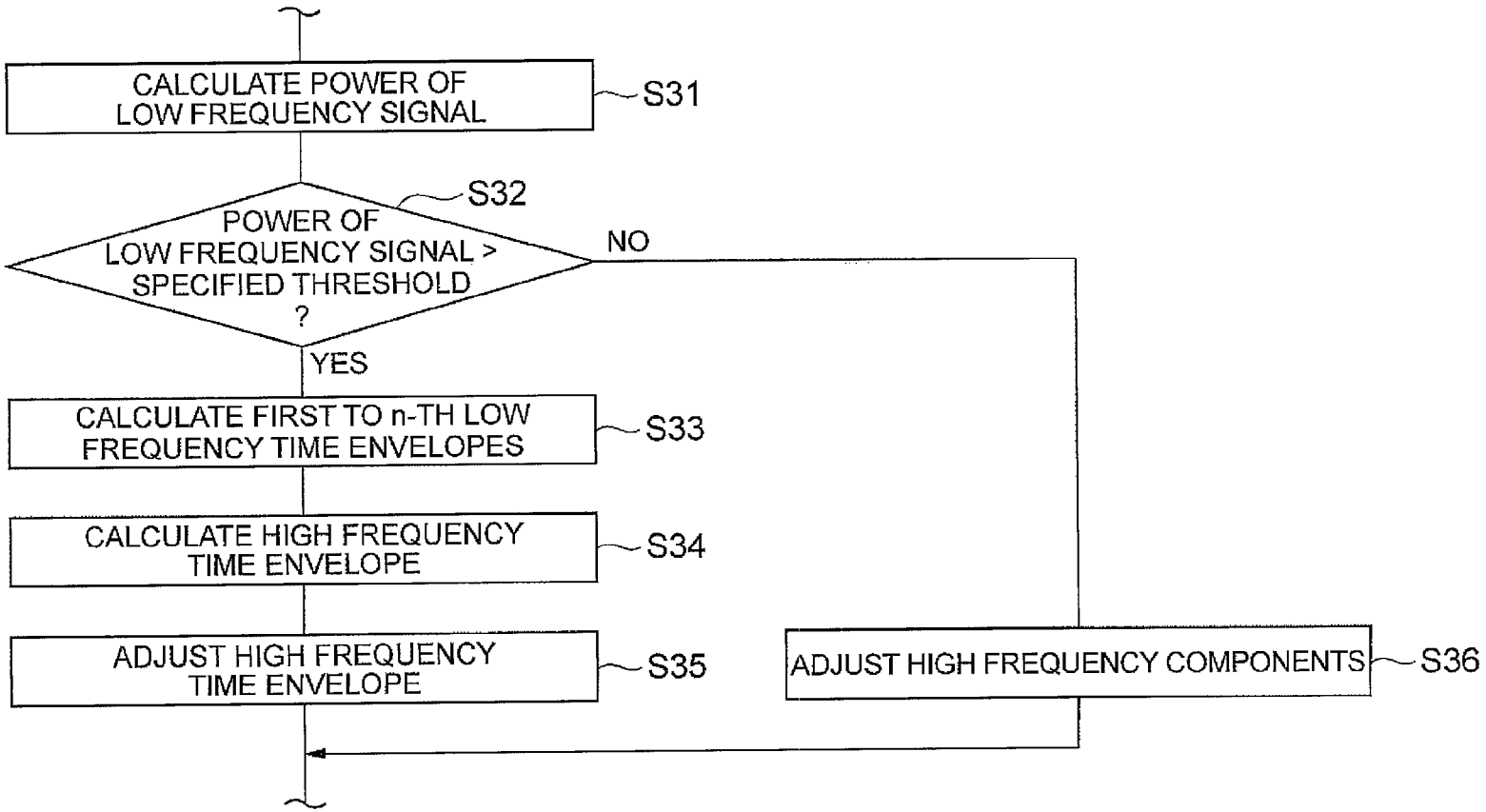
FIG. 6 is a flowchart showing a procedure of envelope calculation performed by the speech decoder 1 shown in FIG. 5.

FIG. 5 is a diagram showing a configuration of a principal part related to envelope calculation in a first alternative example of the speech decoder 1 according to the first embodiment, and FIG. 6 is a flowchart showing a procedure of envelope calculation by the speech decoder 1 shown in FIG. 5.

The speech decoder 1 shown in FIG. 5 includes a time envelope calculation control unit (time envelope calculation control means) 1*k* in addition to the low frequency band time envelope calculation units $\mathbf{1}f_1$ to $\mathbf{1}f_n$ and the time envelope calculation unit 1*g*. The time envelope calculation control unit 1*k* receives a low frequency band signal from the band splitting filter bank unit 1*c*, calculates the power of the low frequency band signal in the frame (Step S31), and compares the calculated power of the low frequency band signal with a specified threshold (Step S32). When the power of the low frequency band signal is not larger than the specified threshold (NO in Step S32), the time envelope calculation control unit 1*k* outputs a low frequency band time envelope calculation control signal to the low frequency band time envelope calculation units $\mathbf{1}f_1$ to $\mathbf{1}f_n$ and outputs a time envelope calculation control signal to the time envelope calculation unit 1*g* so that time envelope calculation is not performed in the low frequency band time envelope calculation units $\mathbf{1}f_1$ to $\mathbf{1}f_n$ and the time envelope calculation unit 1*g*. In this case, the time envelope of the high frequency band signal is sent to the band synthesis filter bank unit 1*j* without being adjusted based on the above-described time envelope (for example, in the above Equation 29, E(m,i) is replaced with $E_{curr}(m,i)$), and the following equation:

$$G(m, i) = \sqrt{\frac{Q(m, i)}{1 + Q(m, i)}} \quad \text{[Equation 39]}$$

is used in place of the above Equation 30) (Step S36). On the other hand, when the power of the low frequency band signal is larger than the specified threshold, the time envelope calculation control unit 1*k* outputs a low frequency band time envelope calculation control signal to the low frequency band time envelope calculation units $\mathbf{1}f_1$ to $\mathbf{1}f_n$ and outputs a time envelope calculation control signal to the time envelope calculation unit 1*g* so that time envelope calculation is performed in the low frequency band time envelope calculation units $\mathbf{1}f_1$ to $\mathbf{1}f_n$ and the time envelope calculation unit 1*g*. In this case, the high frequency band signal whose time envelope is adjusted by the time envelope adjustment unit 1*i* based on the above-described time envelope is sent to the band synthesis filter bank unit 1*j*.

Referring to FIG. 6, in the first alternative example of the speech decoder 1, the envelope calculation process shown in Steps S31 to S36 is executed in place of the process in Steps S07 to S09 of the speech decoder 1 according to the first embodiment shown in FIG. 2.

In the first alternative example of the speech decoder 1 described above, when the power of the low frequency band signal is low and not used for calculation of the time envelope of the high frequency band signal, the process in Steps S07 to S08 can be skipped to reduce the amount of computation.

Note that the time envelope calculation control unit 1*k* may calculate the power of a part corresponding to the first to n-th low frequency band time envelopes calculated by the first to n-th low frequency band time envelope calculation units $\mathbf{1}f_1$ to $\mathbf{1}f_n$, output the low frequency band time envelope calculation control signal based on a result of comparing the calculated power corresponding to the first to n-th low frequency band time envelopes with a specified threshold and thereby control whether or not to skip the processing of the first to n-th low frequency band time envelope calculation units $\mathbf{1}f_1$ to $\mathbf{1}f_n$.

In this case, when the time envelope calculation control unit 1*k* makes control to skip the processing by all of the first to n-th low frequency band time envelope calculation units $\mathbf{1}f_1$ to $\mathbf{1}f_n$, it outputs the time envelope calculation control signal to the time envelope calculation unit 1*g* so as to skip the time envelope calculation process. On the other hand, when the time envelope calculation control unit 1*k* makes control so that at least one of the first to n-th low frequency band time envelope calculation units $\mathbf{1}f_1$ to $\mathbf{1}f_n$ performs the low frequency band time envelope calculation process, it outputs the time envelope calculation control signal to the time envelope calculation unit 1*g* so as to perform the time envelope calculation process.

Second Alternative Example of Speech Decoder According to First Embodiment

Figure 7:
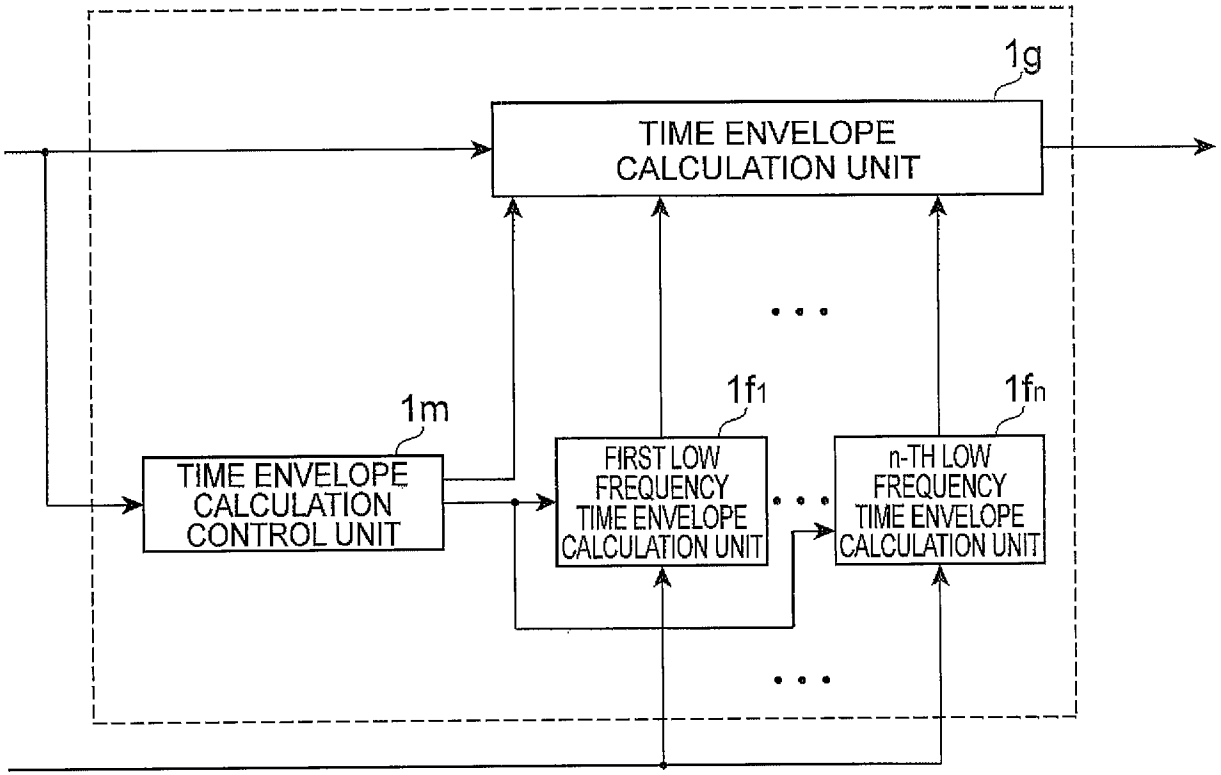
FIG. 7 is a diagram showing a configuration of a principal part relating to envelope calculation in a second alternative example of the speech decoder 1 according to the first embodiment.
Figure 8:
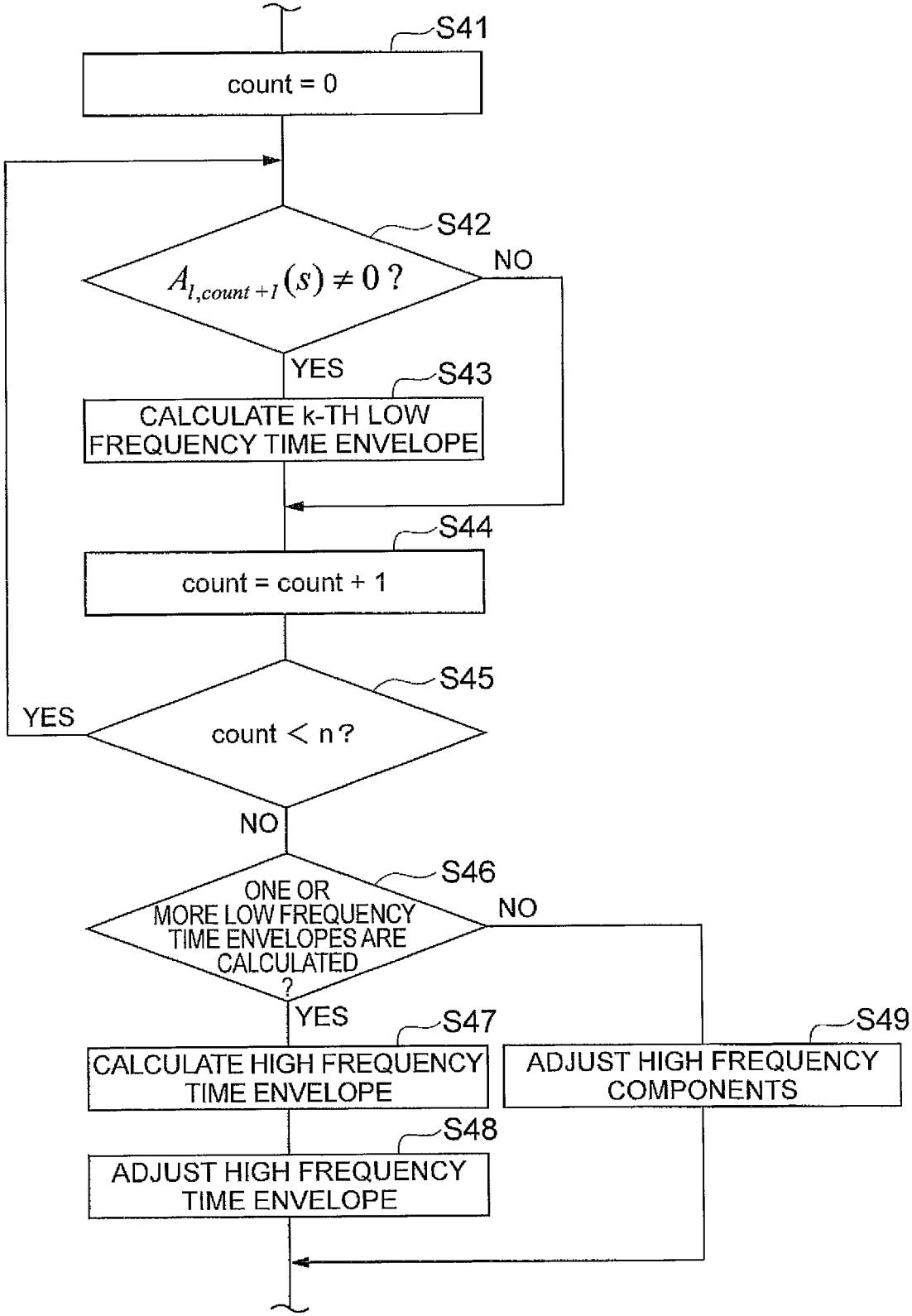
FIG. 8 is a flowchart showing a procedure of envelope calculation performed by the speech decoder 1 shown in FIG. 7.

FIG. 7 is a diagram showing a configuration of a principal part relating to envelope calculation in a second alternative example of the speech decoder 1 according to the first embodiment, and FIG. 8 is a flowchart showing a procedure of envelope calculation performed by the speech decoder 1 shown in FIG. 7.

The speech decoder 1 shown in FIG. 7 includes a time envelope calculation control unit (time envelope calculation control means) 1*m* in addition to the low frequency band time envelope calculation units $\mathbf{1}f_1$ to $\mathbf{1}f_n$ and the time envelope calculation unit 1*g*. The time envelope calculation control unit 1*m* outputs a low frequency band time envelope calculation control signal to the first to n-th low frequency band time envelope calculation units $\mathbf{1}f_1$ to $\mathbf{1}f_n$ based on the time envelope information received from the coded sequence decoding/dequantization unit 1*e* and controls execution of the low frequency band time envelope calculation in the first to n-th low frequency band time envelope calculation units $\mathbf{1}f_1$ to $\mathbf{1}f_n$.

To be specific, in the second alternative example of the speech decoder 1, the envelope calculation process in Steps S41 to S48 shown in FIG. 8 is executed, which replaces the process in Steps S07 to S09 of the speech decoder 1 according to the first embodiment shown in FIG. 2.

First, the time envelope calculation control unit 1*m* sets a count value "count" to 0 (Step S41). Next, the time envelope calculation control unit 1*m* determines whether a coefficient $A_{1,count+1}(s)$ contained in the time envelope information received from the coded sequence decoding/dequantization unit 1*e* is 0 or not (Step S42).

As a result of the determination, when the coefficient $A_{1,count+1}(s)$ is 0 (NO in Step S42), the time envelope calculation control unit 1*m* outputs a low frequency band time envelope calculation control signal to the count-th low frequency band time envelope calculation unit $\mathbf{1}f_{count}$ so that the low frequency band time envelope calculation in the low frequency band time envelope calculation unit $\mathbf{1}f_{count}$ is not performed and then proceeds to Step S44. On the other hand, when it is determined that the coefficient $A_{1,count+1}(s)$ is not 0 (YES in Step S42), the time envelope calculation control unit 1*m* outputs a low frequency band time envelope calculation control signal to the count-th low frequency band time envelope calculation unit $\mathbf{1}f_{count}$ so that the low frequency band time envelope calculation in the low frequency band time envelope calculation unit $\mathbf{1}f_{count}$ is performed. The low frequency band time envelope is thereby calculated by the low frequency band time envelope calculation unit $\mathbf{1}f_{count}$ (Step S43).

Further, the time envelope calculation control unit 1*m* increments the count value "count" by 1 (Step S44), and then compares the count value "count" with the number n of the low frequency band time envelope calculation units $\mathbf{1}f_1$ to $\mathbf{1}f_n$ (Step S45). When the count value "count" is smaller than the number n (YES in Step S45), the process returns to Step S42 and repeats the determination for the next coefficient $A_{1,count}(s)$ contained in the time envelope information. On the other hand, when the count value "count" is equal to or larger than the number n (NO in Step S45), the process proceeds to Step S46. Then, the time envelope calculation control unit 1*m* determines whether the low frequency band time envelope calculation is performed in one or more low frequency band time envelope calculation units $\mathbf{1}f_1$ to $\mathbf{1}f_n$ (Step S46). As a result of the determination, when the low frequency band time envelope calculation is not performed in any of the low frequency band time envelope calculation units $\mathbf{1}f_1$ to $\mathbf{1}f_n$ (NO in Step S46), the time envelope calculation control unit 1*m* outputs the time envelope calculation control signal to the time envelope calculation unit 1*g* so as to skip the time envelope calculation process. In this case, Step S49 is performed in place of Step S47 to S48 and then the process proceeds to Step S10 (FIG. 2). On the other hand, when the low frequency band time envelope calculation is performed in one or more the low frequency band time envelope calculation units $\mathbf{1}f_1$ to $\mathbf{1}f_n$ (YES in Step S46), the time envelope calculation unit 1*g* performs the time envelope calculation process (Step S47). Then, the time envelope adjustment unit 1*i* performs adjustment of the time envelope of the high frequency band signal (Step S48). After that, the band synthesis filter bank unit 1*j* synthesizes the output signal.

By the second alternative example of the speech decoder 1 described above, when a part of the process is not required based on the time envelope information obtained from the coded sequence, any of the process in Steps S07 to S08 can be skipped to reduce the amount of computation.

Third Alternative Example of Speech Decoder According to First Embodiment

Figure 9:
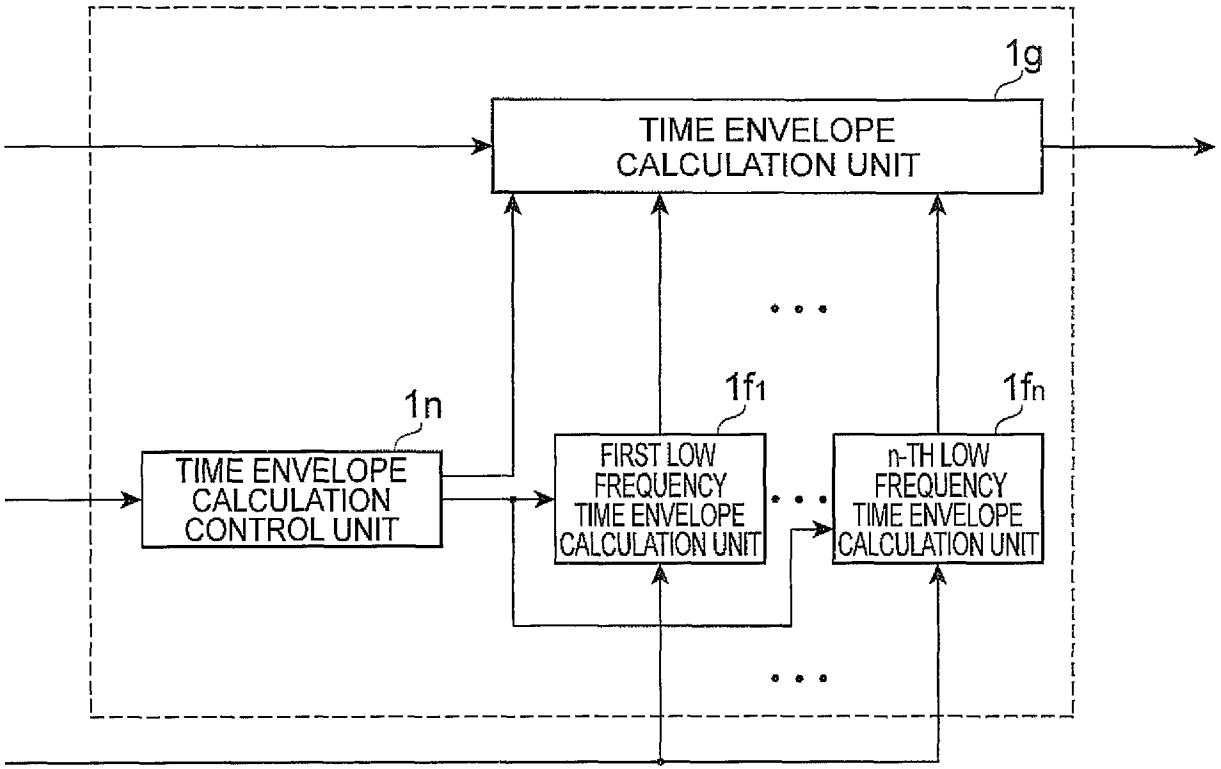
FIG. 9 is a diagram showing a configuration of a principal part relating to envelope calculation in a third alternative example of the speech decoder 1 according to the first embodiment.
Figure 10:
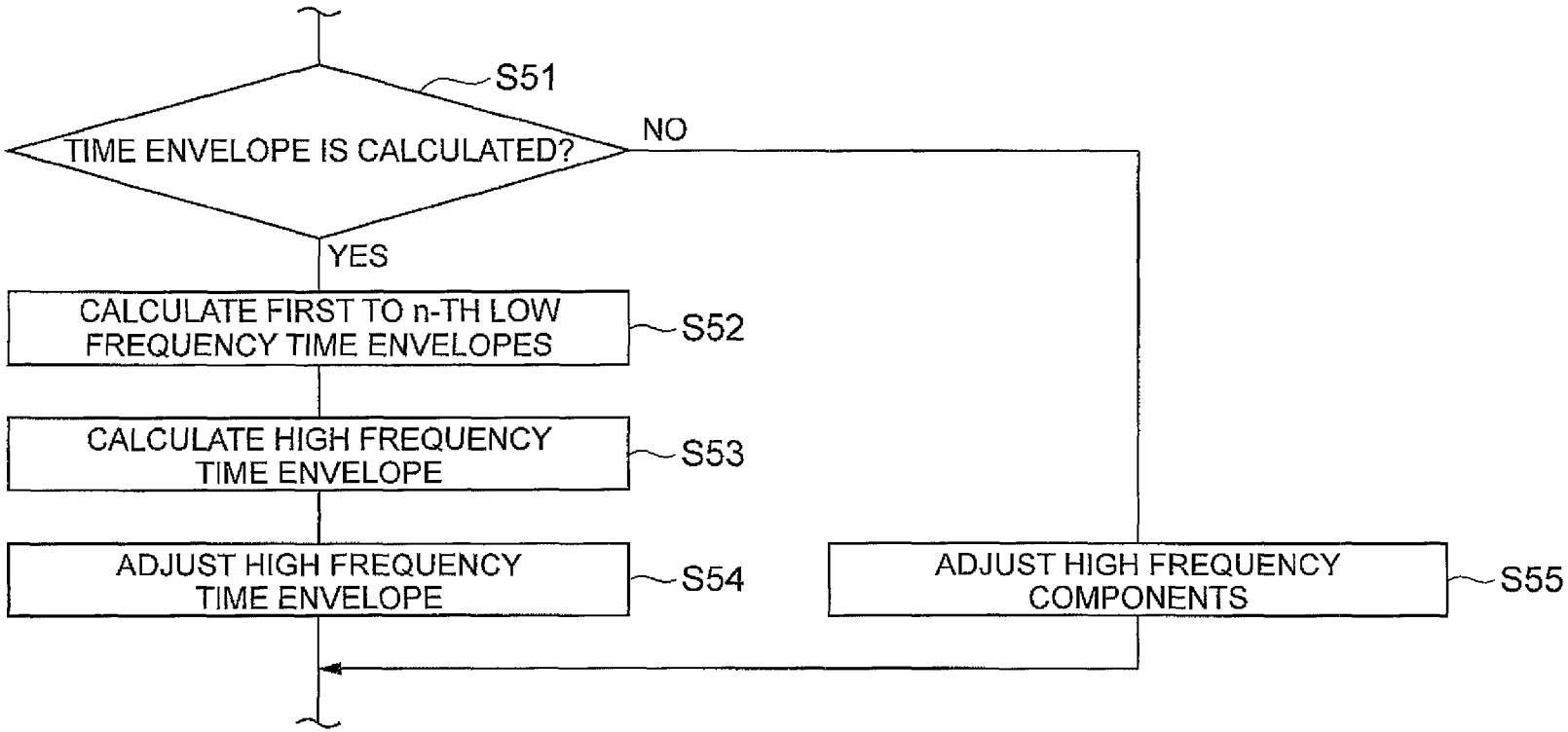
FIG. 10 is a flowchart showing a procedure of envelope calculation performed by the speech decoder 1 shown in FIG. 9.

FIG. 9 is a diagram showing a configuration of a principal part related to envelope calculation according to a third alternative example of the speech decoder 1 according to the first embodiment, and FIG. 10 is a flowchart showing a procedure of envelope calculation by the speech decoder 1 shown in FIG. 9.

The speech decoder 1 shown in FIG. 9 includes a time envelope calculation control unit (time envelope calculation control means) 1*n* in addition to the low frequency band time envelope calculation units $\mathbf{1}f_1$ to $\mathbf{1}f_n$ and the time envelope calculation unit 1*g*. The time envelope calculation control unit 1*n* receives time envelope calculation control information from the coded sequence analysis unit 1*d*. In this alternative example, the time envelope calculation control information describes whether or not to perform the time envelope calculation process in the frame. When decoding and dequantization are needed for reading the description of the time envelope calculation control information, the coded sequence decoding/dequantization unit 1*e* performs decoding and dequantization. Further, the time envelope calculation control unit 1*n* determines whether or not to perform the time envelope calculation process in the frame by referring to the time envelope calculation control information. When the time envelope calculation control unit 1*n* determines not to perform the time envelope calculation process, it outputs a low frequency band time envelope calculation control signal to the low frequency band time envelope calculation units $\mathbf{1}f_1$ to $\mathbf{1}f_n$ and outputs a time envelope calculation control signal to the time envelope calculation unit 1*g* so that the time envelope calculation process is not performed in the low frequency band time envelope calculation units $\mathbf{1}f_1$ to $\mathbf{1}f_n$ and the time envelope calculation unit 1*g*. In this case, the high frequency band signal is sent to the band synthesis filter bank unit 1*j* without adjustment of its time envelope based on the above-described time envelope. On the other hand, when the time envelope calculation control unit 1*n* determines to perform the time envelope calculation process, it outputs a low frequency band time envelope calculation control signal to the low frequency band time envelope calculation units $\mathbf{1}f_1$ to $\mathbf{1}f_n$ and outputs a time envelope calculation control signal to the time envelope calculation unit 1*g* so that the time envelope calculation process is performed in the low frequency band time envelope calculation units $\mathbf{1}f_1$ to $\mathbf{1}f_n$ and the time envelope calculation unit 1*g*. In this case, the high frequency band signal is sent to the band synthesis filter bank unit 1*j* after its time envelope is adjusted in the time envelope adjustment unit 1*i*.

Referring to FIG. 10, in the third alternative example of the speech decoder 1, the envelope calculation process in Steps S51 to S54 is executed in place of the process of Steps S07 to S09 of the speech decoder 1 according to the first embodiment shown in FIG. 2.

In the third alternative example of the speech decoder 1 described above also, the process in Steps S07 to S08 can be skipped based on the control information from the encoder to thereby reduce the amount of computation.

Fourth Alternative Example of Speech Decoder According to First Embodiment

Figure 11:
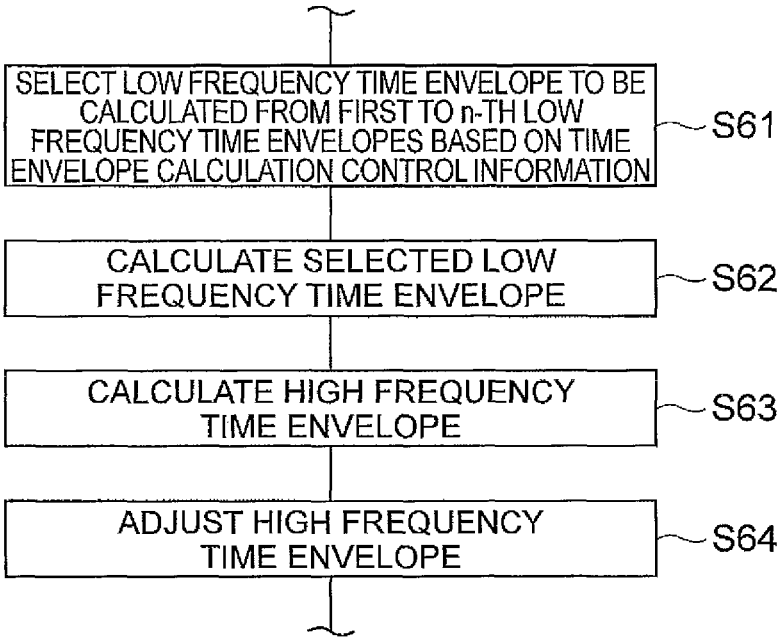
FIG. 11 is a flowchart showing a procedure of envelope calculation in a fourth alternative example of the speech decoder 1 according to the first embodiment.

FIG. 11 is a flowchart showing a procedure of envelope calculation performed by a fourth alternative example of the speech decoder 1 according to the first embodiment. Note that the configuration of the fourth alternative example of the speech decoder 1 is the same as that shown in FIG. 9.

In the fourth alternative example, the envelope calculation process in Steps S61 to S64 shown in FIG. 11 is executed in place of the process in Steps S07 to S09 of the speech decoder 1 according to the first embodiment shown in FIG. 2.

Specifically, the time envelope calculation control information describes the low frequency band time envelope to be used for time envelope calculation in the frame among the first to n-th low frequency band time envelopes. When decoding and dequantization are needed for reading the description of the time envelope calculation control information, the coded sequence decoding/dequantization unit 1*e* performs decoding and dequantization. Then, the time envelope calculation control unit 1*n* selects, based on the time envelope calculation control information, the low frequency band time envelope to be used for the time envelope calculation process in the frame (Step S61).

Then, the time envelope calculation control unit 1*n* outputs the low frequency band time envelope calculation control signal to the first to n-th low frequency band time envelope calculation units $\mathbf{1}f_1$ to $\mathbf{1}f_n$. It is thereby controlled so that the low frequency band time envelope is calculated by the low frequency band time envelope calculation unit $\mathbf{1}f_1$ to $\mathbf{1}f_n$ corresponding to the low frequency band time envelope that is selected in the above selection, and the low frequency band time envelope is not calculated by the low frequency band time envelope calculation unit $\mathbf{1}f_1$ to $\mathbf{1}f_n$ corresponding to the low frequency band time envelopes that is not selected in the above selection (Step S62).

After that, the time envelope calculation control unit 1*n* outputs the time envelope calculation control signal to the time envelope calculation unit 1*g* so that the time envelope is calculated using only the selected low frequency band time envelope (Step S63). Further, the time envelope adjustment unit 1*i* adjusts, using the calculated time envelope, the time envelope of the high frequency band signal generated in the high frequency band generation unit 1*h* (Step S64).

Further, when any of the low frequency band time envelope is not selected in the above selection, Steps S62 to S63 may be skipped, and the high frequency band signal may be sent to the band synthesis filter bank unit 1*j* without adjustment of its time envelope based on the above-described time envelope (Step S36 in FIG. 6).

In the fourth alternative example of the speech decoder 1 described above also, the process in Steps S07 to S08 can be skipped based on the control information from the encoder to reduce the amount of computation.

Fifth Alternative Example of Speech Decoder According to First Embodiment

Figure 12:
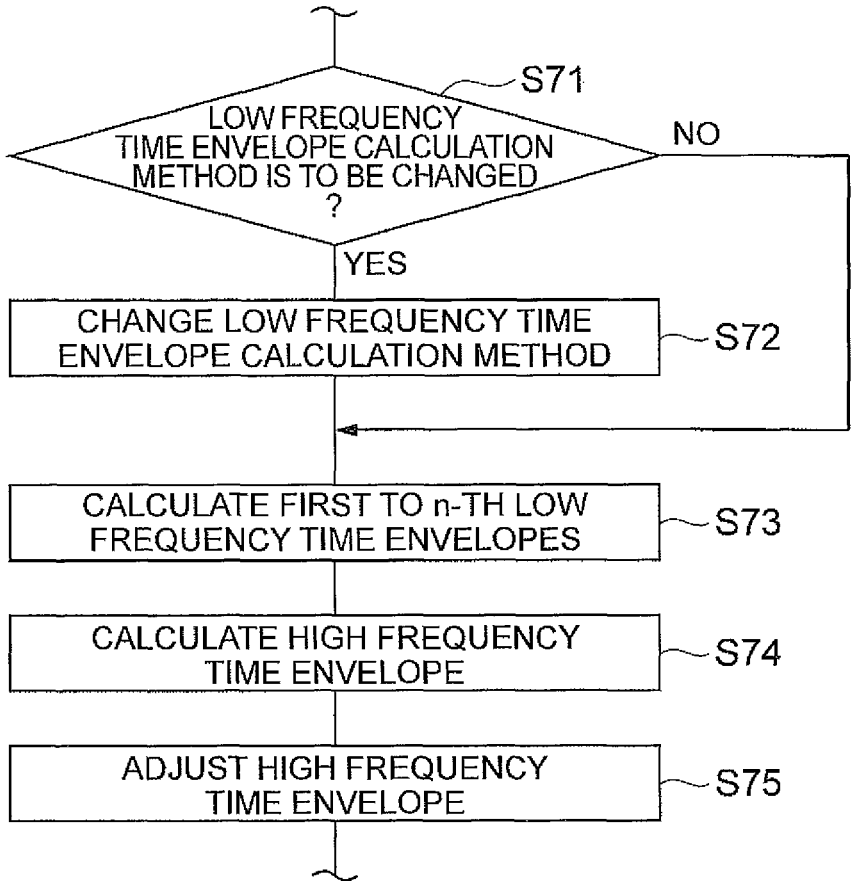
FIG. 12 is a flowchart showing a procedure of envelope calculation in a fifth alternative example of the speech decoder 1 according to the first embodiment.

FIG. 12 is a flowchart showing a procedure of envelope calculation performed by a fifth alternative example of the speech decoder 1 according to the first embodiment. Note that the configuration of the fifth alternative example of the speech decoder 1 is the same as that shown in FIG. 9.

In the fifth alternative example, the envelope calculation process in Steps S71 to S75 shown in FIG. 12 is executed in place of the process in Steps S07 to S09 of the speech decoder 1 according to the first embodiment shown in FIG. 2.

Specifically, the time envelope calculation control information describes a calculation method of the first to n-th low frequency band time envelopes in the frame. When decoding and dequantization are needed for reading the description of the time envelope calculation control information, the coded sequence decoding/dequantization unit 1*e* performs decoding and dequantization. The calculation method of the first to n-th low frequency band time envelopes described in the time envelope calculation control information may be the content related to setting of the arrays $B_l$ and $B_h$ representing sub-bands, for example, and the frequency range of the sub-band can be controlled based on the time envelope calculation control information. The content related to setting of the arrays $B_l$ and $B_h$ may be the description of a set of integers $(k_l k_h)$ to set the arrays $B_l$ and $B_h$ or the description related to selection from a plurality of specified contents of setting of the arrays $B_l$ and $B_h$. In this alternative example, a method of describing the content related to setting of the arrays $B_l$ and $B_h$ is not particularly limited. Further, a calculation method of the first to n-th low frequency band time envelopes described in the time envelope calculation control information may be the content related to setting of the specified processing (for example, the content related to setting of the smoothing coefficient sc(j) described above), and the specified processing (for example, the smoothing) can be controlled based on the time envelope calculation control information. The content related to setting of the smoothing coefficient sc(j) may be a result of quantizing and encoding the value of the smoothing coefficient sc(j) or may be the content related to selection of any one of a plurality of specified smoothing coefficients sc(j). Further, it may include the description as to whether or not to perform the smoothing. In this alternative example, a method of describing the content related to setting of the specified processing (for example, setting of the smoothing coefficient sc(j) described above) is not particularly limited. Furthermore, a method of calculating the first to n-th low frequency band time envelopes described in the time envelope calculation control information may include at least one of the above calculation methods. Note that, in this alternative example, a method of calculating the first to n-th low frequency band time envelopes described in the time envelope calculation control information is not limited to the above description as long as the content related to a method of calculating the low frequency band time envelope is described.

In Step S71, the time envelope calculation control unit 1*n* determines, based on the time envelope calculation control information, whether or not to change the calculation method of the low frequency band time envelope in the frame. When it is determined not to change the calculation method of the low frequency band time envelope (NO in Step S71), the first to n-th low frequency band time envelope calculation units $\mathbf{1}f_1$ to $\mathbf{1}f_n$ calculate the first to n-th low frequency band time envelopes without changing the calculation method of the low frequency band time envelope (Step S73). On the other hand, when it is determined to change the calculation method of the low frequency band time envelope (YES in Step S71), the time envelope calculation control unit 1*n* outputs the low frequency band time envelope calculation control signal to the first to n-th low frequency band time envelope calculation units $\mathbf{1}f_1$ to $\mathbf{1}f_n$ and thereby instructs the calculation method of the low frequency band time envelope, so that the calculation method of the low frequency band time envelope is changed (Step S72). After that, the first to n-th low frequency band time envelope calculation units $\mathbf{1}f_1$ to $\mathbf{1}f_n$ calculate the first to n-th low frequency band time envelopes by the changed low frequency band time envelope calculation method (Step S73). Further, the time envelope calculation unit 1*g* calculates the time envelope by using the first to n-th low frequency band time envelopes calculated by the first to n-th low frequency band time envelope calculation units $\mathbf{1}f_1$ to $\mathbf{1}f_n$ (Step S74). Then, the time envelope adjustment unit 1*i* adjusts, using the time envelope calculated in the time envelope calculation unit 1*g*, the time envelope of the high frequency band signal generated in the high frequency band generation unit 1*h* (Step S75).

In the fifth alternative example of the speech decoder 1 described above also, the process in Steps S07 to S08 can be precisely controlled based on the control information from the encoder, thereby allowing highly accurate adjustment of the time envelope.

Sixth Alternative Example of Speech Decoder According to First Embodiment

Figure 13:
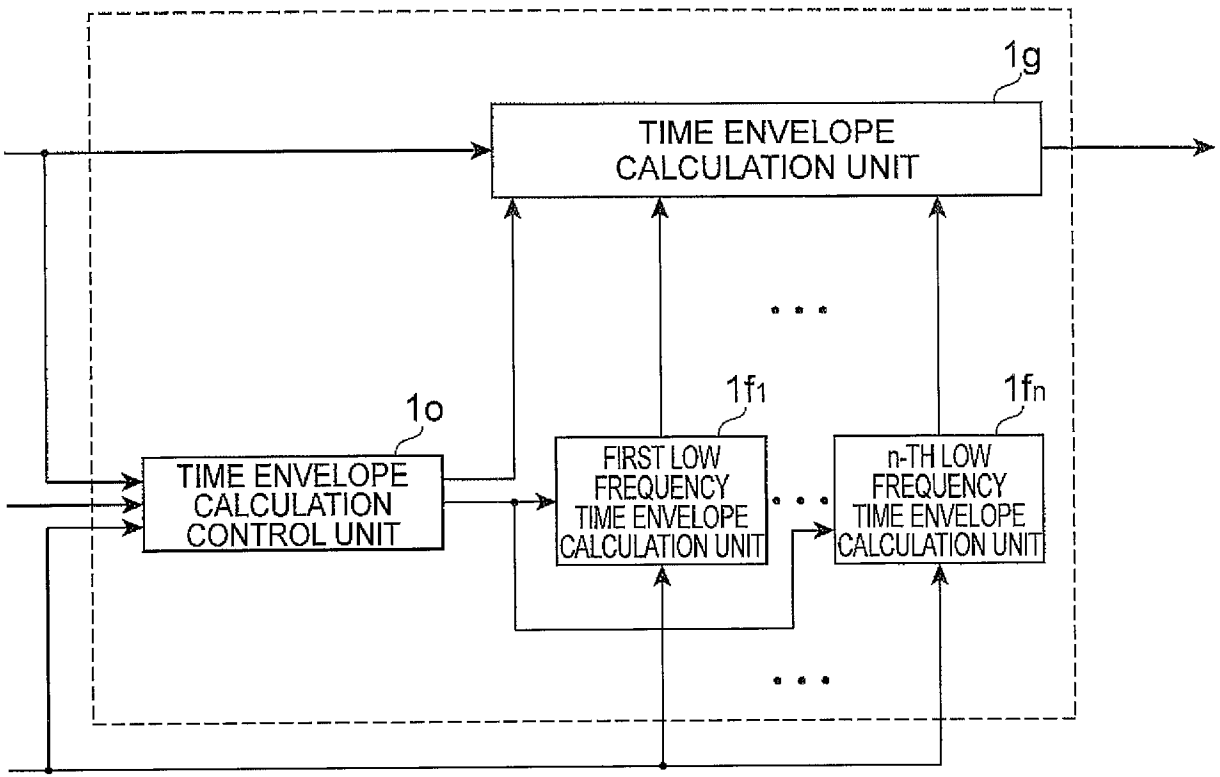
FIG. 13 is a flowchart showing a procedure of envelope calculation in a sixth alternative example of the speech decoder 1 according to the first embodiment.

FIG. 13 is a diagram showing a configuration of a principal part related to envelope calculation in a sixth alternative example of the speech decoder 1 according to the first embodiment. The speech decoder 1 shown in FIG. 13 includes a time envelope calculation control unit (time envelope calculation control means) 1*o* in addition to the low frequency band time envelope calculation units $\mathbf{1}f_1$ to $\mathbf{1}f_n$ and the time envelope calculation unit 1*g*. The time envelope calculation control unit 1*o* is configured to perform any one or more of the envelope calculation process in the first to fifth alternative examples of the speech decoder 1.

Seventh Alternative Example of Speech Decoder According to First Embodiment

Figure 14:
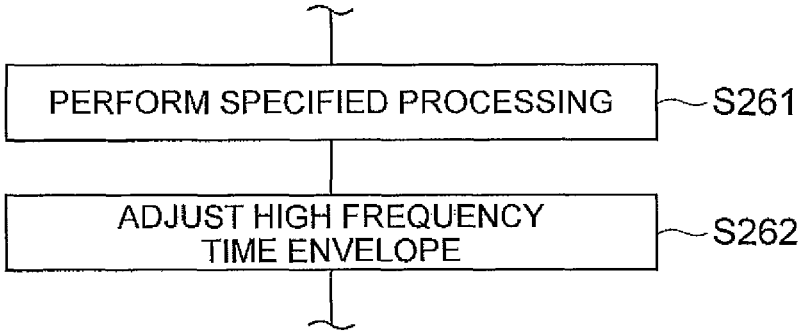
FIG. 14 is a flowchart showing a procedure of time envelope calculation performed by a time envelope calculation unit 1g in a seventh alternative example of the speech decoder 1 according to the first embodiment.

FIG. 14 is a flowchart showing a procedure of envelope calculation performed by a seventh alternative example of the speech decoder 1 according to the first embodiment. Note that the configuration of the seventh alternative example of the speech decoder 1 is the same as the speech decoder 1 according to the first embodiment. Steps S261 to S262 in FIG. 14 replace Step S08 in the flowchart of FIG. 2 showing the process of the speech decoder 1 according to the first embodiment.

In this alternative example, the time envelope calculation unit 1*g* performs specified processing (processing of Step S261) using the low frequency band time envelope $L_{dec}(k,i)$ $\{1 \le k \le n,\ t(s) \le i < t(s+1),\ 0 \le s < s_E\}$ supplied from the low frequency band time envelope calculation units $\mathbf{1}f_1$ to $\mathbf{1}f_n$ and the time envelope information supplied from the coded sequence decoding/dequantization unit 1*e* and then calculates the time envelope (processing of Step S262). Examples of the specified processing and the calculation of the time envelope related thereto are as follows.

In the first example, the coefficient $A_{l,k}(s)$ in Equation 18, 21, 23 or 24 is calculated using the time envelope information supplied in another form from the coded sequence decoding/dequantization unit 1*e*. For example, the coefficient is calculated by the following equation.

$$A_{lk}(s)=F_{lk}(\alpha_1(s), \alpha_2(s), \ldots, \alpha_{Num}(s))$$

$$1 \le l \le n_H,\ 1 \le k \le n$$

$$0 \le s < s_E \qquad \text{[Equation 40]}$$

where $\alpha_k(s)$, k=1, 2, . . . , Num, $0 \le s < s_E$ is the time envelope information supplied from the coded sequence decoding/dequantization unit 1*e*, and $F_{lk}(x_1, x_2, \ldots, x_{Num})$, $1 \le l \le n_H$, $1 \le k \le n$ is a specified function with Num number of variables as arguments. After that, using the coefficient $A_{l,k}(s)$ acquired in the above method, the time envelope is calculated by Equation 18, 21, 23 or 24.

In the second example, the quantity given by the following equation is calculated first.

$$g^{(0)}(l, i) = \sum_{k-1}^{n} (A_{l,k}^{(0)} \cdot L_{dec}(k, i)) + A_{l,0}^{(0)} + \sum_{k-1}^{g} (A_{l,-k}^{(0)} \cdot U(k, i)) \qquad \text{[Equation 41]}$$

$$1 \le l \le n_H,\ t(s) \le i < t(s+1),\ 0 \le s < s_E$$

Note that the following equation:

$$A^{(0)}{}_{l,k},\ 1 \le l \le n_H,\ -g \le k \le n \qquad \text{[Equation 42]}$$

is a specified coefficient.

Further, the above-described $g^{(0)}(l,i)$ may be a specified coefficient, or a specified function for the index 1, i. For example, $g^{(0)}(l,i)$ may be a function given by the following equation.

$$g^{(0)}(l,i)=\lambda^l \omega^{i-t(s)}$$

$$1 \le l \le n, t(s) \le i < t(s+1), 0 \le s < s_E \qquad \text{[Equation 43]}$$

Then, the quantity corresponding to the left-hand side of Equation 18, 21, 23 or 24 is calculated, and the result is represented as $g^{(1)}(l,i)$ $\{1 \le l \le n_H,\ t(s) \le i < t(s+1),\ 0 \le s < s_E\}$. Then, the time envelope is calculated by the following equation, for example.

$$g_{dec}(l,i)=g^{(1)}(l,i)+g^{(0)}(l,i)$$

$$1 \le l \le n_H,\ t(s) \le i < t(s+1),\ 0 \le s_E \quad \text{[Equation 44]}$$

Further, the time envelope may be calculated by the following equation.

$$g_{dec}(l,i)=g^{(0)}(l,i) \cdot g^{(1)}(l,i)$$

$$1 \le l \le n_H,\ t(s) \le i < t(s+1),\ 0 \le s < s_E \quad \text{[Equation 45]}$$

Further, the time envelope may be calculated by the following equation.

$$g_{dec}(l,i)=g^{(1)}(l,i)$$

$$1 \le l \le n_H,\ t(s) \le i < t(s+1),\ 0 \le s < s_E \quad \text{[Equation 46]}$$

When the time envelope information is not supplied from the coded sequence decoding/dequantization unit 1*e*, the time envelope may be calculated by the following equation.

$$g_{dec}(l,i)=g^{(0)}(l,i)$$

$$1 \le l \le n_H,\ t(s) \le i < t(s+1),\ 0 \le s < s_E \quad \text{[Equation 47]}$$

In this alternative example, the form of the above-described $g_{dec}(l,i)$ is not limited to the above example.

Note that, in the present invention, the specified processing and the calculation of the time envelope related thereto are not limited to the above examples.

This alternative example may be applied to the first to sixth alternative examples of the speech decoder 1 according to the first embodiment as follows.

In the case of application to the first alternative example of the speech decoder 1 according to the first embodiment, Step S34 in FIG. 6 is replaced with Steps S261 to S262 in FIG. 14, for example. A plurality of kinds of the above-described specified processing may be prepared in advance and changed depending on the power of the low frequency band signal. Further, any one of a) calculating the time envelope by performing the above-described specified processing only, b) calculating the time envelope by performing the above-described specified processing and further using the time envelope information and c) calculating the time envelope using the time envelope information without performing the above-described specified processing may be selected depending on the power of the low frequency band signal.

Figure 15:
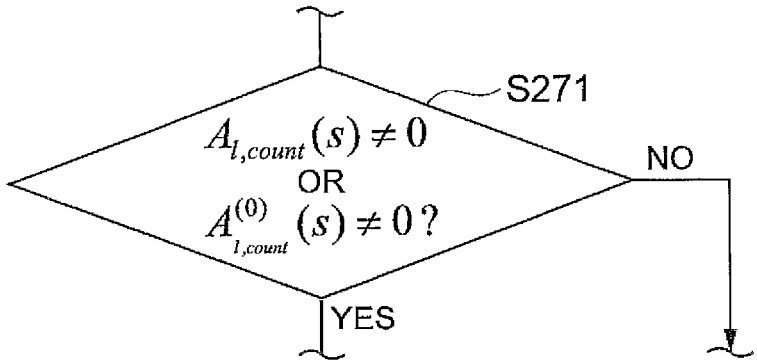
FIG. 15 is a flowchart showing a part of processing by a time envelope calculation control unit 1*m* when the seventh alternative example of the speech decoder 1 according to the first embodiment is applied to the second alternative example of the speech decoder 1 according to the first embodiment.

FIG. 15 is a flowchart showing a part of processing performed by the time envelope calculation control unit 1*m* when the seventh alternative example of the speech decoder 1 according to the first embodiment is applied to the second alternative example of the speech decoder 1 according to the first embodiment.

In the case of application to the second alternative example of the speech decoder 1 according to the first embodiment, Step S42 in FIG. 8 is replaced with Step 271 in FIG. 15, and Step S47 in FIG. 8 is replaced with Steps S261 to S262 in FIG. 14, for example. A plurality of kinds of the above-described specified processing may be prepared in advance and changed depending on the time envelope information. Further, any one process may be selected, depending on the time envelope information, from a) calculating the time envelope by performing the above-described specified processing only, b) calculating the time envelope by performing the above-described specified processing and further using the time envelope information and c) calculating the time envelope using the time envelope information without performing the above-described specified processing.

In the case of application to the third alternative example of the speech decoder 1 according to the first embodiment, Step S53 in FIG. 10 is replaced with Steps S261 to S262 in FIG. 14. A plurality of kinds of the above-described specified processing may be prepared in advance and changed depending on the time envelope calculation control information. Further, any one may be selected, depending on the time envelope calculation control information, from a) calculating the time envelope by performing the above-described specified processing only, b) calculating the time envelope by performing the above-described specified processing and further using the time envelope information and c) calculating the time envelope using the time envelope information without performing the above-described specified processing.

Figure 16:
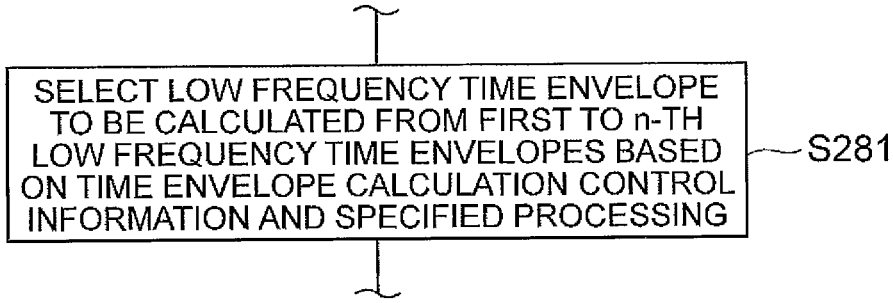
FIG. 16 is a flowchart showing a part of processing by a time envelope calculation control unit 1*n* when the seventh alternative example of the speech decoder 1 according to the first embodiment is applied to the fourth alternative example of the speech decoder 1 according to the first embodiment.

FIG. 16 is a flowchart showing a part of processing performed by the time envelope calculation control unit 1*n* when the seventh alternative example of the speech decoder 1 according to the first embodiment is applied to the fourth alternative example of the speech decoder 1 according to the first embodiment.

In the case of application to the fourth alternative example of the speech decoder 1 according to the first embodiment, Step S61 in FIG. 11 is replaced with Step 281 in FIG. 16, and Step S63 in FIG. 11 is replaced with Steps S261 to S262 in FIG. 14. In Step 281 in FIG. 16, as method of selecting the time envelope of low frequency band components to be calculated from the first to n-th low frequency band time envelopes, it may be examined whether $A^{(0)}_{l,k}$ in one example of the above-described specified processing is zero or not and, the low frequency band signal time envelope calculation unit $\mathbf{1}f_k$ may calculate $L_{dec}(k,i)$ when $A^{(0)}_{l,k}$ is not zero and it is directed to calculate $L_{dec}(k,i)$ in the low frequency band signal time envelope calculation unit $\mathbf{1}f_k$ in the time envelope calculation control information.

In the case of application to the fifth alternative example of the speech decoder 1 according to the first embodiment, Step S74 in FIG. 12 is replaced with Steps S261 to S262 in FIG. 14. When the method of calculating the time envelope of low frequency band components is changed, the above-described processing method may be changed accordingly.

Further, application to the sixth alternative example of the speech decoder 1 according to the first embodiment is made in accordance with the way of application to the first to fifth alternative examples described above.

Note that, although the flow that calculates the time envelope after performing the specified processing is shown in FIG. 14, the specified processing may be performed after calculating the time envelope. For example, specified processing such as smoothing may be performed on the calculated time envelope. Further, the time envelope may be calculated after performing the specified processing, and further another specified processing may be performed on that time envelope.

First Alternative Example of Speech Encoder According to First Embodiment

Figure 17:
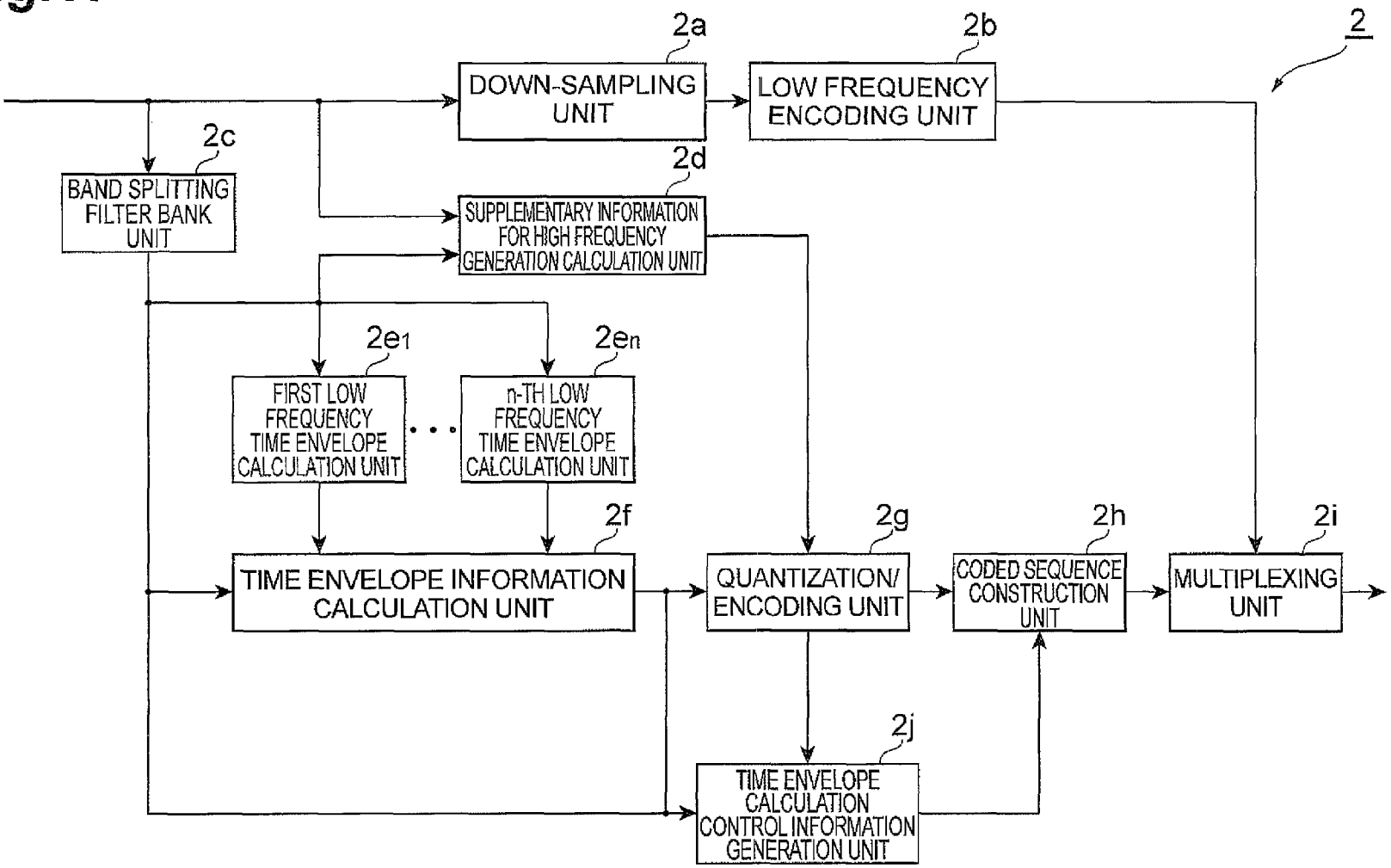
FIG. 17 is a diagram showing a configuration of a first alternative example of the speech encoder 2 according to the first embodiment.
Figure 18:
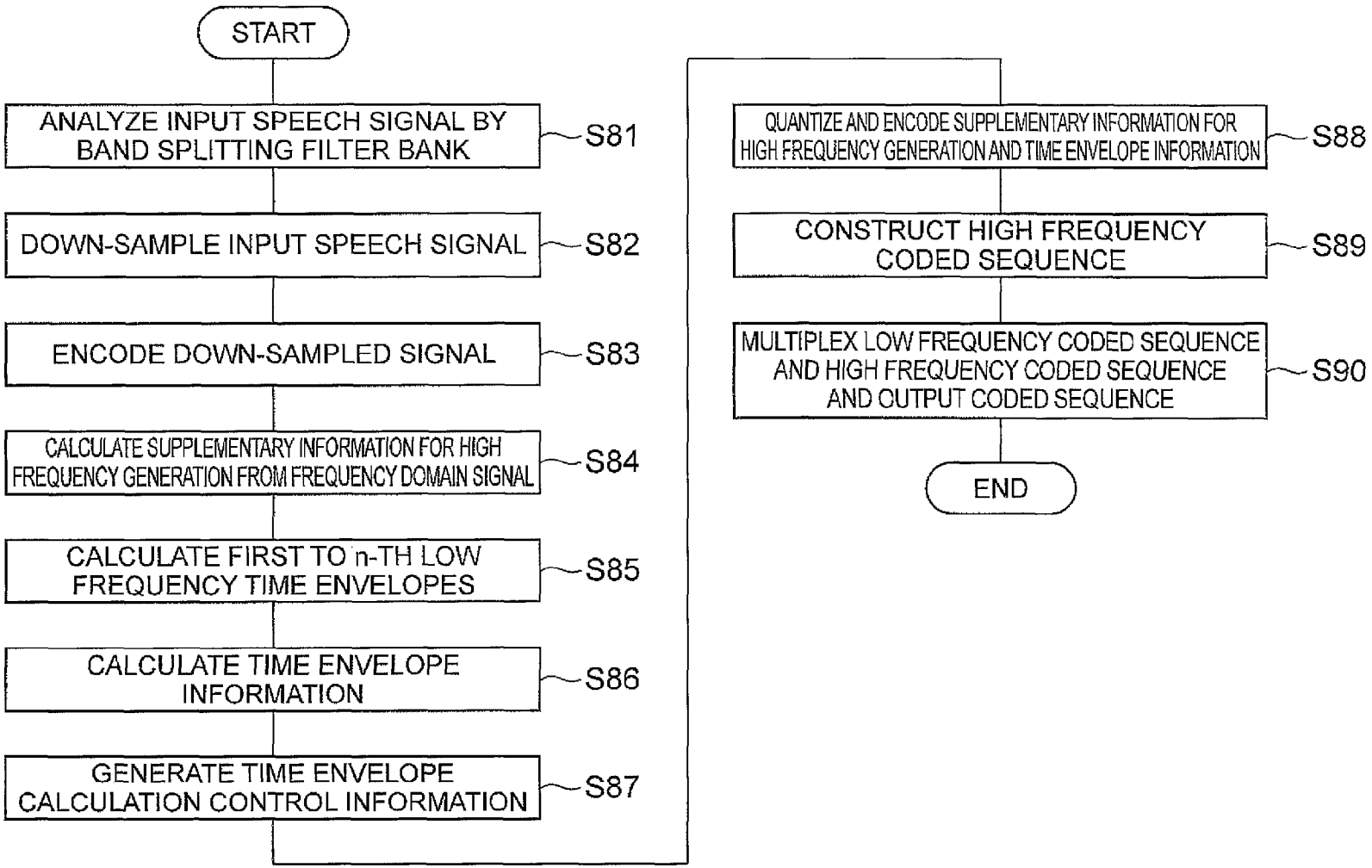
FIG. 18 is a flowchart showing a procedure of speech encoding performed by the speech encoder 2 shown in FIG. 17.

FIG. 17 is a diagram showing a configuration of a first alternative example of the speech encoder 2 according to the first embodiment, and FIG. 18 is a flowchart showing a procedure of speech encoding by the speech encoder 2 shown in FIG. 17.

In the speech encoder 2 shown in FIG. 17, a time envelope calculation control information generation unit (control information generation means) 2*j* is added to the speech encoder 2 according to the first embodiment.

The time envelope calculation control information generation unit 2*j* generates time envelope calculation control information using at least one of the signal X(j,i) in the frequency band domain received from the band splitting filter bank unit 2*c* and the time envelope information received from the time envelope information calculation unit 2*f*. The generated time envelope calculation control information may be any of the time envelope calculation control information in the third to seventh alternative examples of the speech decoder 1 according to the first embodiment.

The time envelope calculation control information generation unit 2*j* may calculate the signal power in the frequency band corresponding to the low frequency band signal of the signal X(j,i) in the frequency domain received from the band splitting filter bank unit 2*c*, for example, and generate the time envelope calculation control information indicating whether or not to perform the time envelope calculation in the speech decoder 1 according to the calculated signal power.

Alternatively, the time envelope calculation control information generation unit 2*j* may calculate the signal power in the frequency band corresponding to the high frequency band signal of the signal X(j,i) in the frequency domain and generate the time envelope calculation control information indicating whether or not to perform the time envelope calculation in the speech decoder 1 according to the calculated signal power.

Further, the time envelope calculation control information generation unit 2*j* may calculate the signal power in the frequency band corresponding to the entire frequency band signal (i.e. the frequency band corresponding to the low frequency band signal and the frequency band corresponding to the high frequency band signal) of the signal X(j,i) in the frequency domain and generate the time envelope calculation control information indicating whether or not to perform the time envelope calculation in the decoder according to the calculated signal power.

The time envelope calculation control information generation unit 2*j* may calculate the power of a part corresponding to the first to n-th low frequency band time envelopes calculated by the first to n-th low frequency band time envelope calculation units $\mathbf{2}e_1$ to $\mathbf{2}e_n$, and generate the time envelope calculation control information related to selection of the low frequency band time envelope to be used for the time envelope calculation in the speech decoder 1 according to the calculated signal power.

The time envelope calculation control information generation unit 2*j* may calculate the signal power in the frequency band corresponding to the low frequency band signal of the signal X(j,i) in the frequency domain and generate the time envelope calculation control information related to the low frequency band time envelope calculation method in the speech decoder 1 according to the calculated signal power.

In this alternative example, the frequency band of the signal power to be calculated is not particularly limited, and the time envelope calculation control information that is generated according to the calculated signal power may be any one or more of the time envelope calculation control information in the third to seventh alternative examples of the speech decoder 1 according to the first embodiment described above.

Further, the time envelope calculation control information generation unit 2*j* may detect or measure the signal characteristics of the signal X(j,i) in the frequency domain, and generate the time envelope calculation control information indicating whether or not to perform the time envelope calculation in the speech decoder 1 according to the calculated signal characteristics.

Alternatively, the time envelope calculation control information generation unit 2*j* may generate the time envelope calculation control information related to selection of the low frequency band time envelope to be used for the time envelope calculation in the speech decoder 1 according to the signal characteristics of the signal X(j,i) in the frequency domain.

The time envelope calculation control information generation unit 2*j* may generate the time envelope calculation control information related to the low frequency band time envelope calculation method in the speech decoder 1 according to the signal characteristics of the signal X(j,i) in the frequency domain.

Note that the signal characteristics detected or measured in the time envelope calculation control information generation unit 2*j* may be the characteristics related to the steepness of the rising edge or the falling edge of the signal. The signal characteristics may be the characteristics related to the stationarity of the signal. The signal characteristics may be the characteristics related to the strength of the tonality of the signal. Further, the signal characteristics may be at least one of the above characteristics.

In this alternative example, the signal characteristics to be detected or measured are not particularly limited, and the time envelope calculation control information that is generated according to the detected or measured signal characteristics may be any one or more of the time envelope calculation control information in the third to sixth alternative examples of the speech decoder 1 according to the first embodiment described above.

Furthermore, the time envelope calculation control information generation unit 2*j* may generate the time envelope calculation control information indicating whether or not to perform the time envelope calculation in the speech decoder 1 according to the value of the time envelope information $A_{l,k}(s)$ ($1 \le l \le n_H$, $1 \le k \le n$, $0 \le s < s_E$) received from the time envelope information calculation unit 2*f*, for example. The time envelope calculation control information generation unit 2*j* may generate the time envelope calculation control information related to selection of the low frequency band time envelope to be used for the time envelope calculation in the speech decoder 1. The time envelope calculation control information generation unit 2*j* may generate the time envelope calculation control information related to the low frequency band time envelope calculation method in the speech decoder 1.

In this alternative example, the time envelope calculation control information that is generated according to the time envelope information may be any one or more of the time envelope calculation control information in the third to sixth alternative examples of the speech decoder 1 according to the first embodiment described above.

Alternatively, the time envelope calculation control information generation unit 2*j* may generate, using the signal X(j,i) in the frequency domain received from the band splitting filter bank unit 2*c* and the coded sequence of the supplementary information for high frequency band generation received from the quantization/encoding unit 2*g*, for example, the time envelope calculation control information indicating whether or not to perform the time envelope calculation in the speech decoder 1. The time envelope calculation control information generation unit 2*j* may generate the time envelope calculation control information related to selection of the low frequency band time envelope to be used for the time envelope calculation in the speech decoder 1. The time envelope calculation control information generation unit 2*j* may generate the time envelope calculation control information related to the low frequency band time envelope calculation method in the speech decoder 1.

To be specific, the time envelope calculation control information generation unit 2*j* may decode and inversely quantize the coded sequence of the supplementary information for high frequency band generation received from the quantization/encoding unit 2*g* and thereby obtains locally decoded supplementary information for high frequency band generation, and then generates a pseudo locally decoded high frequency band signal using the locally decoded supplementary information for high frequency band generation and the signal X(j,i) in the frequency domain. The pseudo locally decoded high frequency band signal can be generated by performing the same processing as the high frequency band generation unit 1*h* of the speech decoder 1 according to the first embodiment. The time envelope calculation control information generation unit 2*j* compares the generated pseudo locally decoded high frequency band signal with the frequency band corresponding to the high frequency band signal of the signal X(j,i) in the frequency domain and generates the time envelope calculation control information based on the comparison result.

The comparison between the pseudo locally decoded high frequency band signal and the frequency band corresponding to the high frequency band signal of the signal X(j,i) in the frequency domain may be made by calculating a differential signal of the two signals and based on the power of the differential signal. Further, it may be made by calculating the time envelopes of the pseudo locally decoded high frequency band signal and the frequency band corresponding to the high frequency band signal of the signal X(j,i) in the frequency domain and based on at least one of a difference of the time envelopes and an amplitude of the difference.

Alternatively, the time envelope calculation control information generation unit 2*j* may generate, using, for example, the signal X(j,i) in the frequency domain received from the band splitting filter bank unit 2*c*, the time envelope information received from the time envelope information calculation unit 2*f*, and the coded sequence of the supplementary information for high frequency band generation received from the quantization/encoding unit 2*g*, the time envelope calculation control information indicating whether or not to perform the time envelope calculation in the speech decoder 1. The time envelope calculation control information generation unit 2*j* may generate the time envelope calculation control information related to selection of the low frequency band time envelope to be used for the time envelope calculation in the speech decoder 1. The time envelope calculation control information generation unit 2*j* may generate the time envelope calculation control information related to the low frequency band time envelope calculation method in the speech decoder 1.

To be specific, the time envelope calculation control information generation unit 2*j* may generate a pseudo locally decoded high frequency band signal and adjust the time envelope of the pseudo locally decoded high frequency band signal by using the time envelope information received from the time envelope information calculation unit 2*f*, and then compare the pseudo locally decoded high frequency band signal with the adjusted time envelope with the frequency band corresponding to the high frequency band signal of the signal X(j,i) in the frequency domain and generate the time envelope calculation control information based on the comparison result.

The comparison between the pseudo locally decoded high frequency band signal with the adjusted time envelope and the frequency band corresponding to the high frequency band signal of the signal X(j,i) in the frequency domain may be performed in the same manner as the comparison is performed between the pseudo locally decoded high frequency band signal and the frequency band corresponding to the high frequency band signal of the signal X(j,i) in the frequency domain.

Further, in the time envelope information calculation unit 2*f* of the speech encoder 2 according to the first embodiment, the time envelope information may be calculated using the pseudo locally decoded high frequency band signal. To be specific, the coded sequence of the supplementary information for high frequency band generation received from the quantization/encoding unit 2*g* is further input to the time envelope information calculation unit 2*f*, and the coded sequence of the supplementary information for high frequency band generation is decoded and inversely quantized to acquire locally decoded supplementary information for high frequency band generation, and the pseudo locally decoded high frequency band signal is generated using the locally decoded supplementary information for high frequency band generation and the signal X(j,i) in the frequency domain.

For example, the time envelope information calculation unit 2*f* may output, as the calculated time envelope information, the time envelope information that allows approximation to the frequency band corresponding to the high frequency band signal of the signal X(j,i) in the frequency domain when the time envelope of the pseudo locally decoded high frequency band signal is adjusted using the time envelope calculated from the time envelope information. The determination as to whether it is close to the frequency band corresponding to the high frequency band signal of the signal X(j,i) in the frequency domain may be made based on a differential signal between the pseudo locally decoded high frequency band signal with the adjusted time envelope and the frequency band corresponding to the high frequency band signal of the signal X(j,i) in the frequency domain, or may be based on an error between the time envelopes of those signals.

Alternatively, the time envelope calculation control information generation unit 2*j* may generate the time envelope calculation control information indicating whether or not to perform the time envelope calculation in the speech decoder 1 according to the amount of information (to be more specific, the number of bits) needed for encoding of the time envelope information received from the quantization/encoding unit 2*g*, for example. The time envelope calculation control information generation unit 2*j* may generate the time envelope calculation control information related to selection of the low frequency band time envelope to be used for the time envelope calculation in the speech decoder 1. The time envelope calculation control information generation unit 2*j* may generate the time envelope calculation control information related to the low frequency band time envelope calculation method in the speech decoder 1.

To be specific, the time envelope calculation control information generation unit 2*j* generates the time envelope calculation control information indicating to perform the time envelope calculation in the speech decoder 1 when the amount of information (to be more specific, the number of bits) needed for encoding of the time envelope information received from the quantization/encoding unit 2*g* is equal to or smaller than a specified threshold, for example. On the other hand, when the amount of information needed for encoding of the time envelope information is larger than a specified threshold, the time envelope calculation control information generation unit 2*j* generates the time envelope calculation control information indicating not to perform the time envelope calculation in the speech decoder 1.

Further, the time envelope calculation control information generation unit 2*j* may generate the time envelope calculation control information related to selection of the low frequency band time envelope to be used for the time envelope calculation in the speech decoder 1 so that the amount of information needed for encoding of the time envelope information is equal to or smaller than a specified threshold. At this time, the time envelope calculation control information generation unit 2*j* may notify the result of comparing the amount of information needed for encoding of the time envelope information with the threshold to the time envelope information calculation unit 2*f*, and the time envelope information calculation unit 2*f* may re-calculate the time envelope information according to the notified comparison result. Note that, in the case where the time envelope information is re-calculated, the quantization/encoding unit 2*g* encodes and quantizes the re-calculated time envelope information. The number of times of re-calculating the time envelope information is not particularly limited.

In this alternative example, the time envelope calculation control information is calculated based on the amount of information needed for encoding of the time envelope information, and the time envelope calculation control information to be generated may be any one or more of the time envelope calculation control information in the third to sixth alternative examples of the speech decoder 1 according to the first embodiment described above.

The time envelope calculation control information generated by the time envelope calculation control information generation unit 2*j* in the above manner is further added to the high frequency band coded sequence by the high frequency band coded sequence construction unit 2*h* and thereby the high frequency band coded sequence is constructed.

Second Alternative Example of Speech Encoder According to First Embodiment

Figure 19:
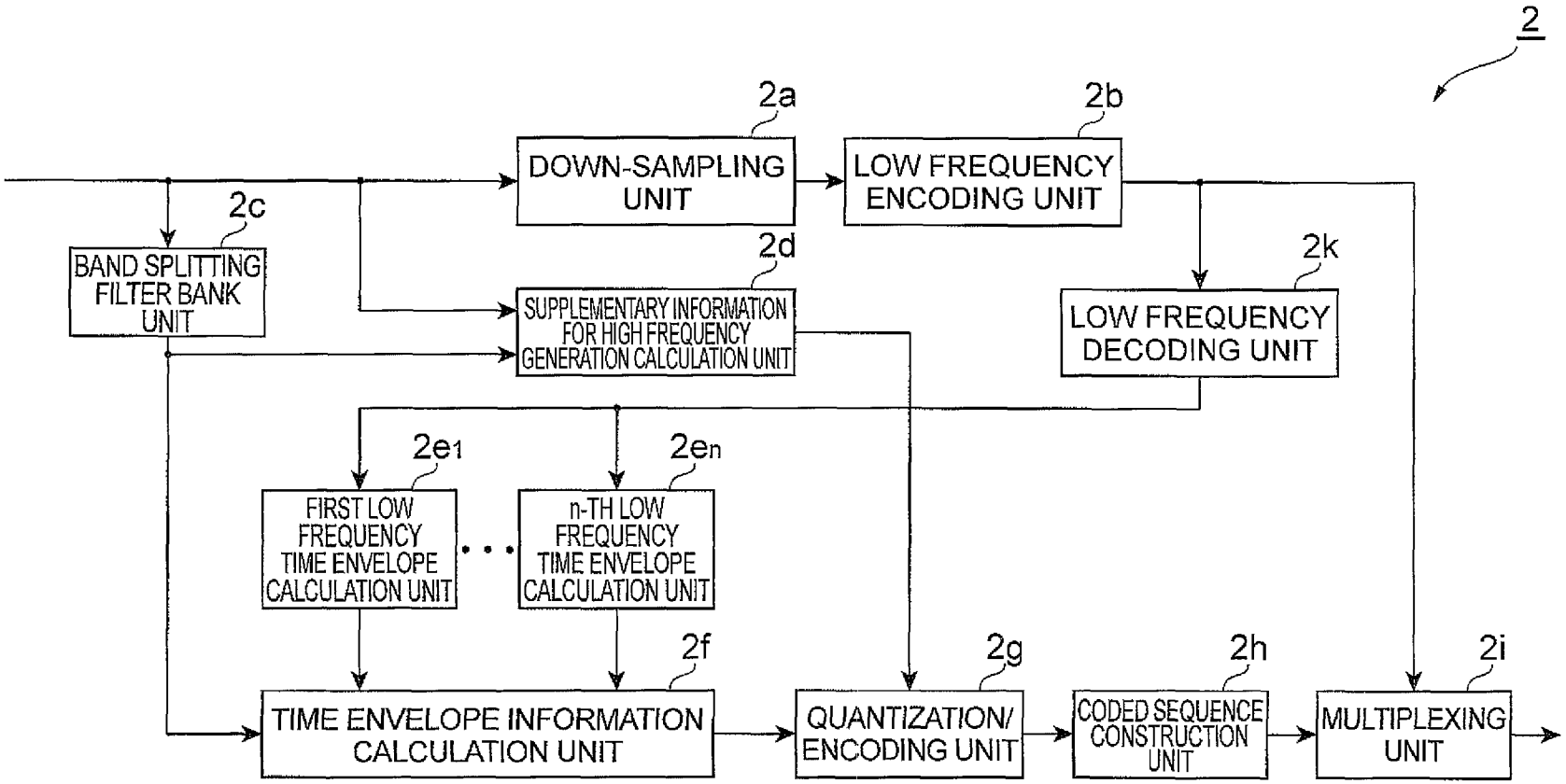
FIG. 19 is a diagram showing a configuration of a second alternative example of the speech encoder 2 according to the first embodiment.
Figure 20:
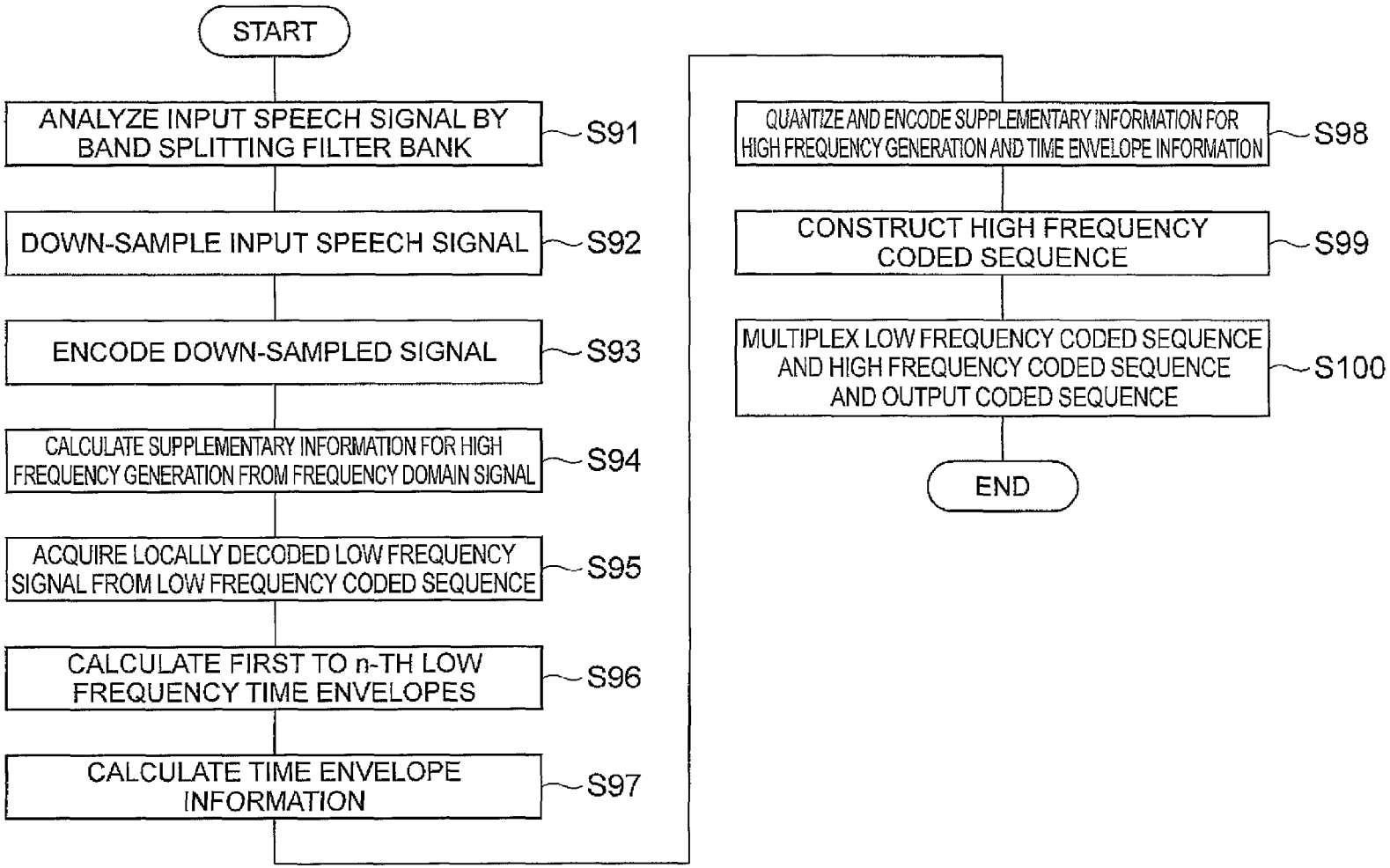
FIG. 20 is a flowchart showing a procedure of speech encoding performed by the speech encoder 2 shown in FIG. 19.

FIG. 19 is a diagram showing a configuration of a second alternative example of the speech encoder 2 according to the first embodiment, and FIG. 20 is a flowchart showing a procedure of speech encoding by the speech encoder 2 shown in FIG. 19.

In the speech encoder 2 shown in FIG. 19, a low frequency band decoding unit 2*k* is added to the speech encoder 2 according to the first embodiment.

The low frequency band decoding unit 2*k* receives the low frequency band coded sequence from the low frequency band encoding unit 2*b*, decodes and inversely quantizes the low frequency band coded sequence and thereby acquires a locally decoded low frequency band signal. Note that, when the quantized low frequency band signal can be acquired from the low frequency band encoding unit 2*b*, the low frequency band decoding unit 2*k* may inversely quantize the quantized low frequency band signal and acquire the locally decoded low frequency band signal. Then, the low frequency band time envelope calculation units $2e_l$ to $2e_n$ calculate the first to n-th low frequency band time envelopes by using the locally decoded low frequency band signal acquired by the low frequency band decoding unit 2*k*.

Note that the second alternative example of the speech encoder 2 according to the first embodiment may be applied also to the first alternative example of the speech encoder 2 according to the first embodiment.

Third Alternative Example of Speech Encoder According to First Embodiment

Figure 21:
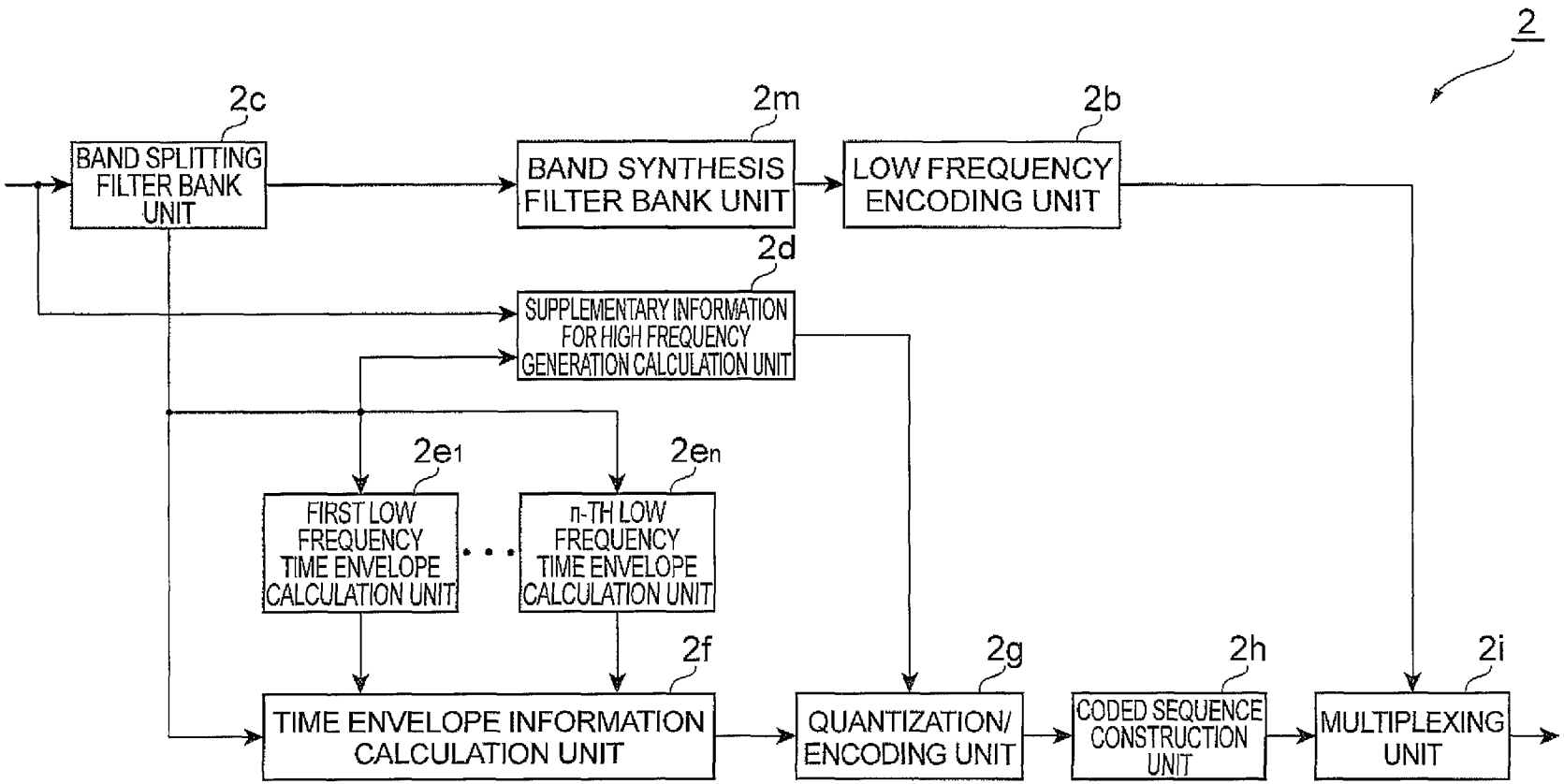
FIG. 21 is a diagram showing a configuration of a third alternative example of the speech encoder 2 according to the first embodiment.
Figure 22:
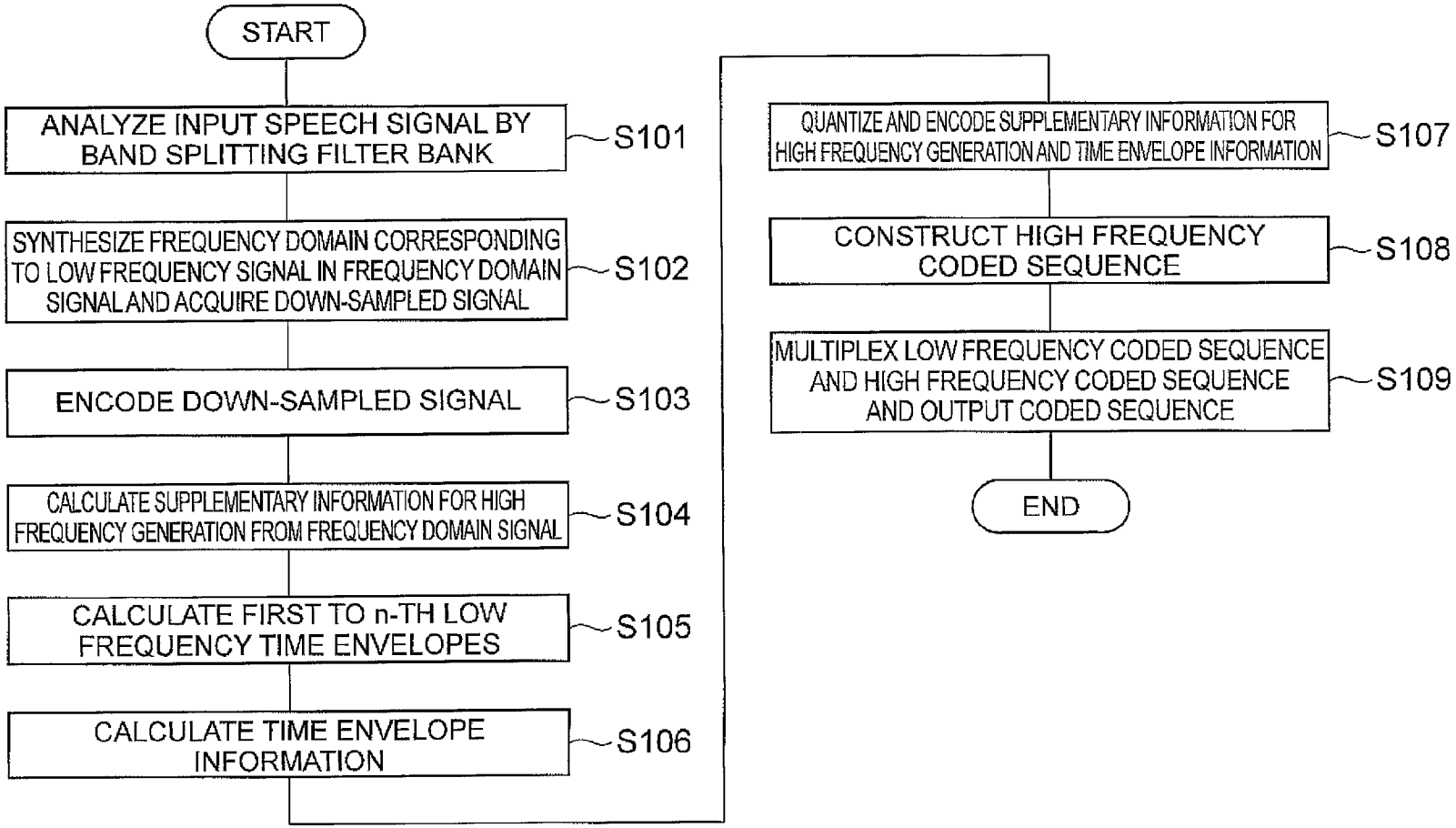
FIG. 22 is a flowchart showing a procedure of speech encoding performed by the speech encoder 2 shown in FIG. 21.

FIG. 21 is a diagram showing a configuration of a third alternative example of the speech encoder 2 according to the first embodiment, and FIG. 22 is a flowchart showing a procedure of speech encoding by the speech encoder 2 shown in FIG. 21.

The speech encoder 2 shown in FIG. 21 is different from the speech encoder 2 according to the first embodiment in that it includes a band synthesis filter bank unit 2*m* in place of the down-sampling unit 2*a*.

The band synthesis filter bank unit 2*m* receives the signal X(j,i) in the frequency domain from the band splitting filter bank unit 2*c*, performs band synthesis for the frequency band corresponding to the low frequency band signal and thereby acquires a down-sampled signal. The acquisition of the down-sampled signal by band synthesis may be performed according to the method of downsampled synthesis filterbank in SBR of "MPEG4 AAC" specified in "ISO/IEC 14496-3", for example ("ISO/IEC 14496-3 subpart 4 General Audio Coding").

Note that the third alternative example of the speech encoder 2 according to the first embodiment may be applied also to the first and second alternative examples of the speech encoder 2 according to the first embodiment.

In a fourth alternative example of the speech encoder 2 according to the first embodiment, the specified processing corresponding to the seventh alternative example of the speech decoder 1 according to the first embodiment described above is performed when calculating g(l,i) in the time envelope information calculation unit 2*f* of the speech encoder 2 according to the first embodiment. Note that, as described in the seventh alternative example of the speech decoder 1 according to the first embodiment, g(l,i) may be calculated using the low frequency band time envelope after performing the specified processing, or g(l,i) may be calculated by performing the specified processing after calculating g(l,i) using the low frequency band time envelope.

Note that the fourth alternative example of the speech encoder 2 according to the first embodiment may be applied also to the first to third alternative examples of the speech encoder 2 according to the first embodiment.

In the case of applying the fourth alternative example of the speech encoder 2 according to the first embodiment to the first alternative example of the speech encoder 2 according to the first embodiment, information as to whether or not to perform the above-described specified processing in the speech decoder 1 according to the first embodiment may be contained in the time envelope calculation control information based on an error of g(l,i) with respect to H(l,i) described above.

Second Embodiment

A second embodiment of the present invention is described hereinbelow.

Figure 23:
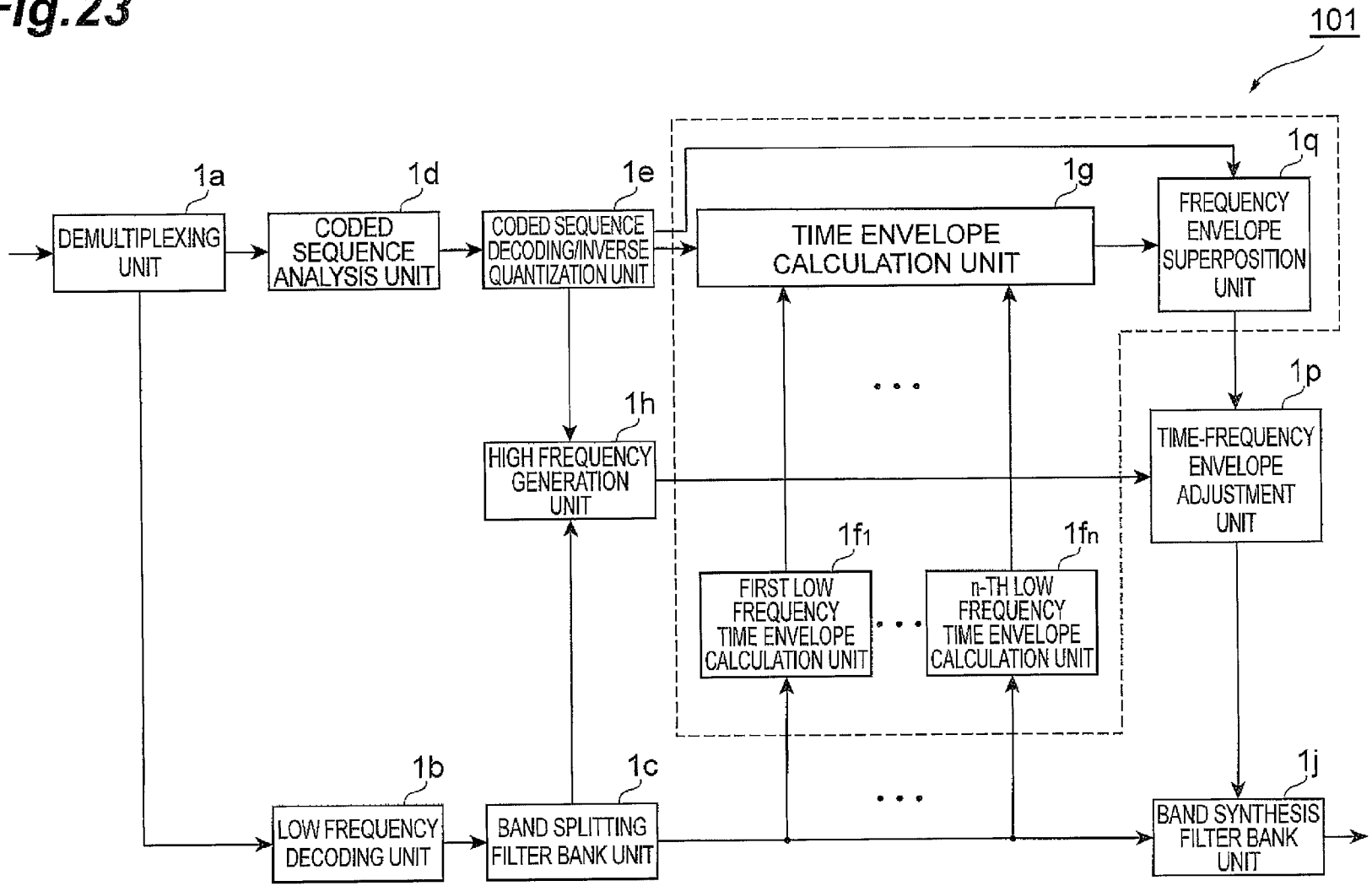
FIG. 23 is a diagram showing a configuration of a speech decoder 101 according to a second embodiment.
Figure 24:
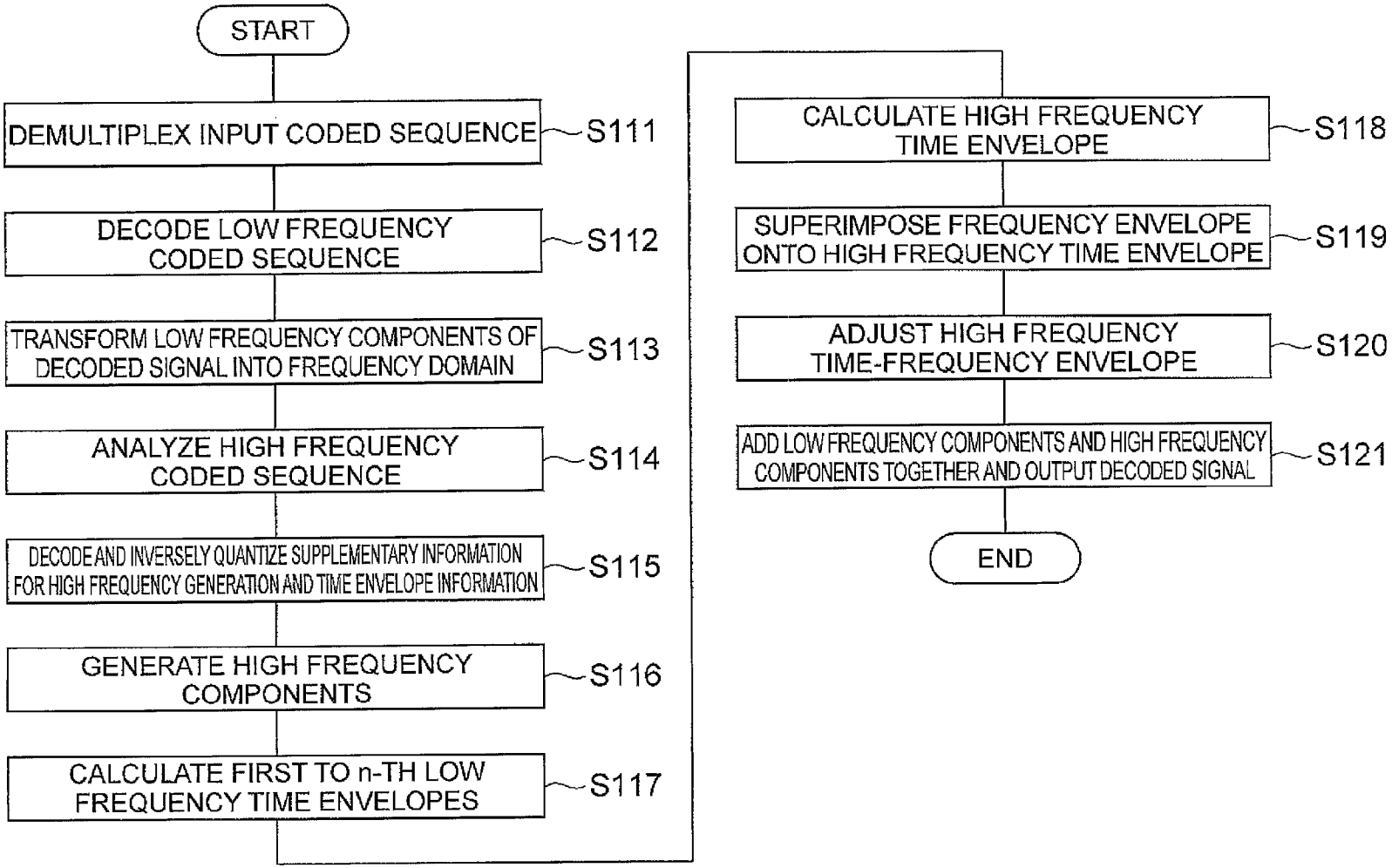
FIG. 24 is a flowchart showing a procedure of speech decoding performed by the speech decoder 101 shown in FIG. 23.

FIG. 23 is a diagram showing a configuration of the speech decoder 101 according to the second embodiment, and FIG. 24 is a flowchart showing a procedure of speech decoding by the speech decoder 101 shown in FIG. 23. The speech decoder 101 of FIG. 23 is different from the speech decoder 1 according to the first embodiment in that it further includes a frequency envelope superposition unit (frequency envelope superposition means) 1*q* and that it includes a time-frequency envelope adjustment unit (time-frequency envelope adjustment means) 1*p* in place of the time envelope adjustment unit 1*i* (1*c* to 1*e*, 1*h*, 1*j* and 1*p* are sometimes referred to also as a bandwidth extension unit (bandwidth extension means)).

The coded sequence analysis unit 1*d* analyzes the high frequency band coded sequence supplied from the demultiplexing unit 1*a* and thereby acquires coded supplementary information for high frequency band generation and quantized time-frequency envelope information.

The coded sequence decoding/dequantization unit 1*e* decodes the coded supplementary information for high frequency band generation supplied from the coded sequence analysis unit 1*d* and thereby obtains supplementary information for high frequency band generation, and dequantize the quantized time-frequency envelope information supplied from the coded sequence analysis unit 1*d* and thereby acquires time-frequency envelope information.

The frequency envelope superposition unit 1*q* receives a time envelope $E_T(l,i)$ from the time envelope calculation unit 1*g* and frequency envelope information from the coded sequence decoding/dequantization unit 1*e*. Then, the frequency envelope superposition unit 1*q* calculates a frequency envelope from the frequency envelope information and superimposes the frequency envelope onto the time envelope. Specifically, the frequency envelope superposition unit 1*q* performs this processing in the following procedure, for example.

First, the frequency envelope superposition unit 1*q* transforms the time envelope by the following equation.

$$E_0(m, i) = E_T(l, i) \quad \text{[Equation 48]}$$

$$k_l - k_x \le m \le k_h - k_x, \begin{cases} k_l = F_H(l) \\ k_h = F_H(l+1) - 1' \end{cases}$$

$$1 \le l \le n_H,\ t(s) \le i < t(s+1),\ 0 \le s < s_E$$

Next, the frequency envelope superposition unit 1*q* divides the high frequency band into $m_H(m_H \ge 1)$ number of sub-bands. The sub-bands are represented as $B^{(F)}{}_k$ (k=1, 2, 3, . . . , $m_H$). Further, for simplification of the description, an array $G_H$ having $m_H+1$ number of indexes representing the boundary of the sub-band $B^{(F)}{}_k$ ($1 \le k \le m_H$) as factors is defined so that the signal $X_H(j,i)$, $G_H(k) \le j < G_H(k+1)$, $t(s) \le i < t(s+1)$, $0 \le s < s_E$ corresponds to the component of the sub-band $B^{(F)}{}_k$. Note that $G_H(1)=k_x$, $G_H(m_H+1)=k_{max}+1$.

Then, the frequency envelope superposition unit 1*q* calculates the frequency envelope by the following equation.

$$E_{F,dec}(k,s)=10^{0.1\times sf_{dec}(k,s)},\ 1 \le k \le m_H,$$

$$0 \le s < s_E \quad \text{[Equation 49]}$$

where $sf_{dec}(k,s)$ (where $1 \le k \le m_H$, $0 \le s < s_E$) is a scale factor corresponding to the sub-band $B^{(F)}{}_k$.

Note that the frequency envelope may be calculated by the following equation.

$$E_{F,dec}(k,s)=64\times 2^{sf_{dec}(k,s)},$$

$$0 \le s < s_E \quad \text{[Equation 50]}$$

In this embodiment, the form of $E_{F,dec}(k,s)$ is not limited to the above example.

The frequency envelope superposition unit 1*q* calculates $sf_{dec}(k,s)$ as follows. First, the values of $sf_{dec}(k,s)$ corresponding to several sub-bands are set as constant numbers that are not dependent on time as represented by the following equation (hereinafter, a set of indexes k corresponding to those sub-bands is denoted as $N_C$).

$$sf_{dec}(k,s)=C,\ \forall k \in N_c,\ 0 \le s < s_E \quad \text{[Equation 50]}$$

Although the value of C may be C=0, the value of C is not specified in this embodiment. Then, when the integer 1 is not included in the set $N_c$, the frequency envelope superposition unit 1*q* acquires the scale factor $sf_{dec}(1,s)$, $0 \le s < s$ from the frequency envelope information.

After that, the frequency envelope superposition unit 1*q* repeats the processing of the following (Step k) from k=2 to $k=m_H$ and calculates the above-described scale factor.

(Step k)

When the integer k is not included in the set $N_c$, a difference in scale factor $dsf_{dec}(k,s)$, $0 \le s < s$ is acquired from the frequency envelope information, the scale factor is calculated by the following equation:

$$sf_{dec}(k,s)=sf_{dec}(k-1,s)+dsf_{dec}(k,s)$$

$$0 \le s < s_E \quad \text{[Equation 52]},$$

and 1 is added to the integer k and then the process proceeds to the next (Step k). On the other hand, when the integer k is included in the set $N_c$, 1 is added to the integer k as it is and then the process proceeds to the next (Step k).

Further, in the case of receiving a difference in scale factor $sf_{dec}(1,s)$, $0 \le s < s_E$ from the frequency envelope information, the processing in the above Step k may be performed by calculating $sf_{dec}(0,s)$, $0 \le s < s_E$ using the low frequency band component of the signal in the frequency domain received from the band splitting filter bank unit 1*c*. For example, in the equations 63, 64 and 65 described later, X(j,i) may be replaced with $X_{dec}(j,i)$, and sf(0,s) calculated using a specified $k_l$ and $k_h$ satisfying $0 \le k_l \le k_h < k_x$ where k=0 may be set as $sf_{dec}(0,s)$.

In this example, differently from the above-described example, the frequency envelope information may correspond to the scale factor $sf_{dec}(k,s)$ itself. Further, the frequency envelope information may be a difference dtsf(s,k), $1 \le s < s_E$, $1 \le k \le m_H$ in the time direction when calculating the scale factor $sf_{dec}(k,s)$, $1 \le k \le m_H$ in the s-th ($s \ge 1$) frame by the following equation using the scale factor $sf_{dec}(k,s-1)$ in the (s−1)th frame.

$$sf_{dec}(k,s)=sf_{dec}(k,s-1)+dtsf(s,k),$$

$$1 \le k \le m_H,\ 1 \le s < s_E \quad \text{[Equation 53]}$$

In this case, however, $sf_{dec}(k,0)$, $1 \le k \le m_H$ corresponding to the initial value is acquired using another way such as the above-described method.

Further, the scale factor of the sub-band may be calculated using interpolation or extrapolation from at least one of the scale factor of the low frequency band component and the scale factor of the sub-band of the high frequency band. In this case, the frequency envelope information is the scale factor of the sub-band to be used for the interpolation or extrapolation and an interpolation or extrapolation parameter within the high frequency band. For calculation of the scale factor of the low frequency band component, the low frequency band component of the signal in the frequency domain received from the band splitting filter bank unit 1*c* is used.

The interpolation or extrapolation parameter may be a specified parameter. Further, the interpolation or extrapolation of the scale factor may be made by calculating a parameter to be actually used for interpolation or extrapolation from the specified interpolation or extrapolation parameter and the interpolation or extrapolation parameter contained in the frequency envelope information. Furthermore, in at least one of the cases where the frequency envelope information is not received and where the frequency envelope information does not contain the interpolation or extrapolation parameter, the interpolation or extrapolation of the scale factor may be made using the specified interpolation or extrapolation parameter only. Note that, in this embodiment, a method of interpolation and extrapolation is not particularly limited.

The form of the frequency envelope information described above is just one example, and it may be any form as long as it is a parameter representing variation of the signal power or the signal amplitude in the frequency direction for each sub-band of the high frequency band. In this embodiment, the form of the frequency envelope information is not particularly limited.

Then, the frequency envelope superposition unit 1*q* transforms the above-described $E_F(k,s)$ using the following equation.

$$E_1(m, s) = E_{F,dec}(k, s) \quad \text{[Equation 54]}$$

$$k_l - k_x \le m \le k_h - k_x, \begin{cases} k_l = G_H(k) \\ k_h = G_H(k+1) - 1' \end{cases}$$

$$1 \le k \le n_H,$$

$$0 \le s < s_E$$

Then, the frequency envelope superposition unit 1*q* calculates the quantity $E_2(m,i)$ by the following equation using the time envelope $E_0(m,i)$ and the frequency envelope $E_1(m,i)$ transformed as above.

$$E_2(m,i)=E_1(m,s)\cdot E_0(m,i)$$

$$0 \le m \le k_{max} - k_x,$$

$$t(s) \le i < t(s+1),\ 0 \le s < s_E \quad \text{[Equation 55]}$$

Further, the above-described $E_2(m,i)$ may be in the form given by the following equation.

$$E_2(m, i) = E_1(m, s) \cdot \sum_{k=0}^{k_{max}-k_x} E_0(k, i), \quad \text{[Equaition 56]}$$

$$0 \le m \le k_{max} - k_x,$$

$$t(s) \le i < t(s+1),\ 0 \le s < s_E$$

Further, it may be in the form given by the following equation.

$$E_2(m, i) = E_1(m, s) \cdot \sum_{k=F_H(Q(m))-k_x}^{F_H(Q(m)+1)-k_x-1} E_0(k, i), \quad \text{[Equation 57]}$$

$$0 \le m \le k_{max} - k_x,$$

$$t(s) \le i < t(s+1),\ 0 \le s < s_E$$

where Q(m), $0 \le m < k_{max} - k_x$ is an integer satisfying the following equation.

$$F_H(Q(m)) - k_x \le m < F_H(Q(m)+^1) - k_x$$

$$1 \le Q(m) \le n_H \quad \text{[Equation 58]}$$

Further, it may be in the form given by the following equation.

$$E_2(m, i) = \frac{E_1(m, s)}{\left(\sum_{k=F_H(Q(m))-K_x}^{F_H(Q(m)+1)-k_x-1} E_1(k, s) + \varepsilon\right)} \cdot \sum_{k=F_H(Q(m))-k_x}^{F_H(Q(m)+1)-k_x-1} E_0(k, i), \quad \text{[Equation 59]}$$

$$0 \le m \le k_{max} - k_x,$$

$$t(s) \le i < t(s+1),\ 0 \le s < s_E$$

Note that, however, the form of the above-described $E_2(m,i)$ is not limited to the above examples in the present invention.

Then, the frequency envelope superposition unit 1*q* calculates the quantity E(m,i) by the following equation using the above-described $E_2(m,i)$.

$$E(m,i)=C(s)\cdot E_2(m,i),$$

$$0 \le m \le k_{max} - k_x,$$

$$t(s) \le i < t(s+1),\ 0 \le s < s_E \quad \text{[Equation 60]}$$

The coefficient C(s) is given by the following equation.

$$C(s) = \frac{\sum_{i=t(s)}^{t(s+1)-1} \sum_{p=0}^{k_{max}-k_x} E_0(p, i)}{\left(\sum_{i=t(s)}^{t(s+1)-1} \sum_{p=0}^{k_{max}-k_x} E_2(p, i)\right) + \varepsilon} \quad \text{[Equation 61]}$$

$$0 \le s < s_E$$

Further, it may be the following equation.

$$C(s) = \frac{\sum_{i=t(s)}^{t(s+1)-1} \sum_{p=0}^{k_{max}-k_x} E_1(p, i)}{\left(\sum_{i=t(s)}^{t(s+1)-1} \sum_{p=0}^{k_{max}-k_x} E_2(p, i)\right) + \varepsilon} \quad \text{[Equation 62]}$$

$$0 \le s < s_E$$

The time-frequency envelope adjustment unit 1*p* adjusts, using the time-frequency envelope $E_1(m,i)$ supplied from the frequency envelope superposition unit 1*q*, the time-frequency envelope of the high frequency band signal $X_H(j,i)$, $k_x \le j < k_{max}$ supplied from the high frequency band generation unit 1*h*.

It should be noted that the first to sixth alternative examples of the speech decoder 1 according to the first embodiment of the invention may be applied to the speech decoder 101 according to the second embodiment of the invention.

Figure 25:
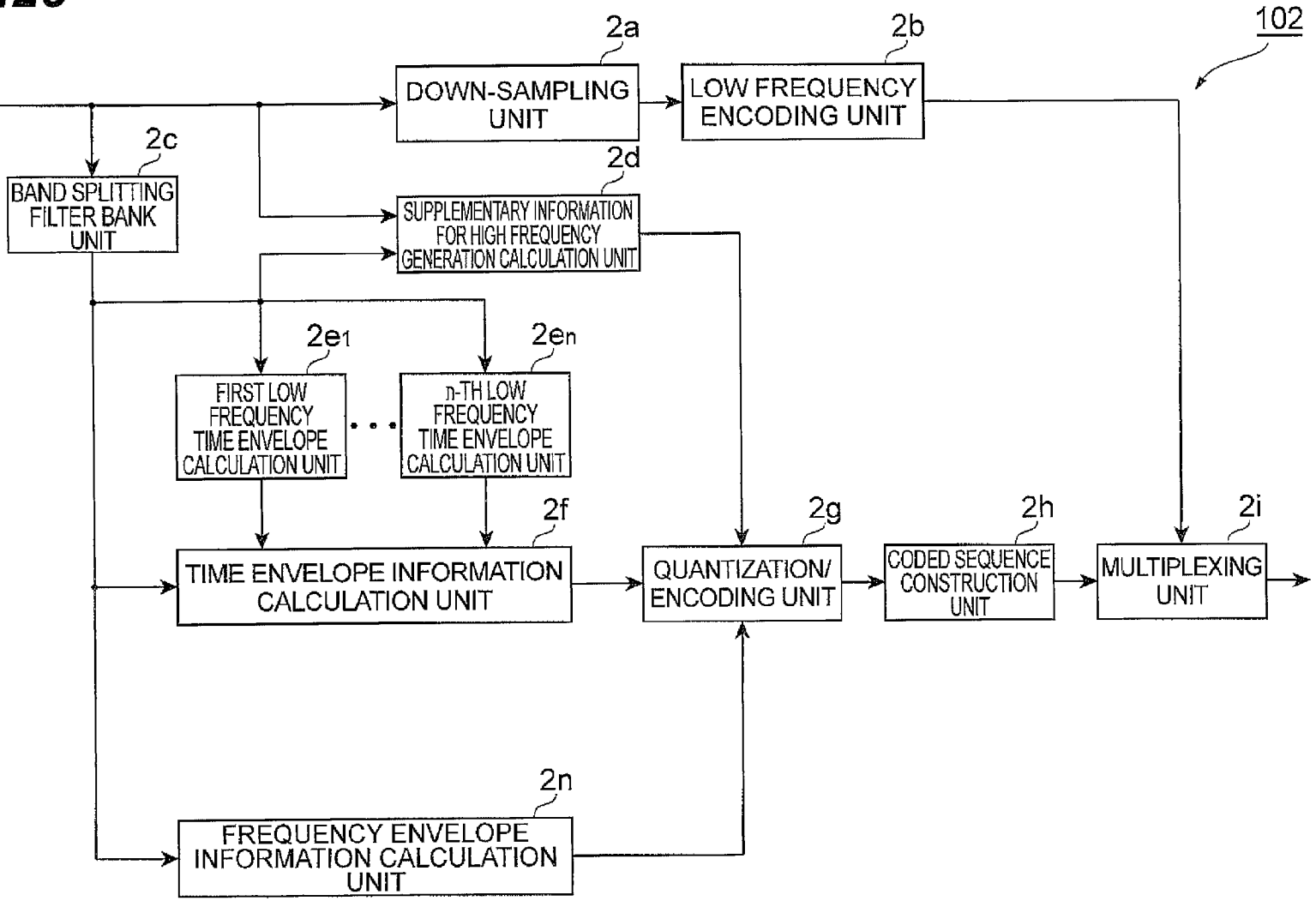
FIG. 25 is a diagram showing a configuration of a speech encoder 102 according to the second embodiment.
Figure 26:
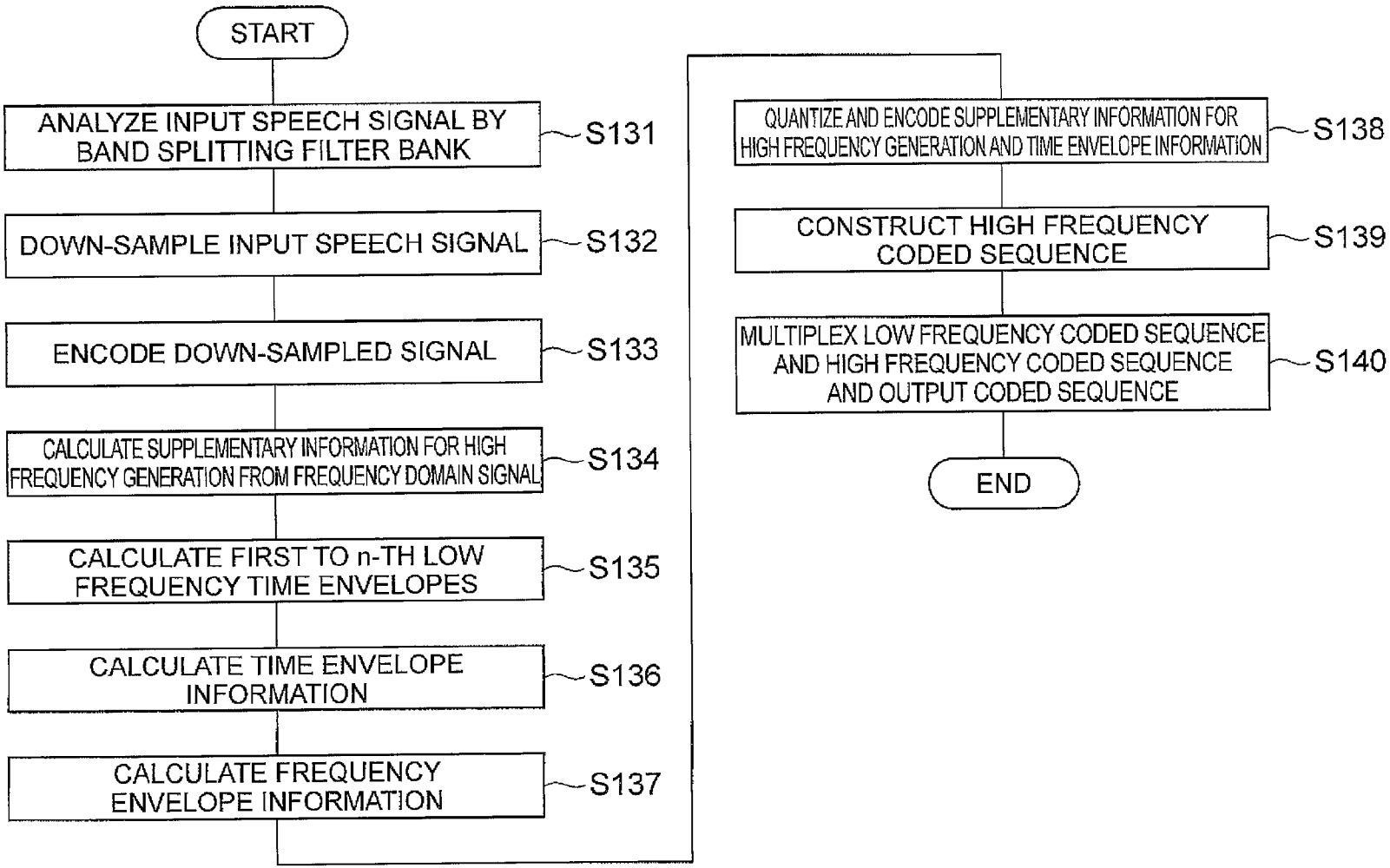
FIG. 26 is a flowchart showing a procedure of speech encoding performed by the speech encoder 102 shown in FIG. 25.

FIG. 25 is a diagram showing a configuration of a speech encoder 102 according to the second embodiment, and FIG. 26 is a flowchart showing a procedure of speech encoding by the speech encoder 102 shown in FIG. 25. The speech encoder 102 of FIG. 25 is different from the speech encoder 2 according to the first embodiment in that it further includes a frequency envelope information calculation unit 2*n*.

The frequency envelope information calculation unit 2*n* receives the high frequency band signal X(j,i) $\{0 \le j < N, 0 \le i < t(s_E)\}$ from the band splitting filter bank unit 2*c* and calculates the frequency envelope information. Specifically, calculation of the frequency envelope information is performed as follows.

First, the frequency envelope information calculation unit 2*n* calculates the frequency envelope of the power on the sub-band $B^{(F)}_k$ (where k=1, 2, 3, . . . , $m_H$) by the following equation.

$$E_F(k,s)=\frac{\sum_{i=t(s)}^{t(s+1)-1}\sum_{j=k_l}^{k_h}|X(j,i)|^2}{(t(s+1)-t(s))\cdot(k_h-k_l+1)}\quad\text{[Equation 63]}$$

$$k_l=G_H(k),\ k_h=G_H(k+1)-1,\ 0\le s<s_E$$

Next, the frequency envelope information calculation unit 2*n* calculates the scale factor sf(k,s), $1\le k\le m_H$ of the sub-band $B^{(F)}_k$. The value of sf(k,s) is calculated by the following equation, for example.

$$sf(k,s)=10\log_{10}E_F(k,s),$$

$$k_l=G_H(k),\ k_h=G_H(k+1)-1,\ 1\le k\le m_H,\ 0\le s\le s_E\quad\text{[Equation 64]}$$

Further, the frequency envelope information calculation unit 2*n* may calculate the value of sf(k,s) by the following equation in accordance with the method described in "ISO/IEC 14496-3 4.B.18".

$$sf(k,s)=\log_2\left(\frac{1}{64}\cdot E_F(k,s)\right),\quad\text{[Equation 65]}$$

$$k_l=G_H(k),\ k_h=G_H(k+1)-1,\ 1\le k\le m_H,\ 0\le s<s_E$$

Further, it may be set by the following equation $$sf(k,s)=C,\ \forall k\in N_c,\ 0\le s<s_E\quad\text{[Equation 66]}$$

in accordance with the speech decoder 101.

Then, the frequency envelope information calculation unit 2*n* may set the frequency envelope information as the above-described scale factor sf(k, s) ($1\le k\le m_H$). Further, the frequency envelope information may be in the form of the following equation. Specifically, a difference in the above-described scale factor sf(k, s) is defined by the following equation $$dsf(k,s)=sf(k,s)-sf(k-1,s),$$

$$0\le s<s_E,\ 2\le k\le m_H\quad\text{[Equation 67]},$$

and dsf(k,s) and sf(1,s)($0\le s<s_E$) may be used as the frequency envelope information.

Further, like the frequency envelope superposition unit 1*q* of the speech decoder 101 according to the second embodiment, the above-described scale factor sf(0,s) may be calculated using the low frequency band signal X(j,i)($0\le j<k_x$) in the frequency domain, and dsf(1,s) calculated by the scale factor sf(0,s) may be contained in the frequency envelope information.

Further, the frequency envelope information may be an extrapolation parameter from the low frequency band when the scale factor of the high frequency band is approximated by extrapolation from the scale factor of the low frequency band component. Further, the frequency envelope information may be the scale factor of the sub-band and the interpolation or extrapolation parameter within the high frequency band when calculating a part different from several sub-bands from the scale factors of these several sub-bands of the high frequency band by using interpolation or extrapolation. A combination of the former and latter forms may be the frequency envelope information.

Note that, in this invention, the frequency envelope information is not limited to the above-described examples.

As a quantization and encoding method of the frequency envelope information, the frequency envelope information may be scalar-quantized and then entropy-coded such as Huffman coding and Arithmetic coding. Further, the frequency envelope information may be vector-quantized using a specified code book and then its index may be set as a code.

Specifically, the above-described scale factor sf(k,s) may be scalar-quantized and then entropy-coded such as Huffman coding and Arithmetic coding. Further, the above-described dsf(k,s) may be scalar-quantized and then entropy-coded. Furthermore, the above-described scale factor sf(k,s) may be vector-quantized using a specified code book and then its index may be set as a code. Further, the above-described dsf(k,s) may be vector-quantized using a specified code book and then its index may be set as a code. Furthermore, a difference of the scalar-quantized scale factor sf(k,s) may be entropy-coded.

For example, $E_{Delta}$(k,s) may be calculated by the following equation $$E_Q(k,s)=INT(a\cdot\max(sf(k,s),0)+0.5),$$

$$E_{Delta}(k,s)=E_Q(k,s)-E_Q(k-1,s),$$

$$2\le k\le m_H,\ 0\le s<s_E$$

using sf(k,s) in the above-described equation in accordance with the method described in "ISO/IEC 14496-3 4.B.18", and $E_{Delta}$(k,s) may be Huffman coded.

Note that, when the integer 1 is included in a set $N_c$, the above-described quantization and encoding of sf(1,s) ($0\le s<s_E$) and dsf(1,s) ($0\le s<s_E$) may be omitted.

Further, in the present invention, quantization and encoding of the frequency envelope information are not limited to the above-described examples.

Figure 27:
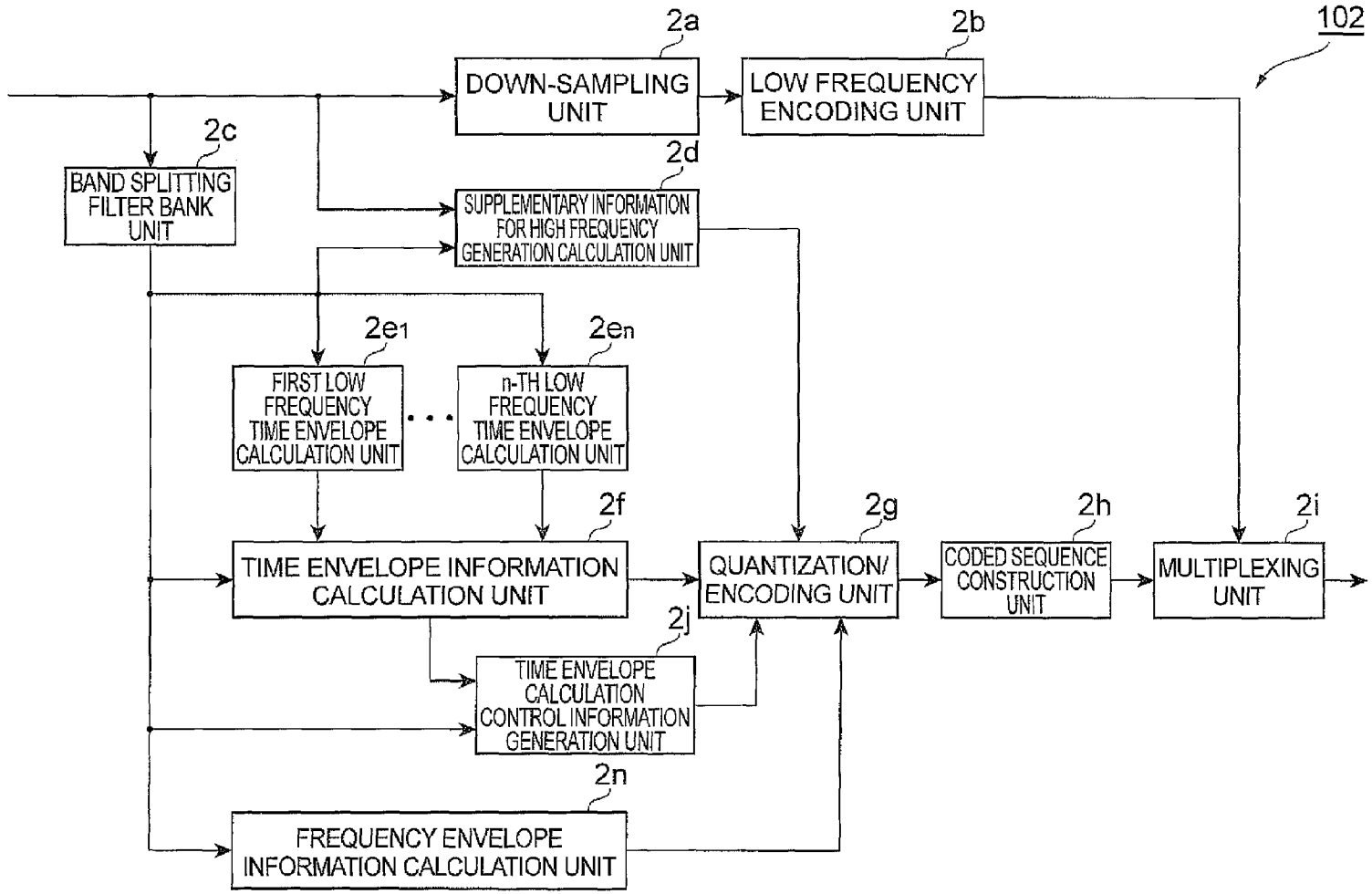
FIG. 27 is a diagram showing a configuration in which the first alternative example of the speech encoder 2 according to the first embodiment of the invention is applied to the speech encoder 102 according to the second embodiment of the invention.
Figure 28:
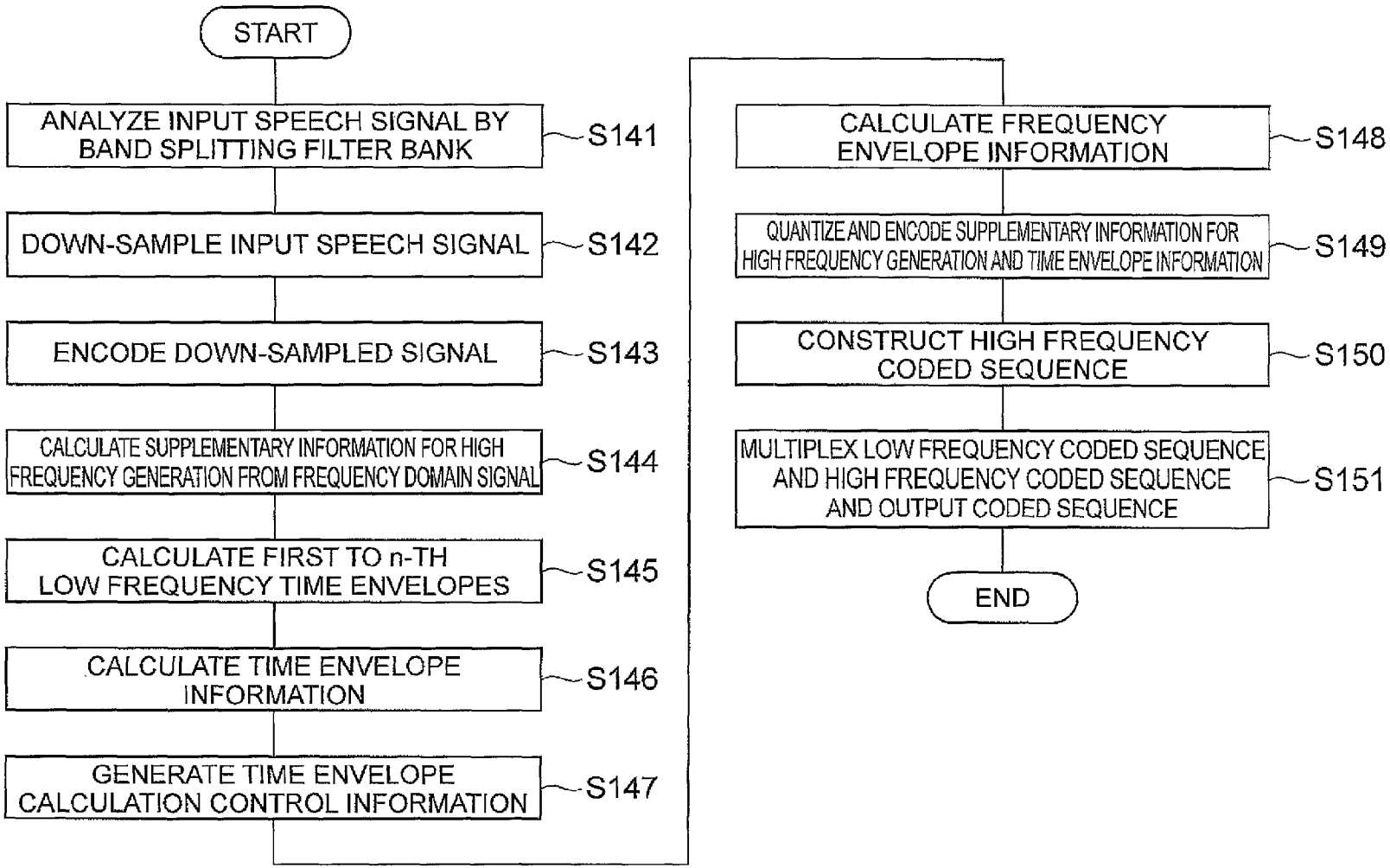
FIG. 28 is a flowchart showing a procedure of speech encoding performed by the speech encoder 102 shown in FIG. 27.
Figure 29:
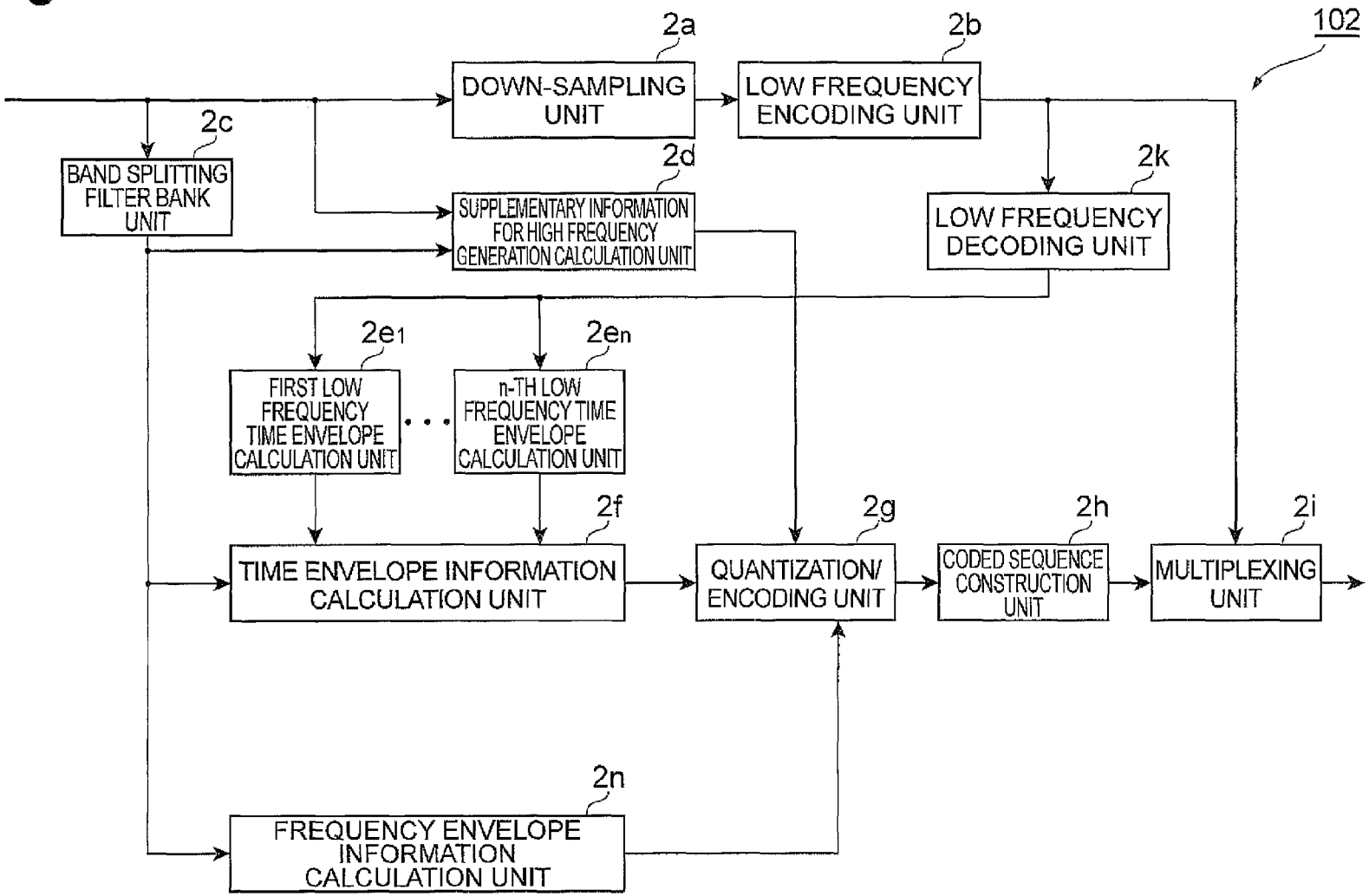
FIG. 29 is a diagram showing a configuration in which the second alternative example of the speech encoder 2 according to the first embodiment of the invention is applied to the speech encoder 102 according to the second embodiment of the invention.
Figure 30:
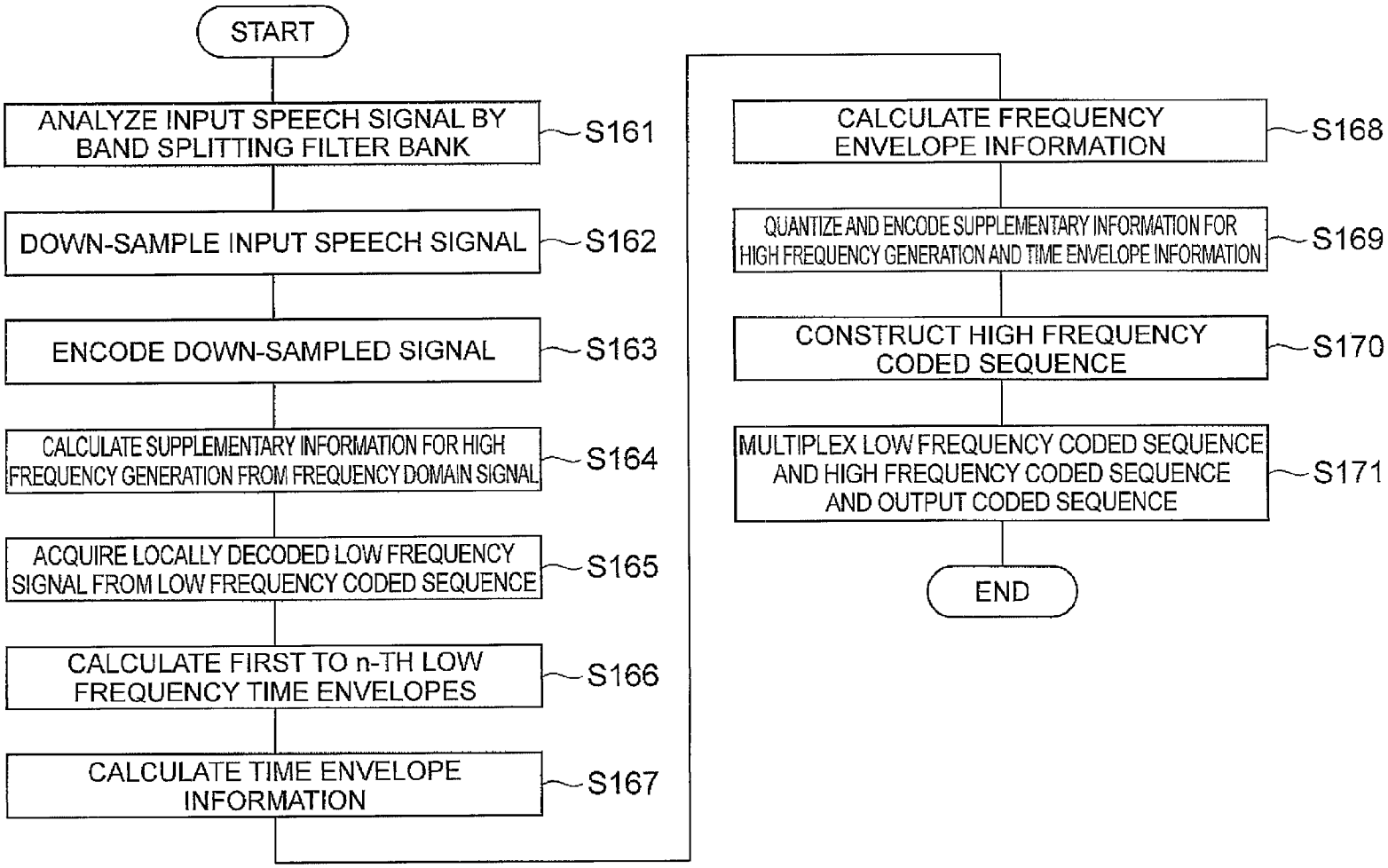
FIG. 30 is a flowchart showing a procedure of speech encoding performed by the speech encoder 102 shown in FIG. 29.

The first to fourth alternative examples of the speech encoder 2 according to the first embodiment of the invention may be applied to the speech encoder 102 according to the second embodiment of the invention. For example, FIG. 27 is a diagram showing a configuration when the first alternative example of the speech encoder 2 according to the first embodiment of the invention is applied to the speech encoder 102 according to the second embodiment of the invention, FIG. 28 is a flowchart showing a procedure of speech encoding by the speech encoder 102 shown in FIG. 27. Further, FIG. 29 is a diagram showing a configuration when the second alternative example of the speech encoder 2 according to the first embodiment of the invention is applied to the speech encoder 102 according to the second embodiment of the invention, and FIG. 30 is a flowchart showing a procedure of speech encoding by the speech encoder 102 shown in FIG. 29.

Third Embodiment

A third embodiment of the present invention is described hereinbelow.

Figure 31:
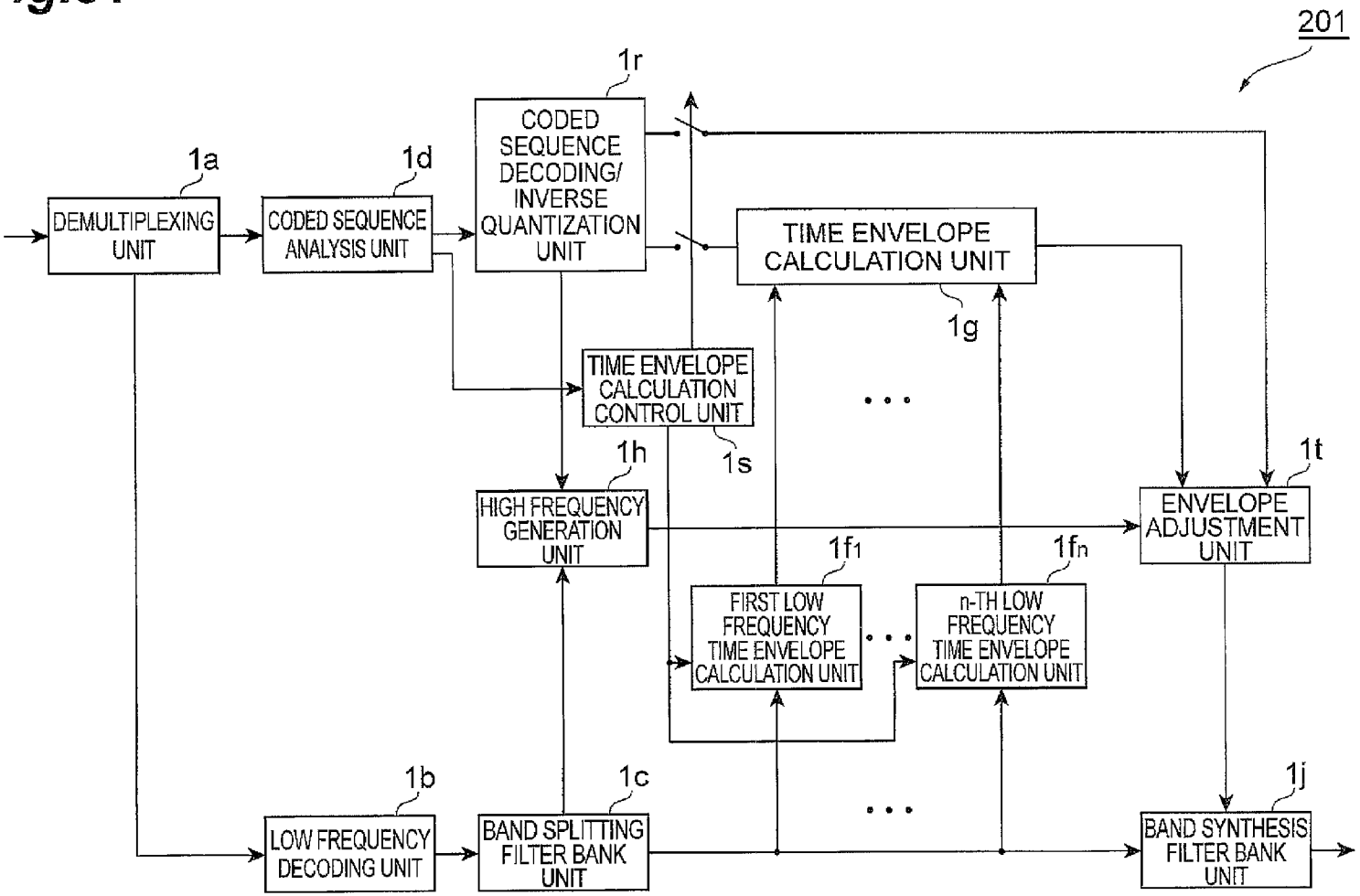
FIG. 31 is a diagram showing a configuration of a speech decoder 201 according to a third embodiment.
Figure 32:
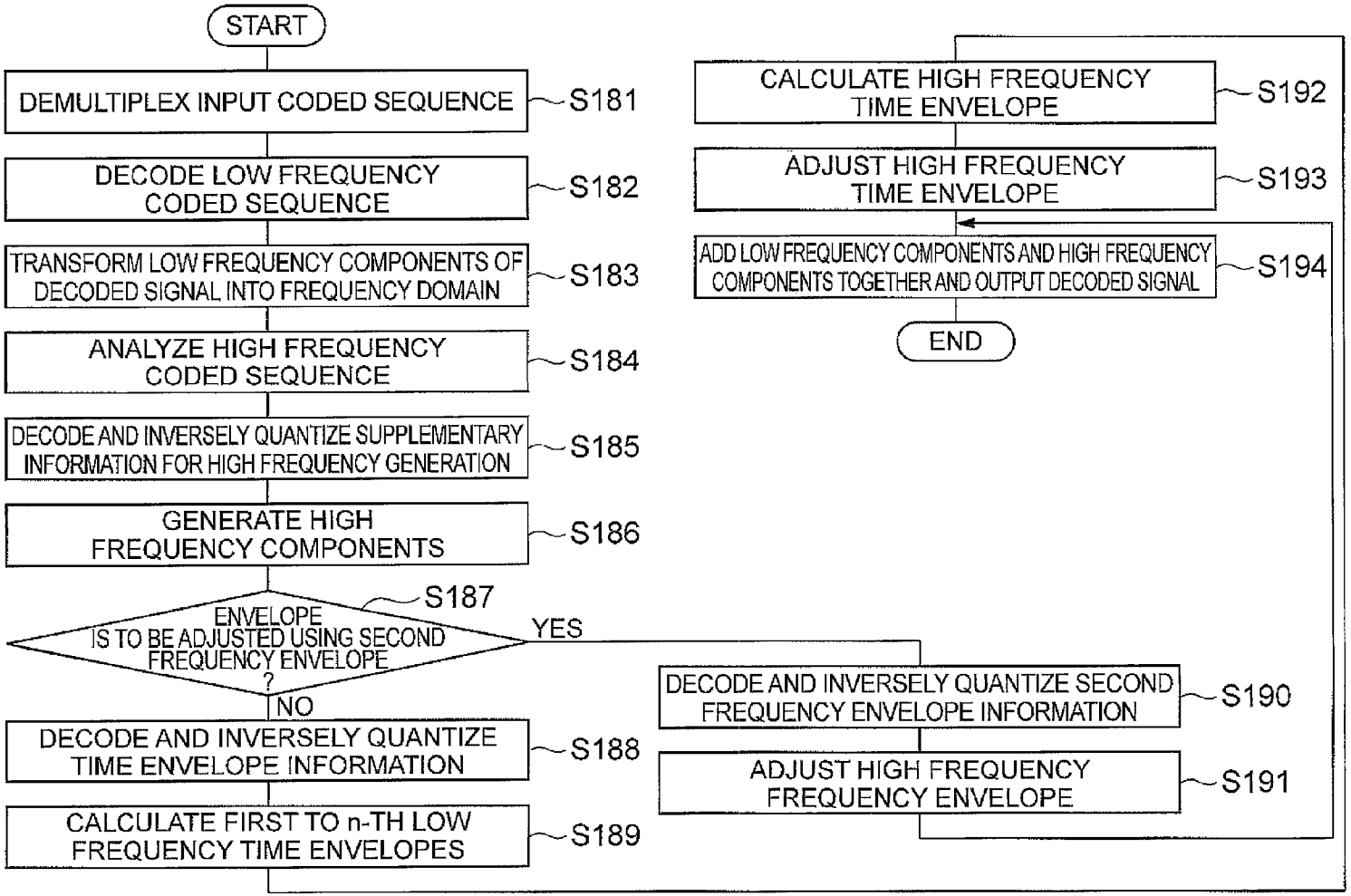
FIG. 32 is a flowchart showing a procedure of speech decoding performed by the speech decoder 201 shown in FIG. 31.

FIG. 31 is a diagram showing a configuration of a speech decoder 201 according to the third embodiment, and FIG. 32 is a flowchart showing a procedure of speech decoding by the speech decoder 201 shown in FIG. 31. The speech decoder 201 of FIG. 31 is different from the speech decoder 1 according to the first embodiment in that it further includes a time envelope calculation control unit 1*s* and that it includes a coded sequence decoding/dequantization unit 1*r* and an envelope adjustment unit it in place of the coded sequence decoding/dequantization unit 1*e* and the time envelope adjustment unit 1*i* (1*c* to 1*d*, 1*h*, 1*j*, and 1*r* to 1*t* are sometimes referred to also as a bandwidth extension unit (bandwidth extension means)).

The coded sequence analysis unit 1*d* analyzes the high frequency band coded sequence supplied from the demultiplexing unit 1*a* and thereby obtains coded supplementary information for high frequency band generation and time envelope calculation control information and further obtains coded time envelope information or coded second frequency envelope information.

The coded sequence decoding/dequantization unit 1*r* decodes the coded supplementary information for high frequency band generation supplied from the coded sequence analysis unit 1*d* and thereby obtains supplementary information for high frequency band generation.

The high frequency band generation unit 1*h* replicates, using the supplementary information for high frequency band generation supplied from the coded sequence decoding/dequantization unit 1*r*, the low frequency band signal $X_{dec}(j,i)$, $0 \le j < k_x$ supplied from the band splitting filter bank unit 1*c* onto the high frequency band and thereby generates a high frequency band signal $X_{dec}(j,i)$, $k_x \le j \le k_{max}$.

The time envelope calculation control unit is checks, based on the time envelope calculation control information supplied from the coded sequence analysis unit 1*d*, whether the envelope adjustment unit it is to adjust the envelope of the high frequency band signal using the second frequency envelope information. When the envelope adjustment unit it does not adjust the envelope of the high frequency band signal using the second frequency envelope information, the coded sequence decoding/dequantization unit 1*r* decodes and inversely quantizes the coded time envelope information supplied from the coded sequence analysis unit 1*d* and thereby obtains the time envelope information. On the other hand, when the envelope adjustment unit it adjusts the envelope of the high frequency band signal using the second frequency envelope information, the time envelope calculation control unit 1*s* outputs a low frequency band time envelope calculation control signal to the low frequency band time envelope calculation units $\mathbf{1}f_1$ to $\mathbf{1}f_n$ and outputs a time envelope calculation control signal to the time envelope calculation unit 1*g* so that the envelope calculation is not performed in the low frequency band time envelope calculation units $\mathbf{1}f_1$ to $\mathbf{1}f_n$ and the time envelope calculation unit 1*g*.

Further, the coded sequence decoding/dequantization unit 1*r* decodes and inversely quantizes the coded second frequency envelope information supplied from the coded sequence analysis unit 1*d* and thereby obtains the second frequency envelope information. Further, in this case, the envelope adjustment unit 1*t* adjusts, using the second frequency envelope information supplied from the coded sequence decoding/dequantization unit 1*r*, the frequency envelope of the high frequency band signal $X_H(j,i)$ ($k_x \le j < k_{max}$) supplied from the high frequency band generation unit 1*h*.

Specifically, the quantity $E_3(k,s)$, $1 \le k \le m_H$, $0 \le s < s_E$ corresponding to $E_{F,dec}(k,s)$ is calculated using the decoded and inversely quantized second frequency envelope information in accordance with the calculation method of $E_{F,dec}(k,s)$ in the frequency envelope superposition unit 1*q* of the speech decoder 101, and further the above-described $E_3(k,s)$ is transformed by the following equation.

$$E(m, i) = E_3(k, s) \qquad \text{[Equation 69]}$$

$$k_l - k_x \le m \le k_h - k_x, \begin{cases} k_l = G_H(k) \\ k_h = G_H(k+1) - 1' \end{cases}$$

$$1 \le k \le m_H,$$

$$0 \le s < s_E$$

After that, the high frequency band signal Y(i,j) $\{k_x \le j \le k_{max},\ t(s) \le i < t(s+1),\ 0 \le s < s_E\}$ whose envelope is adjusted in accordance with the procedure in the time-frequency envelope adjustment unit 1*p* of the speech decoder 101 is acquired.

Note that the first to seventh alternative examples of the speech decoder 1 according to the first embodiment of the invention may be applied to the speech decoder 201 according to the third embodiment of the invention.

Figure 35:
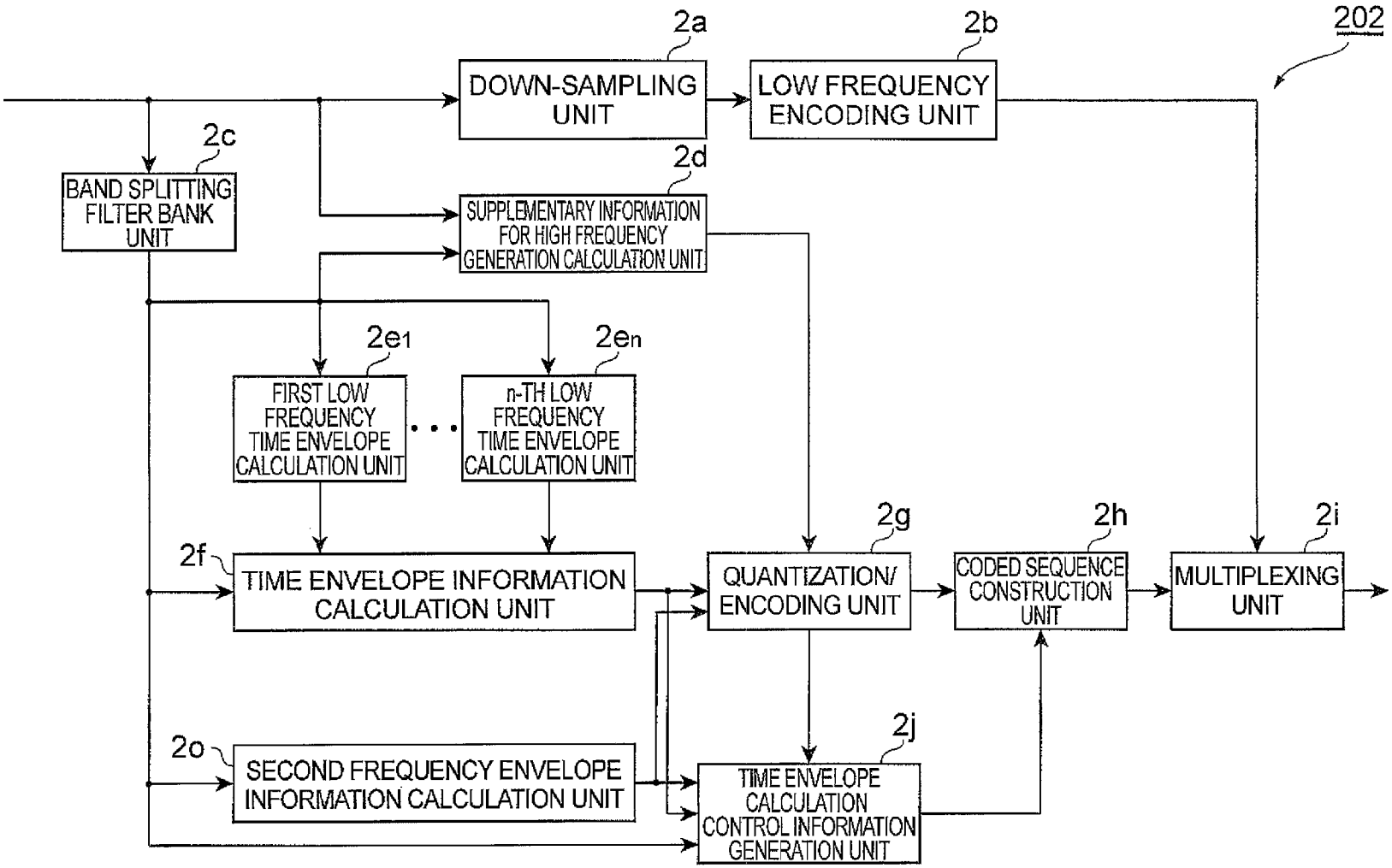
FIG. 35 is a diagram showing a configuration of a speech encoder 202 according to the third embodiment.
Figure 36:
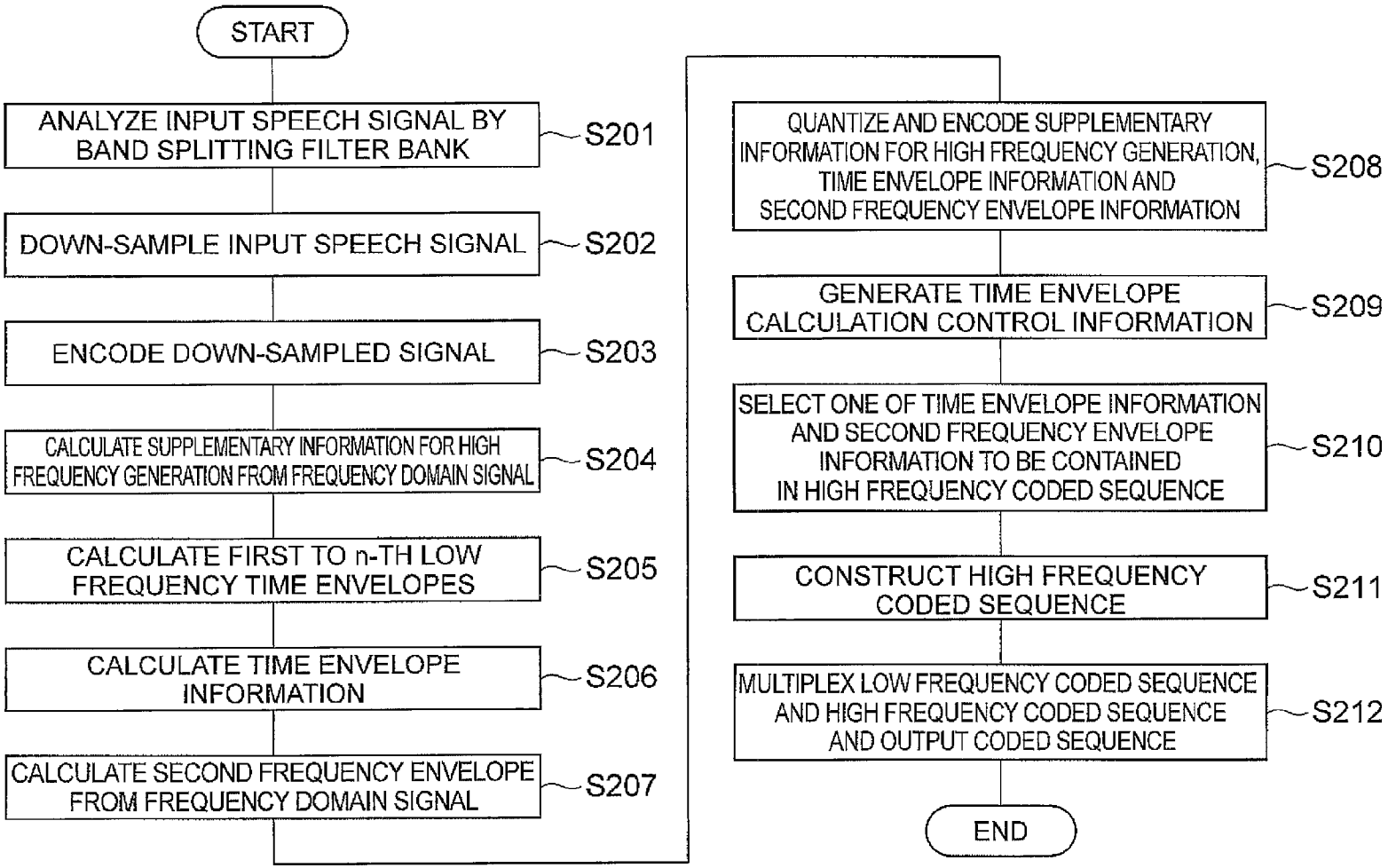
FIG. 36 is a flowchart showing a procedure of speech encoding performed by the speech encoder 202 shown in FIG. 35.

FIG. 35 is a diagram showing a configuration of a speech encoder 202 according to the third embodiment, and FIG. 36 is a flowchart showing a procedure of speech encoding by the speech encoder 202 shown in FIG. 35. The speech encoder 202 of FIG. 35 is different from the speech encoder 2 according to the first embodiment in that it further includes a time envelope calculation control information generation unit 2*j* and a second frequency envelope information calculation unit 2*o*.

The second frequency envelope information calculation unit 2*o* receives the high frequency band signal X(j,i) $\{k_x \le j < N,\ t(s) \le i < t(s+1),\ 0 \le s < s_E\}$ from the band splitting filter bank unit 2*c* and calculates the second frequency envelope information (processing in Step S207).

The second frequency envelope information may be calculated in the same manner as the calculation method of the frequency envelope information in the speech encoder 102 according to the second embodiment. In this embodiment, however, the calculation method of the second frequency envelope information is not particularly limited.

The quantization/encoding unit 2*g* quantizes and encodes the time envelope information and the second frequency envelope information. The quantization and encoding of the time envelope information may be performed in the same manner as the quantization and encoding in the quantization/encoding unit 2*g* of the speech encoder according to the first and second embodiments. The quantization and encoding of the second frequency envelope information may be performed in the same manner as the quantization and encoding of the frequency envelope information in the quantization/encoding unit 2*g* of the speech encoder according to the second embodiment. In this embodiment, however, the quantization and encoding method of the time envelope information and the second frequency envelope information is not particularly limited.

The time envelope calculation control information generation unit 2*j* generates time envelope calculation control information using at least one of the signal X(j,i) in the frequency domain received from the band splitting filter bank unit 2*c*, the time envelope information received from the time envelope information calculation unit 2*f*, and the second frequency envelope information received from the second frequency envelope information calculation unit 2*o* (processing in Step S209). The generated time envelope calculation control information may be the time envelope calculation control information in the speech decoder 201 according to the third embodiment described above.

The time envelope calculation control information generation unit 2*j* may be the same as that of the first alternative example of the speech encoder 2 according to the first embodiment, for example.

The time envelope calculation control information generation unit 2*j* generates the pseudo locally decoded high frequency band signals using the time envelope information and the second frequency envelope information, respectively, and compares them with the original signal in the same manner as in the first alternative example of the speech encoder 2 according to the first embodiment, for example. When the pseudo locally decoded high frequency band signal generated using the second frequency envelope information is closer to the original signal, information indicating adjustment of the high frequency band signal using the second frequency envelope information in the decoder is generated as the time envelope calculation control information. The comparison between each of the pseudo locally decoded high frequency band signals with the original signal may be made by calculating a differential signal and determining whether the differential signal is small or not, for example. Further, the comparison may be made by calculating the time envelopes of each of the pseudo locally decoded high frequency band signals and the original signal, calculating a difference of the time envelopes of each of the pseudo locally decoded high frequency band signals and the original signal, and determining whether the difference is small or not. Furthermore, the comparison may be made by determining whether the maximum value of the differential signal from the original signal and/or the difference in the envelope is small or not. In this embodiment, the comparison method is not limited the above examples.

The time envelope calculation control information generation unit 2*j* may further use at least one of the quantized time envelope information and the quantized second frequency envelope information when generating the time envelope calculation control information.

When the coded supplementary information for high frequency band generation received from the quantization/encoding unit 2*g* and the time envelope calculation control information direct that the high frequency band signal be adjusted using the second frequency envelope information in the decoder, the coded sequence construction unit 2*h* constructs the high frequency band coded sequence using the coded second frequency envelope information and otherwise constructs the same using the coded time envelope information otherwise (processing in Step S211).

Note that the first to fourth alternative examples of the speech encoder 2 according to the first embodiment of the invention may be applied to the speech encoder 202 according to the third embodiment of the invention.

Fourth Embodiment

A fourth embodiment of the present invention is described hereinbelow.

Figure 33:
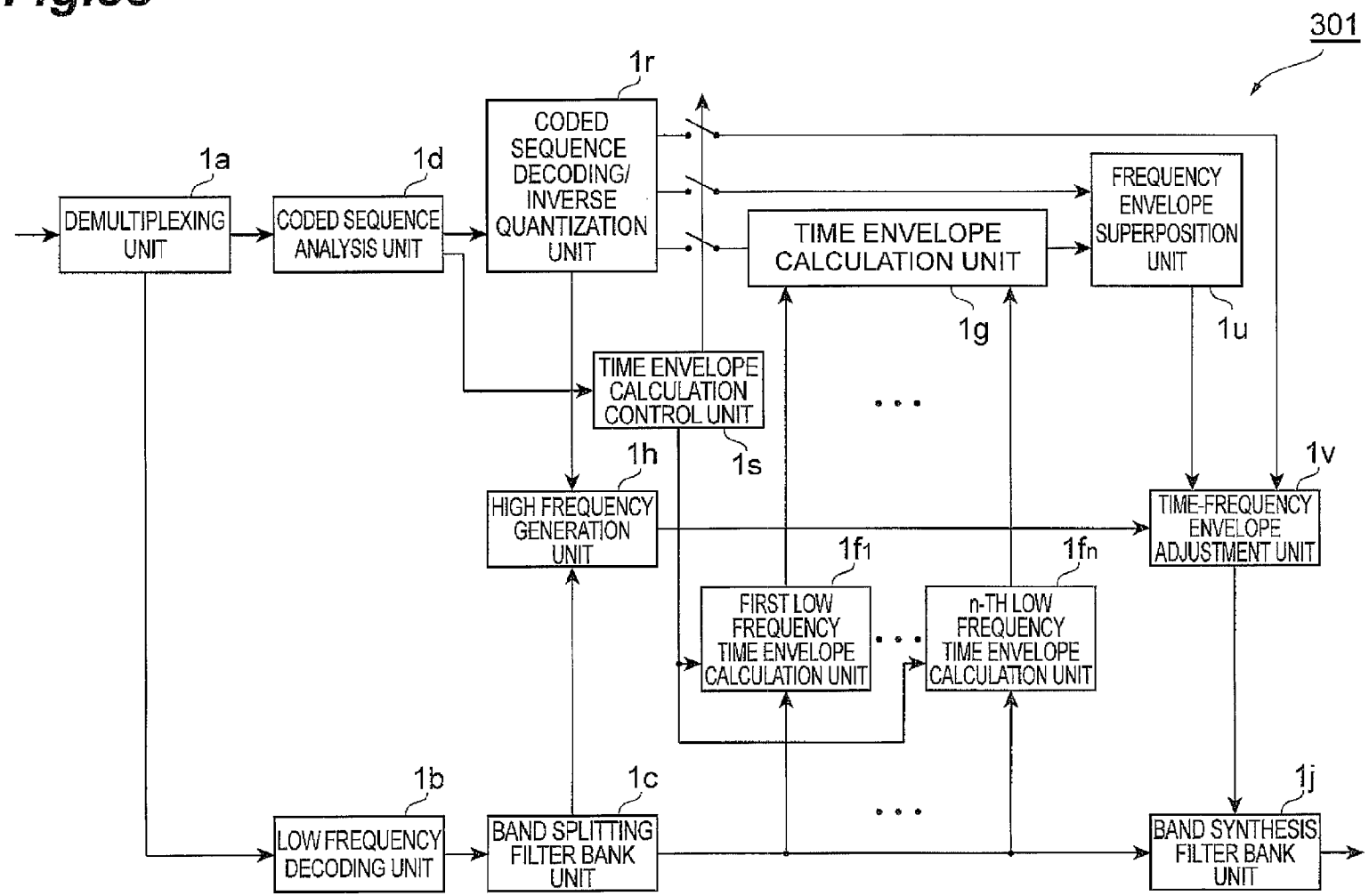
FIG. 33 is a diagram showing a configuration of a speech decoder 301 according to a fourth embodiment.
Figure 34:
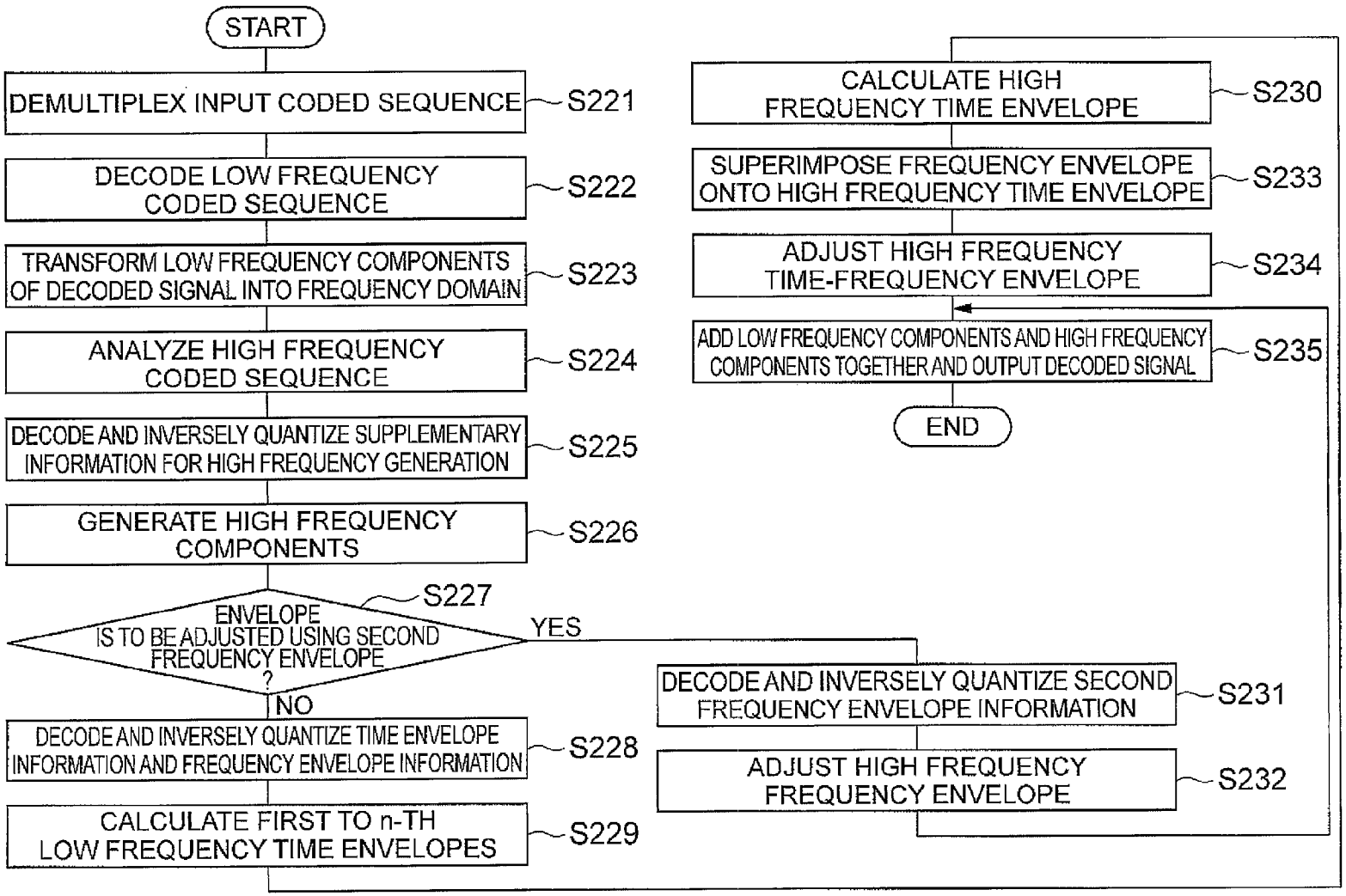
FIG. 34 is a flowchart showing a procedure of speech decoding performed by the speech decoder 301 shown in FIG. 33.

FIG. 33 is a diagram showing a configuration of a speech decoder 301 according to the fourth embodiment, and FIG. 34 is a flowchart showing a procedure of speech decoding by the speech decoder 301 shown in FIG. 33. The speech decoder 201 of FIG. 33 is different from the speech decoder 1 according to the first embodiment in that it further includes a time envelope calculation control unit 1*s* and a frequency envelope superposition unit 1*u* and that it includes a coded sequence decoding/dequantization unit 1*r* and a time-frequency envelope adjustment unit 1*v* in place of the coded sequence decoding/dequantization unit 1*e* and the time envelope adjustment unit 1*i*, respectively (1*c* to 1*d*, 1*h*, 1*j*, 1*r* to 1*s*, and 1*u* to 1*v* are sometimes referred to also as a bandwidth extension unit (bandwidth extension means)).

The coded sequence analysis unit 1*d* analyzes the high frequency band coded sequence supplied from the demultiplexing unit 1*a* and thereby obtains coded supplementary information for high frequency band generation and time envelope calculation control information and further obtains coded time envelope information and coded frequency envelope information or coded second frequency envelope information.

The time envelope calculation control unit 1*s* checks, based on the time envelope calculation control information supplied from the coded sequence analysis unit 1*d*, whether the envelope adjustment unit 1*v* is to adjust the envelope of the high frequency band signal using the second frequency envelope information and, when the envelope adjustment unit 1*v* does not adjust the envelope of the high frequency band signal using the second frequency envelope information, the coded sequence decoding/dequantization unit 1*r* decodes and inversely quantizes the coded time envelope information supplied from the coded sequence analysis unit 1*d* and thereby obtains the time envelope information.

On the other hand, when the envelope adjustment unit 1*v* adjusts the envelope of the high frequency band signal using the second frequency envelope information, the same processing as in Step S190 of the third embodiment is performed. Further, the processing of the time-frequency envelope adjustment unit 1*v* is also the same as in Step S191 of the third embodiment.

It should be noted that the first to seventh alternative examples of the speech decoder 1 according to the first embodiment of the invention may be applied to the speech decoder 301 according to the fourth embodiment of the invention.

Figure 37:
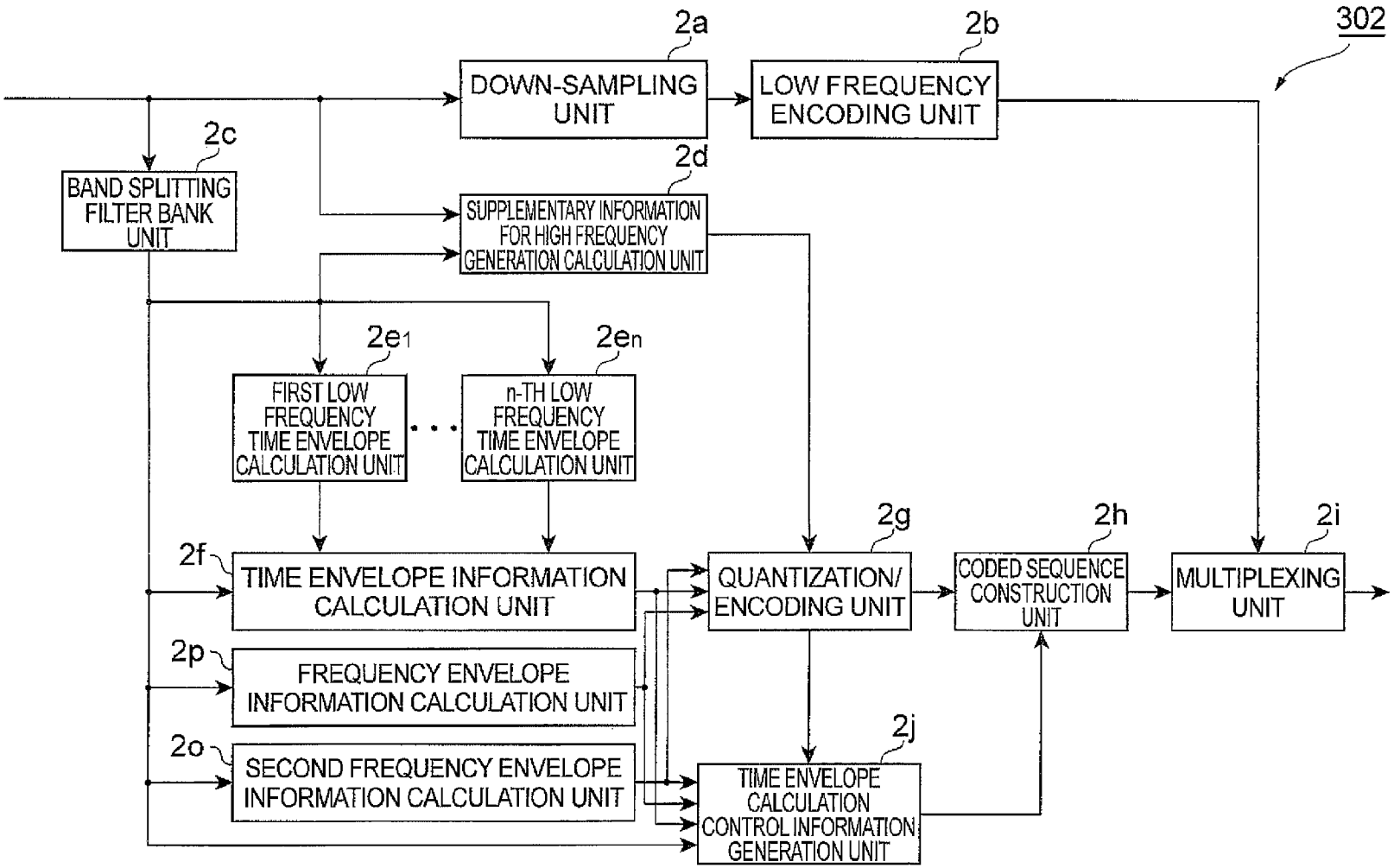
FIG. 37 is a diagram showing a configuration of a speech encoder 302 according to a fourth embodiment.
Figure 38:
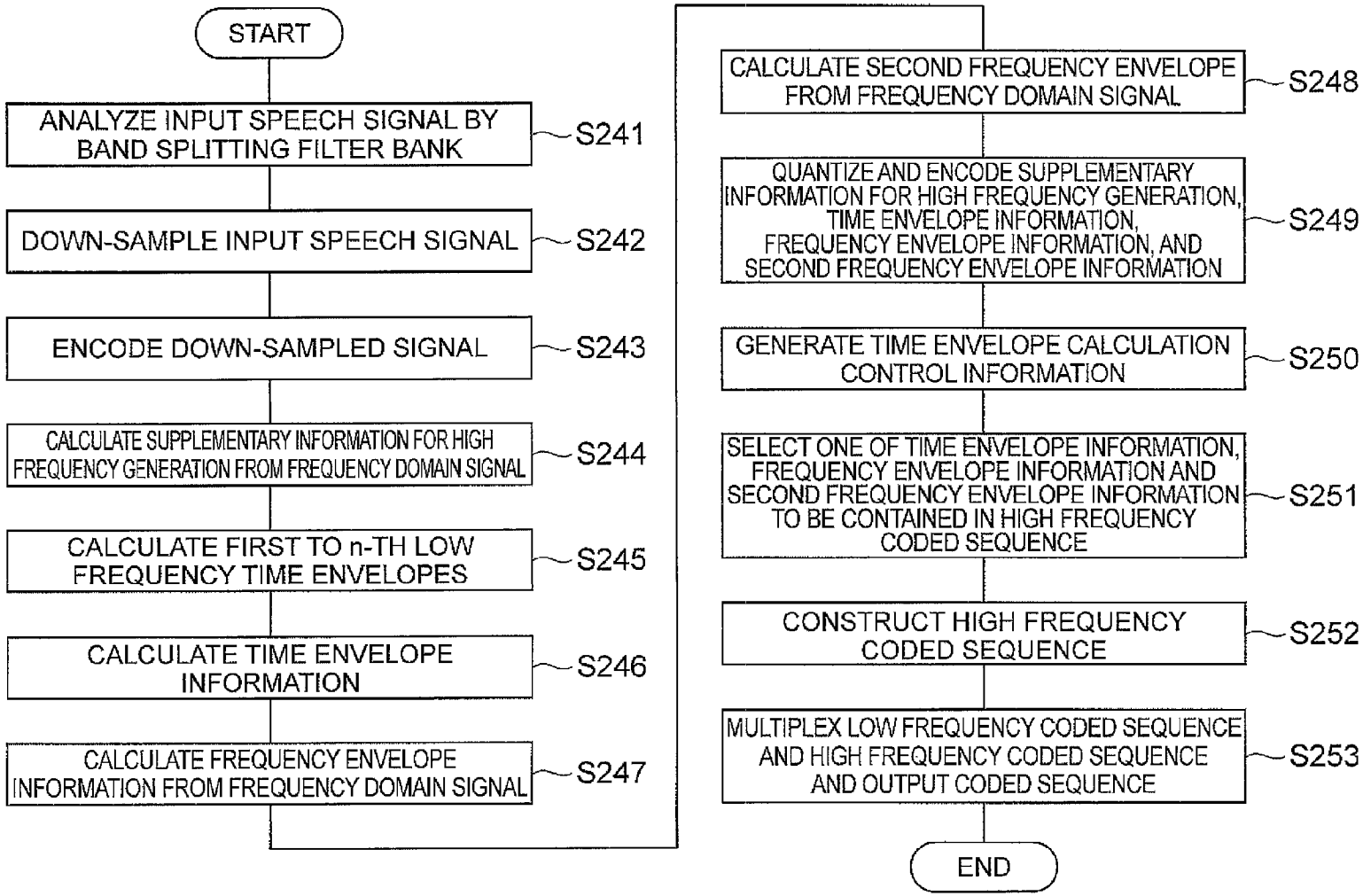
FIG. 38 is a flowchart showing a procedure of speech encoding performed by the speech encoder 302 shown in FIG. 37.

FIG. 37 is a diagram showing a configuration of a speech encoder 302 according to the fourth embodiment, and FIG. 38 is a flowchart showing a procedure of speech encoding by the speech encoder 302 shown in FIG. 37. The speech encoder 302 of FIG. 37 is different from the speech encoder 2 according to the first embodiment in that it further includes a time envelope calculation control information generation unit 2*j*, a frequency envelope information calculation unit 2*p*, and a second frequency envelope information calculation unit 2*o*.

The quantization/encoding unit 2*g* quantizes and encodes the time envelope information, the frequency envelope information and the second frequency envelope information. The quantization and encoding of the time envelope information may be performed in the same manner as the quantization and encoding in the quantization/encoding unit 2*g* of the speech encoder according to the first and second embodiments. The quantization and encoding of the frequency envelope information and the second frequency envelope information may be performed in the same manner as the quantization and encoding of the frequency envelope information in the quantization/encoding unit 2*g* of the speech encoder according to the second embodiment. In this embodiment, however, the quantization and encoding method of the time envelope information and the second frequency envelope information is not particularly limited.

The time envelope calculation control information generation unit 2*j* generates time envelope calculation control information using at least one of the signal X(j,i) in the frequency domain received from the band splitting filter bank unit 2*c*, the time envelope information received from the time envelope information calculation unit 2*f*, the frequency envelope information received from the frequency envelope information calculation unit 2*p*, and the second frequency envelope information received from the second frequency envelope information calculation unit 2*o* (processing in Step S250). The generated time envelope calculation control information may be the time envelope calculation control information in the speech decoder 301 according to the fourth embodiment.

The time envelope calculation control information generation unit 2*j* may be the same as that of the first alternative example of the speech encoder 2 according to the first embodiment, for example. Further, the time envelope calculation control information generation unit 2*j* may be the same as that of the speech encoder 202 according to the third embodiment, for example.

The time envelope calculation control information generation unit 2*j* generates the pseudo locally decoded high frequency band signals using the time envelope information, the frequency envelope information and the second frequency envelope information, respectively, and compares them with the original signal in the same manner as in the first alternative example of the speech encoder 2 according to the first embodiment, for example. When the pseudo locally decoded high frequency band signal generated using the second frequency envelope information is closer to the original signal, information indicating adjustment of the high frequency band signal using the second frequency envelope information in the decoder is generated as the time envelope calculation control information.

The comparison between each of the pseudo locally decoded high frequency band signals with the original signal may be the same as in the time envelope calculation control information generation unit 2*j* of the speech encoder 202 according to the third embodiment, and the comparison method is not particularly limited in this embodiment.

The time envelope calculation control information generation unit 2*j* may further use at least one of the quantized time envelope information, the quantized frequency envelope information and the quantized second frequency envelope information when generating the time envelope calculation control information.

When the coded supplementary information for high frequency band generation received from the quantization/encoding unit 1*g* and the time envelope calculation control information directs that the high frequency band signal be adjusted with the second frequency envelope information in the decoder, the coded sequence construction unit 2*h* constructs the high frequency band coded sequence using the coded second frequency envelop information and otherwise constructs the same with the coded time envelope information and the coded frequency envelope information (processing in Step S252).

Note that the first to fourth alternative examples of the speech encoder 2 according to the first embodiment of the invention may be applied to the speech encoder 302 according to the fourth embodiment of the invention.

Eighth Alternative Example of Speech Decoder According to First Embodiment

In this alternative example, in the time envelope calculation unit 1*g* of the speech decoder 1 according to the first embodiment, processing based on a specified function is performed on the calculated time envelope. For example, the time envelope calculation unit 1*g* normalizes the time envelope with respect to time and calculates the time envelope $E_T'(l, i)$ by the following equation.

$$E_T'(l, i) = E_T(l, i)\frac{t(s+1) - t(s)}{\sum_{i=t(s)}^{t(s+1)-1} E_T(l, i)}, \quad \text{[Equation 70]}$$

$$1 \le l \le n_H,\ t(s) \le i < t(s+1),\ 0 \le s < s_E$$

In this alternative example, after the time envelope $E_T'(l, i)$ is calculated, processing of replacing the value $E_T(l, i)$ with the value $E_T'(l, i)$ can be done since then.

According to this alternative example, only the temporal shape of the high frequency band signal $X_H(j,i)$ ($F_H(l) \le j < F_H(l+1)$) within the frequency band $F_H(l) \le j < F_H(l+1)$ of the frame s can be adjusted without changing the total amount of energy of the frequency band $F_H(l) \le j < F_H(l+1)$ in the frame s of the high frequency band signal $X_H(j, i)$ generated by the high frequency band generation unit 1*h*.

Note that the eighth alternative example of the speech decoder 1 according to the first embodiment may be applied also to the first to seventh alternative examples of the speech decoder 1 according to the first embodiment and the speech decoders according to the second to fourth embodiments, and, in this case, $E_T(l, i)$ may be replaced with $E_T'(l, i)$.

Ninth Alternative Example of Speech Decoder According to First Embodiment

In this alternative example, when the first to n-th low frequency band time envelope calculation units 1$f_1$ to 1$f_n$ of the speech decoder 1 according to the first embodiment acquire the time envelope $L_1(k, i)$ by smoothing the quantity $L_0(k, i)$ in the time direction, $L_0(k,i)$ ($t(s)-d \le i < t(s)$) is stored upon transition from the frame s−1 to the frame s. This alternative example allows smoothing of the quantity $L_0(k, i)$ (to be specific, $L_0(k,i)$ ($t(s) \le i < t(s)+d$)) of the frame s that is close to the boundary with the frame s−1.

The ninth alternative example of the speech decoder 1 according to the first embodiment is also applicable to the first to eighth alternative examples of the speech decoder 1 according to the first embodiment and the speech decoders according to the second to fourth embodiments.

Fifth Alternative Example of Speech Encoder According to First Embodiment

In this alternative example, the calculation of the time envelope information in the time envelope information calculation unit 2*f* of the speech encoder 2 according to the first embodiment is performed based on the correlation between a reference time envelope H(l,i) and the above-described g(l,i). For example, the time envelope information calculation unit 2*f* calculates the time envelope information as follows.

Specifically, a correlation coefficient corr(l) between H(l,i) and g(l,i) is calculated by the following equation.

$$\mathrm{corr}(l) = \frac{\sum_{i=t(s)}^{t(s+1)-1} \left( H(l,i) - H_{ave}(l) \right) \left( g(l,i) - g_{ave}(l) \right)}{\sqrt{\sum_{i=t}^{t(s+1)-1} \left( H(l,i) - H_{ave}(l) \right)^2} \sqrt{\sum_{i=t(s)}^{t(s+1)-1} \left( g(l,i) - g_{ave}(l) \right)^2}} \quad \text{[Equation 71]}$$

$$1 \le l \le n_H,\ t(s) \le i < t(s+1),\ 0 \le s < s_E$$

The correlation coefficient corr(l) is compared with a specified threshold, and the time envelope information is calculated based on the comparison result. Alternatively, a value corresponding to $\mathrm{corr}^2(l)$ may be calculated and compared with a specified threshold, and the time envelope information may be calculated based on the comparison result.

For example, the time envelope information is calculated as follows: Assuming that the specified threshold to be compared with the correlation coefficient is $\mathrm{corr}_{th}(l)$ and $g_{dec}(l,i)$ is given by Equation 21, the time envelope information is calculated by the following equation.

$$\begin{cases} A_{l,k}(s) = 0,\ A_{l,0}(s) = const(0) & corr(l) < corr_{th}(l) \\ A_{l,k}(s) = const(k),\ A_{l,0}(s) = 0 & \text{otherwise} \end{cases} \quad \text{[Equation 72]}$$

$$const(k) \neq 0,\ k > 0$$

When the time envelope information calculated in the above example is input to the second alternative example of the decoder 1 according to the first embodiment, in the case of $A_{l,k}(s)=0$, $A_{l,0}(s)=\mathrm{const}(0)$ (i.e. in the case where the correlation coefficient is smaller than a specified threshold in the encoder) in the sub-band $B^{(T)}_l$, the time envelope calculation control unit 1*m* outputs the low frequency band time envelope calculation control signal to the k-th (k>0) low frequency band time envelope calculation units $\mathbf{1}f_k$ so that the low frequency band time envelope calculation in the low frequency band time envelope calculation units $\mathbf{1}f_k$ is not performed. On the other hand, in the case of $A_{l,k}(s)=\mathrm{const}(k)$, $A_{l,0}(s)=0$ (i.e. in the case where the correlation coefficient is larger than a specified threshold in the encoder), the time envelope calculation control unit 1*m* outputs the low frequency band time envelope calculation control signal to the k-th (k>0) low frequency band time envelope calculation units $\mathbf{1}f_k$ so that the low frequency band time envelope calculation in the low frequency band time envelope calculation units $\mathbf{1}f_k$ is performed.

Note that, in this alternative example, the calculation method is not limited to the above example as long as the time envelope information is calculated based on the correlation between the reference time envelope H(l,i) and the above-described g(l,i).

In the case of calculating the time envelope information based on an error (or a weighted error) between the reference time envelope H(l,i) and g(l,i) as described in the speech encoder 2 according to the first embodiment, the time envelope information is calculated based on the degree of matching between the reference time envelope H(l,i) and g(l,i). On the other hand, in this alternative example, the time envelope information is calculated based on the degree of similarity between the shapes of the reference time envelope H(l,i) and g(l,i).

The fifth alternative example of the speech encoder 2 according to the first embodiment is also applicable to the first to fifth alternative examples of the speech encoder 2 according to the first embodiment and the speech encoders according to the second to fourth embodiments.

First Alternative Example of Speech Decoder According to Second Embodiment

In this alternative example, in the frequency envelope superposition unit 1*q* of the speech decoder 101 according to the second embodiment, processing based on a specified function is performed on the frequency envelope $E_{F,dec}(k,s)$. For example, the frequency envelope superposition unit 1*q* performs processing based on a function of smoothing the frequency envelope $E_{F,dec}(k,s)$ given by the following equation.

$$E_{F,dec,Filt}(k,i) = \sum_{j=0}^{d_h} E_{F,dec,Temp}(k, i-j) \cdot sc_h(j) \quad \text{[Equation 73]}$$

where $$E_{F,dec,Temp}(k,i) = E_{F,dec}(k,s),\ t(s) \le i < t(s+1) \quad \text{[Equation 74]}$$

and $sc_h(j)$ and $d_h$ are a specified coefficient of smoothing and a specified order of smoothing, respectively. In this case, $E_{F,dec,Filt}(k,i)$ is replaced with $E_{F,dec}(k,s)$ in the subsequent processing.

Further, a function of determining whether or not to smooth the frequency envelope $E_{F,dec}(k,s)$ based on the signal characteristics of the frame corresponding to the frequency envelope $E_{F,dec}(k,s)$ may be included in the above Equation 73. Furthermore, information indicating whether or not to perform smoothing may be included in the coded sequence, and a function of determining whether or not to smooth the frequency envelope $E_{F,dec}(k,s)$ based on the information may be included.

Note that the first alternative example of the speech decoder 101 according to the second embodiment is also applicable to the speech decoder according to the fourth embodiment.

Second Alternative Example of Speech Decoder According to Second Embodiment

In the frequency envelope superposition unit 1*q* of the speech decoder 101 according to the second embodiment, the quantity E(m,i) is the value obtained by correcting $E_2(m,i)$ with C(s) (Equation 60). Further, according to Equation 61, the energy of the high frequency band signal after adjustment of the time-frequency envelope in the band $k_x \le m \le k_{max}$ of the frame s is corrected to be the total of the time envelope $E_0(m,i)$ in the band $k_x \le m \le k_{max}$ of the frame s. On the other hand, according to Equation 62, the energy of the high frequency band signal after adjustment of the time-frequency envelope in the band $k_x \le m \le k_{max}$ of the frame s is corrected to be the total of the frequency envelope $E_1(m,i)$ in the band $k_x \le m \le k_{max}$ of the frame s. In this alternative example, C(s) is given by the following equation so that the energy of the high frequency band signal after adjustment of the time-frequency envelope in the band $k_x \le m \le k_{max}$ of the frame s is maintained after the adjustment of the time-frequency envelope.

$$C(s) = \frac{\sum_{i=t(s)}^{t(s+1)-1} \sum_{j=k_x}^{k_{max}} |X_H(j, i)|^2}{\left( \sum_{i=t(s)}^{t(s+1)-1} \sum_{p=0}^{k_{max}-k_x} E_2(p, i) \right) + \varepsilon} \quad \text{[Equation 75]}$$

Further, C(s) may be given by the following equation so that the energy of the high frequency band signal after adjustment of the time-frequency envelope in the band $k_x \le m \le k_{max}$ of the frame s is the total of the time envelope $E_2(m,i)$ in the band $k_x \le m \le k_{max}$ of the frame s.

$$C(s)=1 \quad \text{[Equation 76]}$$

Note that the second alternative example of the speech decoder 101 according to the second embodiment is also applicable to the first alternative example of the speech decoder 101 according to the second embodiment and the speech decoder according to the fourth embodiment.

Third Alternative Example of Speech Decoder According to Second Embodiment

Figure 39:
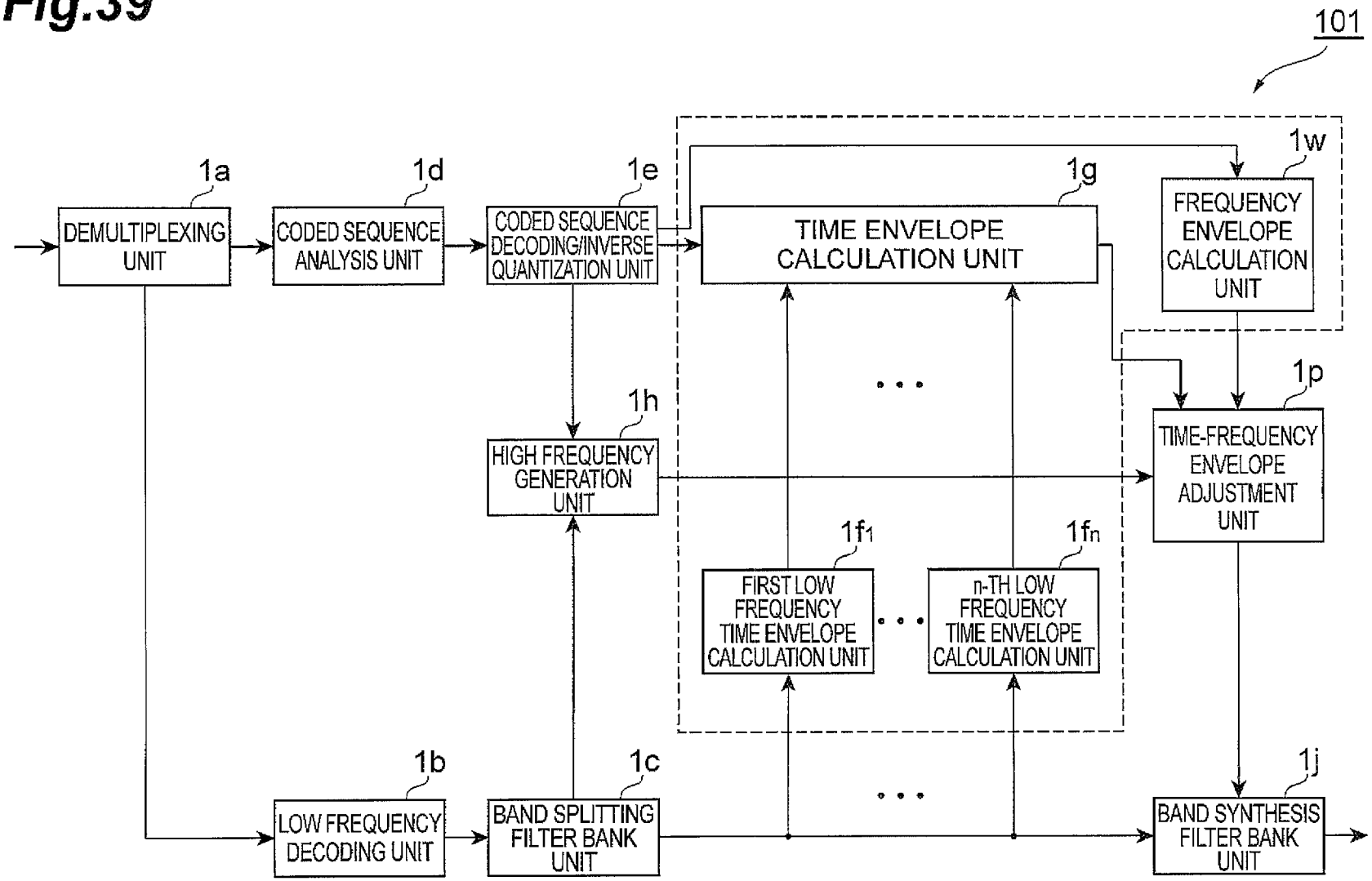
FIG. 39 is a diagram showing a configuration of a third alternative example of the speech decoder 101 according to the second embodiment.
Figure 40:
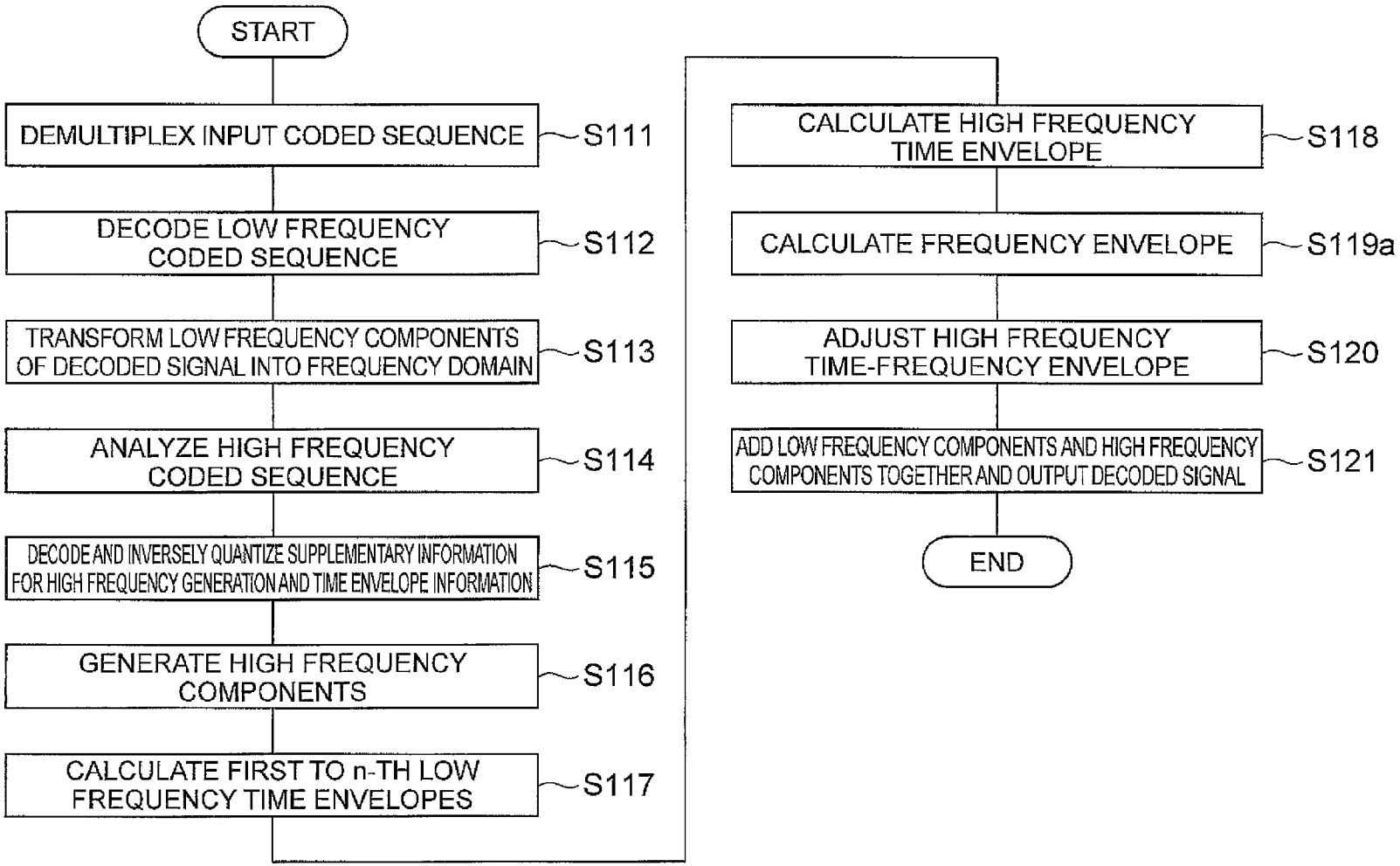
FIG. 40 is a flowchart showing a procedure of speech decoding performed by the speech decoder 101 shown in FIG. 39.

FIG. 39 is a diagram showing a configuration of a third alternative example of the speech decoder 101 according to the second embodiment, and FIG. 40 is a flowchart showing a procedure of speech decoding by the speech decoder 101 shown in FIG. 39. This alternative example is different from the speech decoder 101 according to the second embodiment in that it includes a frequency envelope calculation unit 1*w* in place of the frequency envelope superposition unit 1*q*.

The frequency envelope calculation unit 1*w* in this alternative example calculates the frequency envelope $E_1(m,s)$ in the same manner as the frequency envelope superposition unit 1*q* according to the second embodiment (Step S119*a*).

Then, the time-frequency envelope adjustment unit 1*p* adjusts the time-frequency envelope as follows, for example, using the time envelope $E_T(l,i)$ and the frequency envelope $E_1(m,s)$ (Step S120).

Specifically, the time-frequency envelope adjustment unit 1*p* transforms the time envelope $E_T(l,i)$ into $E_0(m,i)$ in the same manner as the frequency envelope superposition unit 1*q*.

Further, in the same manner as HF adjustment in SBR of "MPEG4 AAC", the noise floor scale factor Q(m,s) in the frame s supplied from the coded sequence decoding/dequantization unit 1*e* is transformed by the following equation.

$$Q_2(m, s) = \sqrt{E_1(m, s) \frac{Q(m, s)}{1 + Q(m, s)}} \quad \text{[Equation 77]}$$

$$0 \le m < M,\ 0 \le s < s_E$$

Further, the level of sinusoid in the frame s is given by the following equation using the quantity S(m,s) calculated by a parameter that determines whether or not to add a sinusoid and that is supplied from the coded sequence decoding/dequantization unit 1*e*.

$$S_2(m, s) = \sqrt{E_1(m, s) \frac{S(m, s)}{1 + Q(m, s)}} \quad \text{[Equation 78]}$$

$$0 \le m < M,\ 0 \le s < s_E$$

Further, the gain is given by the following equation using the frequency envelope $E_1(m,s)$, the noise floor scale factor Q(m,s) in the frame s supplied from the coded sequence decoding/dequantization unit 1*e*, and the function δ(s) that depends on the parameter of the frame s supplied from the coded sequence decoding/dequantization unit 1*e*.

$$G(m, s) = \begin{cases} \sqrt{\dfrac{E_1(m, s)}{(\varepsilon + E_{curr}(m, s))(1 + \delta(s) \cdot Q(m, s))}} & \text{if } S'(m, s) = 0 \\ \sqrt{\dfrac{E_1(m, s)}{(\varepsilon + E_{curr}(m, s))} \dfrac{Q(m, s)}{(1 + Q(m, s))}} & \text{if } S'(m, s) \ne 0 \end{cases} \quad \text{[Equation 79]}$$

$$0 \le m < M,\ 0 \le s < s_E$$

The quantity $E_{curr}(m,s)$ is defined by the following equation.

$$E_{curr}(m, s) = \frac{\sum_{i=t(s)}^{t(s+1)-1} \sum_{j=k_l}^{k_h} |X_H(j, i)|^2}{(t(s+1) - t(s))(k_h - k_l + 1)}, \quad \text{[Equation 80]}$$

$$k_l - k_x \le m \le k_h - k_x,$$

$$\begin{cases} k_l = G_H(k) \\ k_h = G_H(k+1) - 1 \end{cases},\ 1 \le k \le m_H$$

$$0 \le l < n_H,\ 0 \le s < s_E$$

It may be defined also by the following equation.

$$E_{curr}(m, s) = \frac{\sum_{i=t(s)}^{t(s+1)-1} |X_H(m + k_x, i)|^2}{(t(s+1) - t(s))}, \quad \text{[Equation 81]}$$

$$0 \le m < M,\ 0 \le s < s_E$$

Further, S'(m,s) is the function that represents whether there is a sinusoid to be added in the sub-band $B^{(F)}_k$ ($G_H(k) \le m < G_H(k+1)$) including the frequency represented by the index m in the frame s, and it is "1" when there is a sinusoid to be added and "0" otherwise.

Further, the following quantity $X'_H(m+k_x,i)$ can be calculated using the above-described quantity $E_{curr}(m,s)$.

$$X'_H(m+k_x,i)=\frac{X_H(m+k_x,i)}{\sqrt{|X_H(m+k_x,i)|^2}}\sqrt{E_{curr}(m,s)},\quad 0\le m<M,\ t(s)\le i<t(s+1),\ 0\le s<s_E \qquad \text{[Equation 82]}$$

Alternatively, the quantity $X'_H(m+k_x,i)$ can be calculated also by the following equation.

$$X'_H(m+k_x,i)=\frac{X_H(m+k_x,i)}{\sqrt{\frac{1}{k_h-k_l+1}\sum_{j=k_l}^{k_h}|X_H(j,i)|^2}}\sqrt{E_{curr}(m,s)},\quad k_l-k_x\le m\le k_h-k_x,\quad \begin{cases}k_l=G_H(k)\\k_h=G_H(k+1)-1\end{cases},\ 1\le k\le m_H,\quad t(s)\le i<t(s+1),\ 0\le s<s_E \qquad \text{[Equation 83]}$$

The quantity $X'_H(m+k_x,i)$ can be calculated also from the following equation.

$$X'_H(m+k_x,i)=\frac{X_H(m+k_x,i)}{\sqrt{\sum_{j=k_l}^{k_h}|X_H(j,i)|^2}}\sqrt{\sum_{n=k_l-k_x}^{k_h-k_x}E_{curr}(n,s)},\quad k_l-k_x\le m\le k_h-k_x,\quad \begin{cases}k_l=G_H(k)\\k_h=G_H(k+1)-1\end{cases},\ 1\le k\le m_H,\quad t(s)\le i<t(s+1),\ 0\le s<s_E \qquad \text{[Equation 84]}$$

In this processing, the high frequency band signal $X_H(m+k_x,i)$ can be smoothed in the time direction in the frequency index m or the sub-band $B^{(F)}_k$. Thus, by performing the subsequent processing, the high frequency band signal on the basis of the time envelope calculated in the time envelope calculation unit 1g can be output without depending on the time envelope of the high frequency band signal $X_H(m+k_x,i)$.

Note that the gain $G_2(m,s)$, the noise floor scale factor $Q_3(m,s)$ and the sinusoid level $S_3(m,s)$ can be calculated by performing processing based on a specific function on the above-described gain, the noise floor scale factor and the sinusoid level. For example, in the same manner as the HF adjustment in SBR of "MPEG4 AAC", processing based on the function of limitation to the gain for avoiding the unneeded addition of noise (gain limiter) and compensation for the energy loss by the gain limitation (gain booster) is performed on the above-described gain, the noise floor scale factor and the sinusoid level to thereby calculate the gain $G_2(m,s)$, the noise floor scale factor $Q_3(m,s)$ and the sinusoid level $S_3(m,s)$ (see ISO/IEC 1449-3 4.6.18.7.5 for a specific example). In the case of performing the above specified processing, $G_2(m,s)$, $Q_3(m,s)$ and $S_3(m,s)$ are used instead of $G(m,s)$, $Q_2(m,s)$ and $S_2(m,s)$ in the subsequent processing.

The quantities $G_3(m,i)$ and $Q_4(m,i)$ given by the following equation are calculated using the gain $G(m,s)$, the noise floor scale factor $Q_2(m,s)$ and the time envelope $E_0(m,i)$ obtained as above. In the following equation, the gain and the noise floor scale factor are calculated based on the time envelope, and, after the subsequent processing, the signal with the time-frequency envelope adjusted by the time-frequency envelope adjustment unit 1p can be finally output.

$$G_3(m,i)=\sqrt{E_0(m,i)}\cdot G(m,s)\quad 0\le m<M,\ t(s)\le i<t(s+1),\ 0\le s<s_E \qquad \text{[Equation 85]}$$

$$Q_4(m,i)=\sqrt{E_0(m,i)}\cdot Q_2(m,s)\quad 0\le m<M,\ t(s)\le i<t(s+1),\ 0\le s<s_E \qquad \text{[Equation 86]}$$

Note that, although the gain and the noise floor scale factor are calculated based on the time envelope in the above equation, the sinusoid level can be calculated also based on the time envelope in the same manner as the gain and the noise floor scale factor.

Further, processing based on a specified function can be performed on the above-described $G_3(m,i)$ and $Q_4(m,i)$. For example, processing based on a function of smoothing may be performed. $G_{Filt}(m,i)$ and $Q_{Filt}(m,i)$ given by the following equations are calculated.

$$G_{Filt}(m,i)=\sum_{j=0}^{d_h}G_{Temp}(m,i-j+d_h)\cdot sc_h(j)\quad 0\le m<M,\ t(s)\le i<t(s+1),\ 0\le s<s_E \qquad \text{[Equation 87]}$$

$$Q_{Filt}(k,i)=\sum_{j=0}^{d_h}Q_{Temp}(m,i-j+d_h)\cdot sc_h(j)\quad 0\le m<M,\ t(s)\le i<t(s+1),\ 0\le s<s_E \qquad \text{[Equation 88]}$$

where $sc_h(j)$ and $d_h$ are a specified coefficient of smoothing and a specified order of smoothing, respectively. Further, $G_{Temp}(m,i)$ and $Q_{Temp}(m,i)$ are given by the following equations.

$$G_{Temp}(m,i+d_h)=\sqrt{E_0(m,i)}\cdot G(m,s)\quad 0\le m<M,\ t(s)\le i\le t(s+1),\ 0\le s<s_E \qquad \text{[Equation 89]}$$

$$Q_{Temp}(m,i+d_h)=\sqrt{E_0(m,i)}\cdot Q_2(m,s)\quad 0\le m<M,\ t(s)\le i<t(s+1),\ 0\le s<s_E \qquad \text{[Equation 90]}$$

Furthermore, the effect of smoothing can be equally obtained by processing based on the following functions.

$$G_{Filt}(m,i)=G_{old}(m)\cdot w_{old}(m,i)+G_{Temp}(m,i)\cdot w_{curr}(m,i)\quad 0\le m<M,\ t(s)\le i<t(s+1),\ 0\le s<s_E \qquad \text{[Equation 91]}$$

$$Q_{Filt}(m,i)=Q_{old}(m)\cdot w_{old}(m,i)+Q_{Temp}(m,i)\cdot w_{curr}(m,i)\quad 0\le m<M,\ t(s)\le i<t(s+1),\ 0\le s<s_E \qquad \text{[Equation 92]}$$

where $w_{old}(m,i)$ and $w_{curr}(m,i)$ are specified weighting factors. Further, $G_{Temp}(m,i)$ and $Q_{Temp}(m, i)$ are given by the following equations.

$$G_{Temp}(m,i)=\sqrt{E_0(m,i)}\cdot G(m,s)$$

$$0\le m<M,\ t(s)\le i<t(s+1),\ 0\le s<s_E \qquad \text{[Equation 93]}$$

$$Q_{Temp}(m,i)=\sqrt{E_0(m,i)}\cdot Q_2(m,s)$$

$$0\le m<M,\ t(s)\le i<t(s+1),\ 0\le s<s_E \qquad \text{[Equation 94]}$$

Further, $G_{old}(m)$ is the gain of a time index (specifically, t(s)−1) in the previous frame (specifically, the frame s−1) at the boundary with the frame s and given by any of the following equations.

$$G_{old}(m)=G_{Temp}(m,t(s)-1)=\sqrt{E_0(m,t(s)-1)}\cdot G(m,s-1)$$

$$0\le m<M,\ 0\le s<s_E \qquad \text{[Equation 95]}$$

$$G_{old}(m)=G_{Filt}(m,t(s)-1)$$

$$0\le m<M,\ 0\le s<s_E \qquad \text{[Equation 96]}$$

In the case where the above-described processing based on a specified function is performed, $G_{Filt}(m,s)$ and $Q_{Filt}(m,s)$ are used instead of $G_3(m,s)$ and $Q_4(m,s)$ in the subsequence processing.

The above-described function of smoothing may include a function of determining whether or not to perform smoothing based on the parameter of the frame s supplied from the coded sequence decoding/dequantization unit 1*e*. Further, information indicating whether or not to perform smoothing may be included in the coded sequence, and the above-described function of smoothing may include a function of determining whether or not to perform smoothing based on the information. Furthermore, it may include a function of determining whether or not to perform smoothing based on at least one of the above.

Finally, the time-frequency envelope adjustment unit 1*p* obtains the signal with the adjusted time-frequency envelope by the following equations.

$$W_1(m,i)=G_3(m,i)\cdot X_H(m+k_x,i)$$

$$Re\{W_2(m,i)\}=Re\{W_1(m,i)\}+Q_4(m,i)\cdot V_0(f(i))$$

$$Im\{W_2(m,i)\}=Im\{W_1(m,i)\}+Q_4(m,i)\cdot V_1(f(i)) \qquad \text{[Equation 97]}$$

$$Re\{Y(m,i)\}=Re\{W_2(m,i)\}+\psi_{Re}(m,s,i)$$

$$Im\{Y(m,i)\}=Im\{W_2(m,i)\}+\psi_{Im}(m,s,i)$$

$$\psi_{Re}(m,s,i)=S_2(m,s)\cdot\psi_{Re,sin}(f_{sin}(i))$$

$$\psi_{Re}(m,s,i)=S_2(m,s)\cdot(-1)^{m+k_x}\cdot\phi_{Re,sin}(f_{sin}(i)) \qquad \text{[Equation 98]}$$

where $V_0$ and $V_1$ are arrays that specify a noise component, f is a function that maps the index i onto the index on the arrays, $\phi_{Re,sin}$ and $\phi_{Im,sin}$ are arrays that specify the phase of a sinusoid component, and $f_{sin}$ is a function that maps the index i onto the index on the arrays (see "ISO/IEC 14496-3 4.6.18" for a specific example).

Alternatively, in the above-described Equation 97, $X'_H(m+k_x,i)$ may be used in place of $X_H(m+k_x,i)$.

Note that, when the gain booster of HF adjustment in SBR of "MPEG4 AAC" described above is applied to the frequency envelope superposition unit 1*q* of the speech decoder 101 according to the second embodiment, the energy loss due to gain limitation is compensated in units of the frame s for each sub-band $B^{(F)}_k$ ($G_H(k)\le j<G_H(k+1)$). On the other hand, according to the following equation, the energy loss due to gain limitation is compensated in units of the time index i for the high frequency band signal $X_H(j,i)$ for each sub-band $B^{(F)}_k$ ($G_H(k)\le j<G_H(k+1)$).

$$G_{Boost_{temp}}(k,i)=\sqrt{\frac{\varepsilon+\sum_{j=G_H(k)}^{G_H(k-1)-1}E_1(j,s)}{\varepsilon+\sum_{j=G_H(k)}^{G_H(k+1)-1}\left(X_H^2(j,i)\cdot G^2(j,s)+S_2^2(j,s)+\delta(S_2(j,s),s)\cdot Q_2^2(j,s)\right)}} \qquad \text{[Equation 99]}$$

$$G_2(m,i)=G_{Boost_{Temp}}(k,i)\cdot G(m,s)$$

$$Q_3(m,i)=G_{Boost_{Temp}}(k,i)\cdot Q_2(m,s)$$

$$1\le k\le m_H,\ G_H(k)\le m+k_x<G_H(k+1),\ t(s)\le i<t(s+1),\ 0\le s<s_E$$

In the above-described equation, the gain limiter of HF adjustment in SBR of "MPEG4 AAC" described above may be applied to the gain G(m,s) and the noise scale factor $Q_2(m,s)$.

Using the gain $G_2(m,i)$ and the noise scale factor $Q_3(m,i)$, $G_{Temp}(m,i)$ and $Q_{Temp}(m,i)$ are given by the following equation instead of the above-described Equations 89 and 90.

$$G_{Temp}(m,i+d_h)=\sqrt{E_0(m,i)}\cdot G_2(m,i)$$

$$0\le m<M,\ t(s)\le i<t(s+1),\ 0\le s<s_E \qquad \text{[Equation 100]}$$

$$Q_{Temp}(m,i+d_h)=\sqrt{E_0(m,i)}\cdot Q_3(m,i)$$

$$0\le m<M,\ t(s)\le i<t(s+1),\ 0\le s<s_E \qquad \text{[Equation 101]}$$

Further, when Equation 99 is replaced with the following equation, the energy loss due to gain limitation is compensated in units of the time index i for the high frequency band signal $X_H(j,i)$ for each sub-band $B^{(T)}_k$ ($F_H(k)\le j<F_H(k+1)$).

[Equation 102]

$$G_{Boost_{Temp}}(k, i) = \sqrt{\frac{\varepsilon + \sum_{j=F_H(k)}^{F_H(k+1)-1} E_1(j, s)}{\varepsilon + \sum_{j=F_H(k)}^{F_H(k+1)-1} (X_H^2(j, i) \cdot G^2(j, s) + S_2^2(j, s) + \delta(S_2(j, s), s) \cdot Q_2^2(j, s))}}$$

$$G_2(m, i) = G_{Boost_{Temp}}(k, i) \cdot G(m, s)$$

$$Q_3(m, i) = G_{Boost_{Temp}}(k, i) \cdot Q_2(m, s)$$

$$1 \le k \le m_H,\ F_H(k) \le m + k_x < F_H(k+1),\ t(s) \le i < t(s+1),\ 0 \le s < s_E$$

Furthermore, when Equation 99 is replaced with the following equation, the energy loss due to gain limitation is compensated in units of the time index i for the high frequency band signal $X_H(j,i)$ for each frequency index m.

[Equation 103]

$$G_{Boost_{Temp}}(m, i) = \sqrt{\frac{\varepsilon + E_1(m, s)}{\varepsilon + (X_H^2(m + k_x, i) \cdot G^2(m, s) + S_2^2(m, s) + \delta(S_2(m, s), s) \cdot Q_2^2(m, s))}}$$

$$G_2(m, i) = G_{Boost_{Temp}}(m, i) \cdot G(m, s)$$

$$Q_3(m, i) = G_{Boost_{Temp}}(m, i) \cdot Q_2(m, s)$$

$$1 \le k \le m_H,\ 0 \le m < M,\ t(s) \le i < t(s+1),\ 0 \le s < s_E$$

Alternatively, when calculating the above quantity $G_{BoostTemp}(m.i)$, $X'_H(m+k_x,i)$ may be used instead of $X_H(m+k_x,i)$.

In the time-frequency envelope adjustment unit 1*p* of the speech decoder 101 according to the second embodiment, adjustment of the time-frequency envelope is performed by the similar way to the HF adjustment in SBR of "MPEG4 AAC" using the quantity E(m,i) received from the frequency envelope superposition unit 1*q*, in the same manner as performed by the time envelope adjustment unit 1*i* of the speech decoder 1 according to the first embodiment. Therefore, in the same manner as performed by the HF adjustment in SBR of "MPEG4 AAC", when a gain limiter operation for avoiding addition of unneeded noise is performed on a gain, a noise floor scale factor and a sinusoid level, and a gain booster operation is performed to compensate energy loss caused by the gain booster operation, these operations are performed on the time index $i(t(s) \le i < t(s+1))$. On the other hand, according to this alternative example, when a gain limiter operation for avoiding addition of unneeded noise is performed on a gain, a noise floor scale factor and a sinusoid level, and a gain booster operation is performed to compensate energy loss caused by the gain booster operation, at least one of these operations may be performed on the frame s. Thus, this alternative example allows reduction of the amount of operation for the above processing compared with the speech decoder 101 according to the second embodiment.

Note that the third alternative example of the speech decoder 101 according to the second embodiment is applicable also to the first and second alternative examples of the speech decoder 101 according to the second embodiment and the speech decoder according to the fourth embodiment.

Another Embodiment of Third Alternative Example of Speech Decoder 101 According to Second Embodiment In the case where the first, second and third alternative examples of the speech decoder 1 used in the first embodiment and the fifth alternative example of the speech decoder 1 used in the first embodiment which implements at least one of the above alternative examples are applied to the above-described alternative example, there is a case where the time envelope calculation unit 1*g* does not calculate the time envelope $E_T(l,i)$. In this case, the operation processing that requires $E_0(m,i)$ is performed by replacing $E_0(m,i)$ with 1. In this way, the processing of multiplying $E_0(m,i)$, the power of $E_0(m,i)$ and the square root of $E_0(m,i)$ can be omitted, thereby reducing the amount of computation. Note that, in the processing using the above method, the time-frequency envelope adjustment unit 1*p* does not need to calculate $E_0(m,i)$.

Sixth Alternative Example of Speech Encoder 2 According to First Embodiment The time envelope information calculation unit 2*f* calculates the time envelope information based on the characteristics of at least one signal of the signal X(j,i) in the frequency domain obtained from the band splitting filter bank unit 2*c*, an external input signal received through the communication device of the speech encoder 2, and the down-sampled low frequency band signal in the time domain obtained as an output from the down-sampling unit 2*a*. The signal characteristics may be transient characteristics, tonality, noise characteristics and the like of the signal, for example, through the signal characteristics are not limited to those specific examples in this alternative example.

Note that this alternative example is also applicable to the first to fifth alternative examples of the speech encoder 2 according to the first embodiment and the speech encoders according to the second to fourth embodiments.

Seventh Alternative Example of Speech Encoder 2 According to First Embodiment The time envelope calculation control information generation unit 2*j* generates the time envelope calculation control information related to the low frequency band time envelope calculation method in the speech decoder 1 according to the signal characteristics of at least one signal of the signal X(j,i) in the frequency domain obtained from the band splitting filter bank unit 2*c*, an external input signal received through the communication device of the speech encoder 2, and the down-sampled low frequency band signal in the time domain obtained as an output from the down-sampling unit 2*a*. The signal characteristics may be transient characteristics, tonality, noise characteristics and the like of the signal, for example, through the signal characteristics are not limited to those specific examples in this alternative example.

Note that this alternative example is also applicable to the first to sixth alternative examples of the speech encoder 2 according to the first embodiment and the speech encoders according to the second to fourth embodiments.

Quantization/Encoding Unit of Speech Encoder According to First to Fourth Embodiments In the quantization/encoding unit 2*g* of the speech encoder according to the first to fourth embodiments, the noise floor scale factor, and the parameter that determines whether or not to add a sinusoid may be quantized and encoded as a matter of course.

INDUSTRIAL APPLICABILITY

The present invention is used for a speech decoder, a speech encoder, a speech decoding method, a speech encoding method, a speech decoding program, and a speech encoding program, and it is possible to adjust the time envelope of a decoded signal into a less distorted shape and thereby obtain a reproduced signal in which pre-echo and post-echo are sufficiently reduced.

REFERENCE SIGNS LIST

1$f_1$~1$f_n$ . . . frequency band time envelope calculation unit, 2$e_1$~2$e_n$ . . . low frequency band time envelope calculation unit, 1, 102, 201, 301 . . . speech decoder, 1*a* . . . demultiplexing unit, 1*b* . . . low frequency band decoding unit, 1*c* . . . band splitting filter bank unit, 1*d* . . . coded sequence analysis unit, 1*e* . . . dequantization unit, 1*g* . . . time envelope calculation unit, 1*h* . . . high frequency band generation unit, 1*i* . . . time envelope adjustment unit, 1*j* . . . band synthesis filter bank unit, 1*k*, 1*m*, 1*n*, 1*o* . . . time envelope calculation control unit, 1*p*, 1*v* . . . time-frequency envelope adjustment unit, 1*q* . . . frequency envelope superposition unit, 1*r* . . . coded sequence decoding/dequantization unit, 1*s* . . . time envelope calculation control unit, 1*t* . . . envelope adjustment unit, 1*u* . . . frequency envelope superposition unit, 1*w* . . . frequency envelope calculation unit, 2, 102, 202, 302 . . . speech encoder, 2*a* . . . down-sampling unit, 2*b* . . . low frequency band encoding unit, 2*c* . . . band splitting filter bank unit, 2*d* . . . supplementary information for high frequency band generation calculation unit, 2$e_1$~2$e_k$ . . . low frequency band time envelope calculation unit, 2*f* . . . time envelope information calculation unit, 2*g* . . . quantization/encoding unit, 2*h* . . . high frequency band coded sequence construction unit, 2*i* . . . multiplexing unit, 2*j* . . . time envelope calculation control information generation unit, 2*k* . . . low frequency band decoding unit, 2*m* . . . band synthesis filter bank unit, 2*n*, 2*o*, 2*p* . . . frequency envelope information calculation unit.

The invention claimed is:

1. A speech decoder that decodes a coded sequence of encoded speech signal, comprising:

a demultiplexing unit for demultiplexing the coded sequence into a low frequency band coded sequence and a high frequency band coded sequence;

a low frequency band decoding unit for decoding the low frequency band coded sequence demultiplexed by the demultiplexing unit and obtaining a low frequency band signal;

a frequency transformation unit for transforming the low frequency band signal, which is obtained by the low frequency band decoding unit, into a frequency domain;

a high frequency band coded sequence analysis unit for analyzing the high frequency band coded sequence demultiplexed by the demultiplexing unit and acquiring supplementary information for high frequency band generation and time envelope information;

a coded sequence decoding and dequantization unit for decoding and inversely quantizing the supplementary information for high frequency band generation and the time envelope information acquired by the high frequency band coded sequence analysis unit;

a high frequency band generation unit for generating, using the supplementary information for high frequency band generation decoded by the coded sequence decoding and dequantization unit, high frequency band components in the speech signal from the low frequency band signal transformed into the frequency domain by the frequency transformation unit;

a first to Nth (N is an integer equal to or larger than two) low frequency band time envelope calculation unit for analyzing the low frequency band signal transformed into the frequency domain by the frequency transformation unit and acquiring time envelopes for a plurality of low frequency bands;

a time envelope calculation unit for calculating a high frequency band time envelope using the time envelope information, which is acquired by the coded sequence decoding and dequantization unit, and the plurality of low frequency band time envelopes, which are acquired by the low frequency band time envelope calculation unit;

a time envelope adjustment unit for adjusting, using the time envelope acquired by the time envelope calculation unit, a time envelope of the high frequency band components generated by the high frequency band generation unit; and a signal outputting unit for adding the high frequency band components, which are adjusted by the time envelope adjustment unit, and the low frequency band signal, which is decoded by the low frequency band decoding unit, and outputting a time domain signal containing entire frequency band components.

2. A speech decoder that decodes a coded sequence of encoded speech signal, comprising:

a demultiplexing unit for demultiplexing the coded sequence into a low frequency band coded sequence and a high frequency band coded sequence;

a low frequency band decoding unit for decoding the low frequency band coded sequence demultiplexed by the demultiplexing unit and obtaining a low frequency band signal;

a frequency transformation unit for transforming the low frequency band signal, which is obtained by the low frequency band decoding unit, into a frequency domain;

a high frequency band coded sequence analysis unit for analyzing the high frequency band coded sequence demultiplexed by the demultiplexing unit and acquiring coded supplementary information for high frequency band generation, frequency envelope information, and time envelope information;

a coded sequence decoding and dequantization unit for decoding and inversely quantizing the supplementary information for high frequency band generation, the frequency envelope information, and the time envelope information acquired by the high frequency band coded sequence analysis unit;

a high frequency band generation unit for generating, using the supplementary information for high frequency band generation decoded by the coded sequence decoding and dequantization unit, high frequency band components in the speech signal from the low frequency band signal transformed into the frequency domain by the frequency transformation unit;

a first to Nth (N is an integer equal to or larger than two) low frequency band time envelope calculation unit for analyzing the low frequency band signal transformed into the frequency domain by the frequency transformation unit and acquiring time envelopes for a plurality of low frequency bands;

a time envelope calculation unit for calculating a high frequency band time envelope using the time envelope information, which is acquired by the coded sequence decoding and dequantization unit, and the plurality of low frequency band time envelopes, which are acquired by the low frequency band time envelope calculation unit;

a frequency envelope superposition unit for superimposing the frequency envelope information, which is acquired by the coded sequence decoding and dequantization unit, onto the high frequency band time envelope and acquiring a time-frequency envelope;

a time-frequency envelope adjustment unit for adjusting, using the time envelope acquired by the time envelope calculation unit and the time-frequency envelope acquired by the frequency envelope superposition unit, a time envelope and a frequency envelope of the high frequency band components generated by the high frequency band generation unit; and a signal outputting unit for adding the high frequency band components, which are adjusted by the time-frequency envelope adjustment unit, and the low frequency band signal, which is decoded by the low frequency band decoding unit, and outputting a time domain signal containing entire frequency band components.

3. A speech decoder that decodes a coded sequence of encoded speech signal, comprising:

a demultiplexing unit for demultiplexing the coded sequence into a low frequency band coded sequence and a high frequency band coded sequence;

a low frequency band decoding unit for decoding the low frequency band coded sequence demultiplexed by the demultiplexing unit and obtaining a low frequency band signal;

a frequency transformation unit for transforming the low frequency band signal, which is obtained by the low frequency band decoding unit, into a frequency domain;

a high frequency band coded sequence analysis unit for analyzing the high frequency band coded sequence demultiplexed by the demultiplexing unit and acquiring coded supplementary information for high frequency band generation, frequency envelope information, and time envelope information;

a coded sequence decoding and dequantization unit for decoding and inversely quantizing the supplementary information for high frequency band generation, the frequency envelope information, and the time envelope information acquired by the high frequency band coded sequence analysis unit;

a high frequency band generation unit for generating, using the supplementary information for high frequency band generation decoded by the coded sequence decoding and dequantization unit, high frequency band components in the speech signal from the low frequency band signal transformed into the frequency domain by the frequency transformation unit;

a first to Nth (N is an integer equal to or larger than two) low frequency band time envelope calculation unit for analyzing the low frequency band signal transformed into the frequency domain by the frequency transformation unit and acquiring time envelopes for a plurality of low frequency bands;

a time envelope calculation unit for calculating a high frequency band time envelope using the time envelope information, which is acquired by the coded sequence decoding and dequantization unit and the plurality of low frequency band time envelopes, which is acquired by the low frequency band time envelope calculation unit;

a frequency envelope calculation unit for calculating a frequency envelope using the frequency envelope information acquired by the coded sequence decoding and dequantization unit;

a time-frequency envelope adjustment unit for adjusting, using the time envelope acquired by the time envelope calculation unit and the frequency envelope acquired by the frequency envelope calculation unit, a time envelope and a frequency envelope of the high frequency band components generated by the high frequency band generation unit; and a signal outputting unit for adding the high frequency band components, which are adjusted by the time-frequency envelope adjustment unit, and the low frequency band signal, which is decoded by the low frequency band decoding unit, and outputting a time domain signal containing entire frequency band components.

4. The speech decoder according to claim 1, further comprising:

a time envelope calculation control unit for controlling, using the low frequency band signal transformed into the frequency domain by the frequency transformation unit, at least one of (i) calculation of the low frequency band time envelopes in the first to Nth low frequency band time envelope calculation unit and (ii) calculation of the high frequency band time envelope in the time envelope calculation unit.

5. The speech decoder according to claim 1, further comprising:

a time envelope calculation control unit for controlling, using the time envelope information acquired by the coded sequence decoding and dequantization unit, at least one of (i) calculation of the low frequency band time envelopes in the first to Nth low frequency band time envelope calculation unit and (ii) calculation of the high frequency band time envelope in the time envelope calculation unit.

6. The speech decoder according to claim 1, wherein the high frequency band coded sequence analysis unit further acquires time envelope calculation control information, and the speech decoder further comprises time envelope calculation control unit for controlling, using the time envelope calculation control information acquired by the high frequency band coded sequence analysis unit, at least one of (i) calculation of the low frequency band time envelopes in the first to Nth low frequency band time envelope calculation unit and (ii) calculation of the high frequency band time envelope in the time envelope calculation unit.

7. The speech decoder according to claim 1, wherein the high frequency band coded sequence analysis unit further acquires time envelope calculation control information, the coded sequence decoding and dequantization unit further acquires second frequency envelope information, and the speech decoder further comprises time envelope calculation control unit for determining, based on the time envelope calculation control information, whether to adjust the frequency envelope of the high frequency band components based on the second frequency envelope information and, when it is determined to adjust the frequency envelope, controlling not to perform calculation of the low frequency band time envelopes in the first to Nth low frequency band time envelope calculation unit or calculation of the high frequency band time envelope in the time envelope calculation unit.

8. The speech decoder according to claim 2, wherein the time-frequency envelope adjustment unit processes, with a specified function, the high frequency band components of the speech signal generated by the high frequency band generation unit.

9. The speech decoder according to claim 1, wherein the low frequency band time envelope calculation unit processes, with a specified function, the acquired plurality of low frequency band time envelopes.

10. A speech encoder that encodes a speech signal, comprising:

a frequency transformation unit for transforming the speech signal into a frequency domain;

a down-sampling unit for down-sampling the speech signal and acquiring a low frequency band signal;

a low frequency band encoding unit for encoding the low frequency band signal acquired by the down-sampling unit;

a first to Nth (N is an integer equal to or larger than two) low frequency band time envelope calculation unit for calculating a plurality of time envelopes of low frequency band components of the speech signal transformed into the frequency domain by the frequency transformation unit;

a time envelope information calculation unit for calculating, using the time envelopes of the low frequency band components calculated by the first to Nth low frequency band time envelope calculation unit, time envelope information necessary to acquire a time envelope of high frequency band components of the speech signal transformed by the frequency transformation unit;

a supplementary information calculation unit for analyzing the speech signal and calculating supplementary information for high frequency band generation to be used for generating high frequency band components from the low frequency band signal;

a quantization and encoding unit for quantizing and encoding the supplementary information for high frequency band generation, which is generated by the supplementary information calculation unit, and the time envelope information, which is calculated by the time envelope information calculation unit;

a coded sequence construction unit for constructing a high frequency band coded sequence from the supplementary information for high frequency band generation and the time envelope information quantized and encoded by the quantization and encoding unit; and a multiplexing unit for generating a coded sequence in which the low frequency band coded sequence, which is acquired by the low frequency band encoding unit, and the high frequency band coded sequence, which is constructed by the coded sequence construction unit, are multiplexed.

11. The speech encoder according to claim 10, further comprising:

a frequency envelope calculation unit for calculating frequency envelope information of the high frequency band components of the speech signal transformed into the frequency domain by the frequency transformation unit, wherein the quantization and encoding unit further quantizes and encodes the frequency envelope information, and the coded sequence construction unit constructs the high frequency band coded sequence by further adding the frequency envelope information quantized and encoded by the quantization and encoding unit.

12. The speech encoder according to claim 10, further comprising:

a control information generation unit for generating time envelope calculation control information that controls time envelope calculation in a speech decoder using at least one of (i) the speech signal transformed into the frequency domain by the frequency transformation unit and (ii) the time envelope information calculated by the time envelope information calculation unit, wherein the coded sequence construction unit constructs the high frequency band coded sequence by further adding the time envelope calculation control information generated by the control information generation unit.

13. The speech encoder according to claim 10, wherein the time envelope information calculation unit calculates a time envelope of high frequency band components of the speech signal transformed into the frequency domain by the frequency transformation unit, and calculates the time envelope information based on correlation between a time envelope calculated from the first to Nth time envelopes of low frequency band components and the time envelope of the frequency components.

14. A speech decoding method of decoding a coded sequence generated by encoding a speech signal, comprising:

a demultiplexing step, performed by a demultiplexing unit, of demultiplexing the coded sequence into a low frequency band coded sequence and a high frequency band coded sequence;

a low frequency band decoding step, performed by a low frequency band decoding unit, of decoding the low frequency band coded sequence demultiplexed by the demultiplexing unit and obtaining a low frequency band signal;

a frequency transformation step, performed by a frequency transformation unit, of transforming the low frequency band signal obtained by the low frequency band decoding unit into a frequency domain;

a high frequency band coded sequence analysis step, performed by a high frequency band coded sequence analysis unit, of analyzing the high frequency band coded sequence demultiplexed by the demultiplexing unit and acquiring coded supplementary information for high frequency band generation and time envelope information;

a coded sequence decoding and dequantization step, performed by coded sequence decoding and dequantization unit, of decoding and inversely quantizing the supplementary information for high frequency band generation and the time envelope information acquired by the high frequency band coded sequence analysis unit;

a high frequency band generation step, performed by a high frequency band generation unit, of generating, using the supplementary information for high frequency band generation decoded by the coded sequence decoding and dequantization unit, high frequency band components in the speech signal from the low frequency band signal transformed into the frequency domain by the frequency transformation unit;

a first to Nth (N is an integer equal to or larger than two) low frequency band time envelope calculation step, performed by a first to Nth low frequency band time envelope calculation unit, of analyzing the low frequency band signal transformed into the frequency domain by the frequency transformation unit and acquiring a plurality of low frequency band time envelopes;

a time envelope calculation step, performed by a time envelope calculation unit, of calculating a high frequency band time envelope using the time envelope information, which is acquired by the coded sequence decoding and dequantization unit, and the plurality of low frequency band time envelopes, which are acquired by the low frequency band time envelope calculation unit;

a time envelope adjustment step, performed by the time envelope adjustment unit, of adjusting a time envelope of the high frequency band components generated by the high frequency band generation unit using the time envelope acquired by the time envelope calculation unit; and a signal outputting step, performed by a signal outputting unit, of adding the high frequency band components, which are adjusted by the time envelope adjustment unit, and the low frequency band signal, which is decoded by the low frequency band decoding unit, and outputting a time domain signal containing the entire frequency band components.

15. A speech decoding method of decoding a coded sequence generated by encoding a speech signal, comprising:

a demultiplexing step, performed by a demultiplexing unit, of demultiplexing the coded sequence into a low frequency band coded sequence and a high frequency band coded sequence;

a low frequency band decoding step, performed by a low frequency band decoding unit, of decoding the low frequency band coded sequence demultiplexed by the demultiplexing unit and obtaining a low frequency band signal;

a frequency transformation step, performed by a frequency transformation unit, of transforming the low frequency band signal, which is obtained by the low frequency band decoding unit, into a frequency domain;

a high frequency band coded sequence analysis step, performed by a high frequency band coded sequence analysis unit, of analyzing the high frequency band coded sequence demultiplexed by the demultiplexing unit and acquiring coded supplementary information for high frequency band generation, frequency envelope information, and time envelope information;

a coded sequence decoding and dequantization step, performed by a coded sequence decoding and dequantization unit, of decoding and inversely quantizing the supplementary information for high frequency band generation, the frequency envelope information, and the time envelope information acquired by the high frequency band coded sequence analysis unit;

a high frequency band generation step, performed by a high frequency band generation unit, of generating, using the supplementary information for high frequency band generation decoded by the coded sequence decoding and dequantization unit, high frequency band components in the speech signal from the low frequency band signal transformed into the frequency domain by the frequency transformation unit;

a first to Nth (N is an integer of two or more) low frequency band time envelope calculation step, performed by a first to Nth low frequency band time envelope calculation unit, of analyzing the low frequency band signal transformed into the frequency domain by the frequency transformation unit and acquiring a plurality of low frequency band time envelopes;

a time envelope calculation step, performed by a time envelope calculation unit, of calculating a high frequency band time envelope using the time envelope information, which is acquired by the coded sequence decoding and dequantization unit, and the plurality of low frequency band time envelopes, which are acquired by the low frequency band time envelope calculation unit;

a frequency envelope superposition step, performed by a frequency envelope superposition unit, of superimposing the frequency envelope information, which is acquired by the coded sequence decoding and dequantization unit, onto the high frequency band time envelope and acquiring a time-frequency envelope;

a time-frequency envelope adjustment step, performed by a time-frequency envelope adjustment unit, of adjusting, using the time envelope acquired by the time envelope calculation unit and the time-frequency envelope acquired by the frequency envelope superposition unit, a time envelope and a frequency envelope of the high frequency band components generated by the high frequency band generation unit; and a signal outputting step, performed by a signal outputting unit, of adding the high frequency band components, which are adjusted by the time-frequency envelope adjustment unit, and the low frequency band signal, which is decoded by the low frequency band decoding unit, and outputting a time domain signal containing entire frequency band components.

16. A speech decoding method of decoding a coded sequence generated by encoding a speech signal, comprising:

a demultiplexing step, performed by a demultiplexing unit, of demultiplexing the coded sequence into a low frequency band coded sequence and a high frequency band coded sequence;

a low frequency band decoding step, performed by a low frequency band decoding unit, of decoding the low frequency band coded sequence demultiplexed by the demultiplexing unit and obtaining a low frequency band signal;

a frequency transformation step, performed by a frequency transformation unit, of transforming the low frequency band signal, which is obtained by the low frequency band decoding unit, into a frequency domain;

a high frequency band coded sequence analysis step, performed by a high frequency band coded sequence analysis unit, of analyzing the high frequency band coded sequence demultiplexed by the demultiplexing unit and acquiring coded supplementary information for high frequency band generation, frequency envelope information, and time envelope information;

a coded sequence decoding and dequantization step, performed by a coded sequence decoding and dequantization unit, of decoding and inversely quantizing the supplementary information for high frequency band generation, the frequency envelope information, and the time envelope information acquired by the high frequency band coded sequence analysis unit;

a high frequency band generation step, performed by a high frequency band generation unit, of generating, using the supplementary information for high frequency band generation decoded by the coded sequence decoding and dequantization unit, high frequency band components in the speech signal from the low frequency band signal transformed into the frequency domain by the frequency transformation unit;

a first to Nth (N is an integer equal to or larger than two) low frequency band time envelope calculation step, performed by a first to Nth low frequency band time envelope calculation unit, of analyzing the low frequency band signal transformed into the frequency domain by the frequency transformation unit and acquiring a plurality of low frequency band time envelopes;

a time envelope calculation step, performed by a time envelope calculation unit, of calculating a high frequency band time envelope using the time envelope information, which is acquired by the coded sequence decoding and dequantization unit, and the plurality of low frequency band time envelopes, which are acquired by the low frequency band time envelope calculation unit;

a frequency envelope calculation step, performed by a frequency envelope calculation unit, of calculating a frequency envelope using the frequency envelope information acquired by the coded sequence decoding and dequantization unit;

a time-frequency envelope adjustment step, performed by a time-frequency envelope adjustment unit, of adjusting, using the time envelope acquired by the time envelope calculation unit and the frequency envelope acquired by the frequency envelope calculation unit, a time envelope and a frequency envelope of the high frequency band components generated by the high frequency band generation unit; and a signal outputting step, performed by a signal outputting unit, of adding the high frequency band components, which are adjusted by the time-frequency envelope adjustment unit, and the low frequency band signal, which is decoded by the low frequency band decoding unit, and outputting a time domain signal containing entire frequency band components.

17. A speech encoding method of encoding a speech signal, comprising:

a frequency transformation step, performed by a frequency transformation unit, of transforming the speech signal into a frequency domain;

a down-sampling step, performed by a down-sampling unit, of down-sampling the speech signal and acquiring a low frequency band signal;

a low frequency band encoding step, performed by a low frequency band encoding unit, of encoding the low frequency band signal acquired by the down-sampling unit;

a first to Nth (N is an integer equal to or larger than two) low frequency band time envelope calculation step, performed by first to Nth low frequency band time envelope calculation unit, of calculating a plurality of time envelopes of low frequency band components of the speech signal transformed into the frequency domain by the frequency transformation unit;

a time envelope information calculation step, performed by a time envelope information calculation unit, of calculating, using the time envelopes of the low frequency band components calculated by the first to Nth low frequency band time envelope calculation unit, time envelope information necessary to acquire a time envelope of high frequency band components of the speech signal transformed by the frequency transformation unit;

a supplementary information calculation step, performed by a supplementary information calculation unit, of analyzing the speech signal and calculating supplementary information for high frequency band generation to be used for generating high frequency band components from the low frequency band signal;

a quantization and encoding step, performed by quantization and encoding unit, of quantizing and encoding the supplementary information for high frequency bands generation, which is generated by the supplementary information calculation unit, and the time envelope information, which is calculated by the time envelope information calculation unit;

a coded sequence construction step, performed by a coded sequence construction unit, of constructing a high frequency band coded sequence from the supplementary information for high frequency band generation and the time envelope information quantized and encoded by the quantization and encoding unit; and a multiplexing step, performed by a multiplexing unit, of generating a coded sequence in which the low frequency band coded sequence, which is acquired by the low frequency band encoding unit, and the high frequency band coded sequence, which is constructed by the coded sequence construction unit, are multiplexed.

18. A non-transitory storage medium for storing a speech decoding program that decodes a coded sequence of encoded speech signal, the program causing a computer to function as:

a demultiplexing unit for demultiplexing the coded sequence into a low frequency band coded sequence and a high frequency band coded sequence;

a low frequency band decoding unit for decoding the low frequency band coded sequence demultiplexed by the demultiplexing unit and obtaining a low frequency band signal;

a frequency transformation unit for transforming the low frequency band signal obtained by the low frequency band decoding unit into a frequency domain;

a high frequency band coded sequence analysis unit for analyzing the high frequency band coded sequence demultiplexed by the demultiplexing unit and acquiring coded supplementary information for high frequency band generation and time envelope information;

a coded sequence decoding and dequantization unit for decoding and inversely quantizing the supplementary information for high frequency band generation and the time envelope information acquired by the high frequency band coded sequence analysis unit;

a high frequency band generation unit for generating, using the supplementary information for high frequency band generation decoded by the coded sequence decoding and dequantization unit, high frequency band components in the speech signal from the low frequency band signal transformed into the frequency domain by the frequency transformation unit;

a first to Nth (N is an integer equal to or larger than two) low frequency band time envelope calculation unit for analyzing the low frequency band signal transformed into the frequency domain by the frequency transformation unit and acquiring a plurality of low frequency band time envelopes;

a time envelope calculation unit for calculating a high frequency band time envelope using the time envelope information, which is acquired by the coded sequence decoding and dequantization unit, and the plurality of low frequency band time envelopes, which are acquired by the low frequency band time envelope calculation unit;

a time envelope adjustment unit for adjusting, using the time envelope acquired by the time envelope calculation unit, a time envelope of the high frequency band components generated by the high frequency band generation unit; and a signal outputting unit for adding the high frequency band components, which are adjusted by the time envelope adjustment unit, and the low frequency band signal, which is decoded by the low frequency band decoding unit, and outputting a time domain signal containing entire frequency band components.

19. A non-transitory storage medium for storing a speech decoding program that decodes a coded sequence of encoded speech signal, the program causing a computer to function as:

a demultiplexing unit for demultiplexing the coded sequence into a low frequency band coded sequence and a high frequency band coded sequence;

a low frequency band decoding unit for decoding the low frequency band coded sequence demultiplexed by the demultiplexing unit and obtaining a low frequency band signal;

a frequency transformation unit for transforming the low frequency band signal obtained by the low frequency band decoding unit into a frequency domain;

a high frequency band coded sequence analysis unit for analyzing the high frequency band coded sequence demultiplexed by the demultiplexing unit and acquiring coded supplementary information for high frequency band generation, frequency envelope information, and time envelope information;

a coded sequence decoding and dequantization unit for decoding and inversely quantizing the supplementary information for high frequency band generation, the frequency envelope information, and the time envelope information acquired by the high frequency band coded sequence analysis unit;

a high frequency band generation unit for generating, using the supplementary information for high frequency band generation decoded by the coded sequence decoding and dequantization unit, high frequency band components in the speech signal from the low frequency band signal transformed into the frequency domain by the frequency transformation unit;

a first to Nth (N is an integer of two or more) low frequency band time envelope calculation unit for analyzing the low frequency band signal transformed into the frequency domain by the frequency transformation unit and acquiring a plurality of low frequency band time envelopes;

a time envelope calculation unit for calculating a high frequency band time envelope using the time envelope information, which is acquired by the coded sequence decoding and dequantization unit, and the plurality of low frequency band time envelopes, which are acquired by the low frequency band time envelope calculation unit;

a frequency envelope superposition unit for superimposing the frequency envelope information, which is acquired by the coded sequence decoding and dequantization unit, onto the high frequency band time envelope and acquiring a time-frequency envelope;

a time-frequency envelope adjustment unit for adjusting, using the time envelope acquired by the time envelope calculation unit and the time-frequency envelope acquired by the frequency envelope superposition unit, a time envelope and a frequency envelope of the high frequency band components generated by the high frequency band generation unit; and a signal outputting unit for adding the high frequency band components, which are adjusted by the time-frequency envelope adjustment unit, and the low frequency band signal, which is decoded by the low frequency band decoding unit, and outputting a time domain signal containing entire frequency band components.

20. A non-transitory storage medium for storing a speech decoding program that decodes a coded sequence of encoded speech signal, the program causing a computer to function as:

a demultiplexing unit for demultiplexing the coded sequence into a low frequency band coded sequence and a high frequency band coded sequence;

a low frequency band decoding unit for decoding the low frequency band coded sequence demultiplexed by the demultiplexing unit and obtaining a low frequency band signal;

a frequency transformation unit for transforming the low frequency band signal obtained by the low frequency band decoding unit into a frequency domain;

a high frequency band coded sequence analysis unit for analyzing the high frequency band coded sequence demultiplexed by the demultiplexing unit and acquiring coded supplementary information for high frequency band generation, frequency envelope information, and time envelope information;

a coded sequence decoding and dequantization unit for decoding and inversely quantizing the supplementary information for high frequency band generation, the frequency envelope information, and the time envelope information acquired by the high frequency band coded sequence analysis unit;

a high frequency band generation unit for generating, using the supplementary information for high frequency band generation decoded by the coded sequence decoding and dequantization unit, high frequency band components in the speech signal from the low frequency band signal transformed into the frequency domain by the frequency transformation unit;

a first to Nth (N is an integer equal to or larger than two) low frequency band time envelope calculation unit for analyzing the low frequency band signal transformed into the frequency domain by the frequency transformation unit and acquiring a plurality of low frequency band time envelopes;

a time envelope calculation unit for calculating a high frequency band time envelope using the time envelope information, which is acquired by the coded sequence decoding and dequantization unit, and the plurality of low frequency band time envelopes, which are acquired by the low frequency band time envelope calculation unit;

a frequency envelope calculation unit for calculating a frequency envelope using the frequency envelope information acquired by the coded sequence decoding and dequantization unit;

a time-frequency envelope adjustment unit for adjusting, using the time envelope acquired by the time envelope calculation unit and the frequency envelope acquired by the frequency envelope calculation unit, a time envelope and a frequency envelope of the high frequency band components generated by the high frequency band generation unit; and a signal outputting unit for adding the high frequency band components, which are adjusted by the time-frequency envelope adjustment unit, and the low frequency band signal, which is decoded by the low frequency band decoding unit, and outputting a time domain signal containing entire frequency band components.

21. A non-transitory storage medium for storing a speech encoding program that encodes a speech signal, the program causing a computer to function as:

a frequency transformation unit for transforming the speech signal into a frequency domain;

a down-sampling unit for down-sampling the speech signal and acquiring a low frequency band signal;

a low frequency band encoding unit for encoding the low frequency band signal acquired by the down-sampling unit;

a first to Nth (N is an integer equal to or larger than two) low frequency band time envelope calculation unit for calculating a plurality of time envelopes of low frequency band components of the speech signal transformed into the frequency domain by the frequency transformation unit;

a time envelope information calculation unit for calculating, using the time envelopes of the low frequency band components calculated by the first to Nth low frequency band time envelope calculation unit, time envelope information necessary to acquire a time envelope of high frequency band components of the speech signal transformed by the frequency transformation unit;

a supplementary information calculation unit for analyzing the speech signal and calculating supplementary information for high frequency band generation to be used for generating high frequency band components from the low frequency band signal;

a quantization and encoding unit for quantizing and encoding the supplementary information for high frequency band generation, which is generated by the supplementary information calculation unit, and the time envelope information, which is calculated by the time envelope information calculation unit;

a coded sequence construction unit for constructing a high frequency band coded sequence from the supplementary information for high frequency band generation and the time envelope information quantized and encoded by the quantization and encoding unit; and a multiplexing unit for generating a coded sequence in which the low frequency band coded sequence, which is acquired by the low frequency band encoding unit, and the high frequency band coded sequence, which is constructed by the coded sequence construction unit, are multiplexed.

* * * * *